US007515111B2

(12) United States Patent
Tsujimura et al.

(10) Patent No.: US 7,515,111 B2
(45) Date of Patent: Apr. 7, 2009

(54) ANTENNA APPARATUS

(75) Inventors: Akihiro Tsujimura, Ome (JP); Koichi Sato, Fuchu (JP); Takashi Amano, Soka (JP); Hiroyuki Hotta, Ome (JP)

(73) Assignee: Kabushiki Kaisha Toshiba, Tokyo (JP)

( * ) Notice: Subject to any disclaimer, the term of this patent is extended or adjusted under 35 U.S.C. 154(b) by 154 days.

(21) Appl. No.: 11/515,304

(22) Filed: Sep. 1, 2006

(65) Prior Publication Data

US 2007/0273600 A1 Nov. 29, 2007

(30) Foreign Application Priority Data

May 26, 2006 (JP) ..... 2006-147282

(51) Int. Cl.
*H01Q 1/00* (2006.01)
*H01Q 9/28* (2006.01)

(52) U.S. Cl. ..... 343/787; 343/795

(58) Field of Classification Search ..... 343/702, 343/787, 795, 878
See application file for complete search history.

(56) References Cited

U.S. PATENT DOCUMENTS 7,088,304 B2 * 8/2006 Endo et al. ..... 343/788
2005/0162331 A1 * 7/2005 Endo et al. ..... 343/788
2007/0001921 A1 * 1/2007 Takahashi et al. ..... 343/788

FOREIGN PATENT DOCUMENTS

JP 2002-232316 A 8/2002
JP 2003-099733 A 4/2003
JP 2005-080023 A 3/2005
JP 2005-309811 A 11/2005

OTHER PUBLICATIONS

Trans. IEEE; Japan; vol. J87B, pp. 1327-1335; T. Tanaka et al; "A Study on Miniaturization of Antenna for Handset Utilizing Magnetic Materials"; Sep. 2004.

* cited by examiner

*Primary Examiner*—Shih-Chao Chen
(74) *Attorney, Agent, or Firm*—Frishauf, Holtz, Goodman & Chick, P.C.

(57) ABSTRACT

A magnetic member is interposed and arranged between an antenna element and a printed circuit board, and an air member or a dielectric member is interposed between the antenna element and the magnetic member. The magnetic member is constituted of a nanogranular structure in which magnetic nanoparticles with ferromagnetism are three-dimensionally dispersed and arranged in an insulating matrix substrate.

28 Claims, 29 Drawing Sheets

FIG. 5
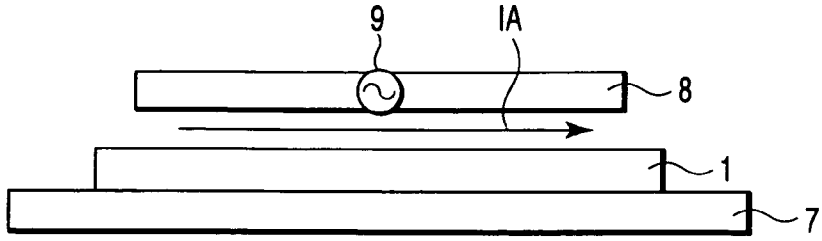
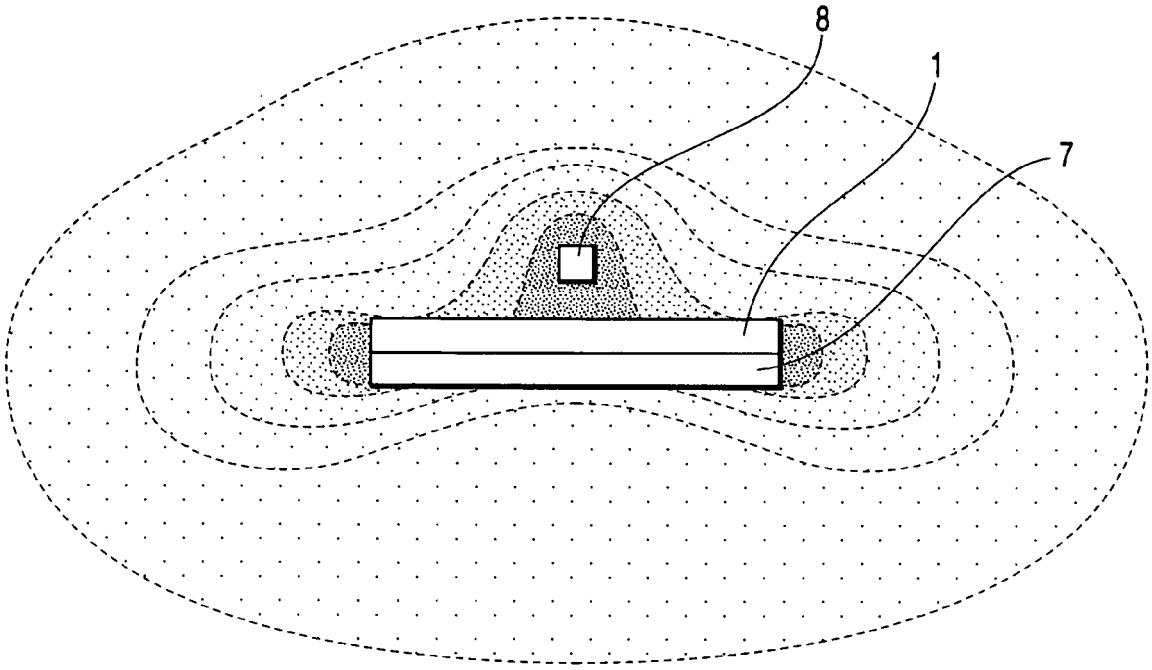
FIG. 6
FIG. 7
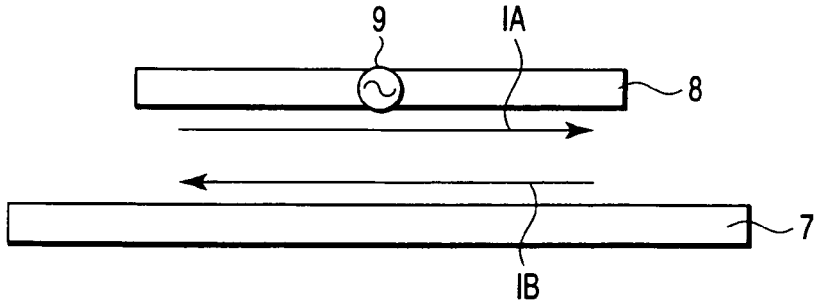
FIG. 8
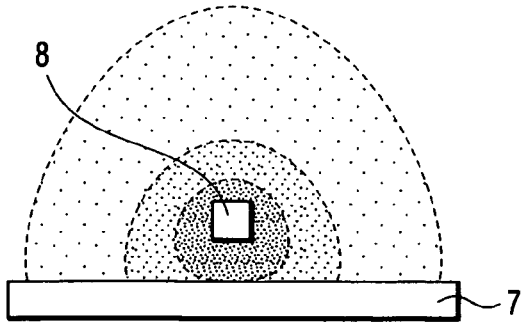

Magnetic permeability ($\mu$) = 40
Thickness (t) = 0.5mm

Magnetic permeability ($\mu$) = 40
Thickness (t) = 0.5mm

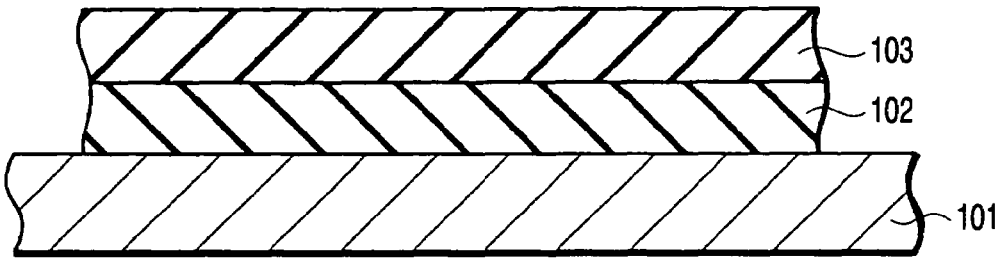
FIG. 45A
FIG. 45B
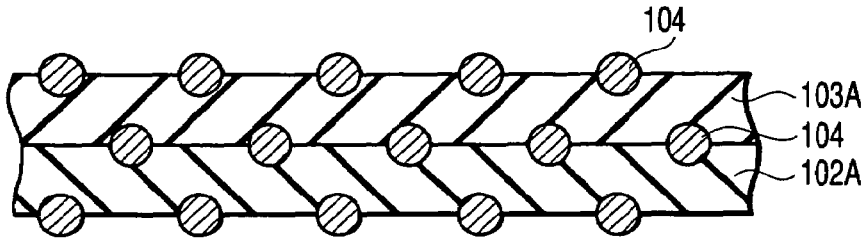
FIG. 45C
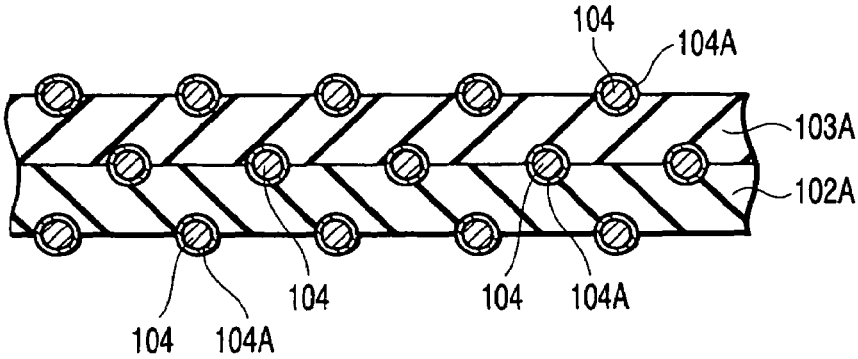
FIG. 45D
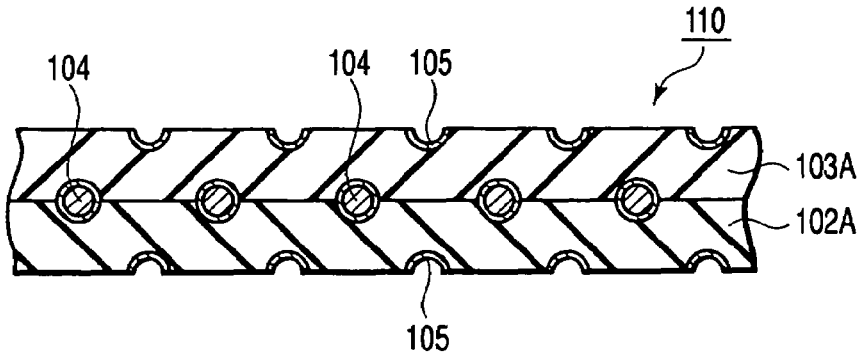

Three magnetic members each having thickness of 0.1mm are laminated
Magnetic permeability ($\mu$) = 40

ANTENNA APPARATUS

CROSS-REFERENCE TO RELATED APPLICATIONS

This application is based upon and claims the benefit of priority from prior Japanese Patent Application No. 2006-147282, filed May 26, 2006, the entire contents of which are incorporated herein by reference.

BACKGROUND OF THE INVENTION

1. Field of the Invention

The present invention relates to an antenna apparatus provided in a wireless communication device which requires a reduction in thickness (low profile), such as a mobile communication.

2. Description of the Related Art

In recent years, with a reduction in size and weight of electronic communication devices, a reduction in size and weight of electronic components has been demanded. A mobile communication terminal performs most of information propagation by transmission/reception of radio frequency waves. A frequency band of a currently utilized radio frequency is over 100 MHz. Thus, attention has been paid to electronic components and printed circuit boards which are useful in high frequency band such as a giga hertz.

In order to operate with radio frequency waves in such a high frequency band, an energy loss in electronic components must be small. For example, in an antenna apparatus used in a mobile communication terminal, radio frequency waves radiated from an antenna element produce a transmission loss in a propagation process. This transmission loss is transformed as a thermal energy in an electronic component and a printed circuit board to become a factor of heat generation in the electronic component, thereby offsetting radio frequency waves to be transmitted to the outside. Therefore, excessive intensive radio frequency waves more than necessary must be transmitted, and hence there is problem in effective use of the radio waves.

Thus, in a conventional antenna apparatus used in a mobile communication terminal, a distance between an antenna element, an electronic component and a printed circuit board is generally set large size so that radiation characteristics of radio frequency waves radiated from the antenna element are not greatly affected by the electronic component and the printed circuit board.

Further, as another countermeasure, there has been proposed a structure in which a magnetic material plate is arranged on a side opposite to a side where an antenna of a printed circuit board is set, for example (see, e.g., Jpn. Pat. Appln. KOKAI Publication No. 2002-232316).

However, when a distance between the antenna element, the electronic component and the printed circuit board is set large, the antenna apparatus is increased in size. As a result, an antenna apparatus accommodation space in a case of a mobile communication terminal becomes large, whereby an increase in size of the terminal is unavoidable. Furthermore, even if a magnetic material plate is arranged on the side opposite to the side where an antenna of the printed circuit board is set, antenna radiation characteristics are not improved. Therefore, a distance between the antenna element, the electronic component and the printed circuit board must be set large.

BRIEF SUMMARY OF THE INVENTION

In view of the above-described problems, it is an object of the present invention to provide an antenna apparatus which can realize both an improvement in antenna radiation efficiency and a reduction in size.

To achieve this object, according to the present invention, a magnetic member in which magnetic nanoparticles having ferromagnetism are dispersed and arranged in an insulating matrix substrate is interposed and arranged between an antenna element and a printed circuit board on which a metal surface applying ground potential to the antenna element is formed.

Therefore, according to the present invention, an input impedance between the antenna element and the printed circuit board can be improved by the magnetic member, whereby occurrence of an image current on the metal surface of the printed circuit board can be suppressed, thus improving antenna radiation characteristics. Moreover, a gap between the antenna element and the printed circuit board does not have to be set large for adjustment of an impedance matching, thereby reducing the size (reducing the thickness) of the antenna apparatus.

That is, according to the present invention, it is possible to provide the antenna apparatus which can achieve both an improvement in antenna radiation efficiency and a reduction in size.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out hereinafter.

BRIEF DESCRIPTION OF THE SEVERAL VIEWS OF THE DRAWING

The accompanying drawings, which are incorporated in and constitute a part of the specification, illustrate embodiments of the invention, and together with the general description given above and the detailed description of the embodiments given below, serve to explain the principles of the invention.

FIG. 5 is a view illustrating a function of the antenna apparatus depicted in FIG. 1;

FIG. 6 is a view illustrating the function of the antenna apparatus depicted in FIG. 1;

FIG. 7 is a view illustrating a function of a conventional antenna apparatus;

FIG. 8 is a view illustrating the function of the conventional antenna apparatus;

FIGS. 45A to 45D are process cross-sectional views showing a fifth manufacturing method of a magnetic member according to the present invention;

DETAILED DESCRIPTION OF THE INVENTION

Embodiments of an antenna apparatus according to the present invention will now be described hereinafter with reference to the accompanying drawings.

First Embodiment

In a first embodiment of an antenna apparatus according to the present invention, a magnetic member is interposed and arranged between elements of a dipole antenna and a printed circuit board, and an air member or a dielectric member is interposed between the elements of the dipole antenna and the magnetic member.

Figure 1:
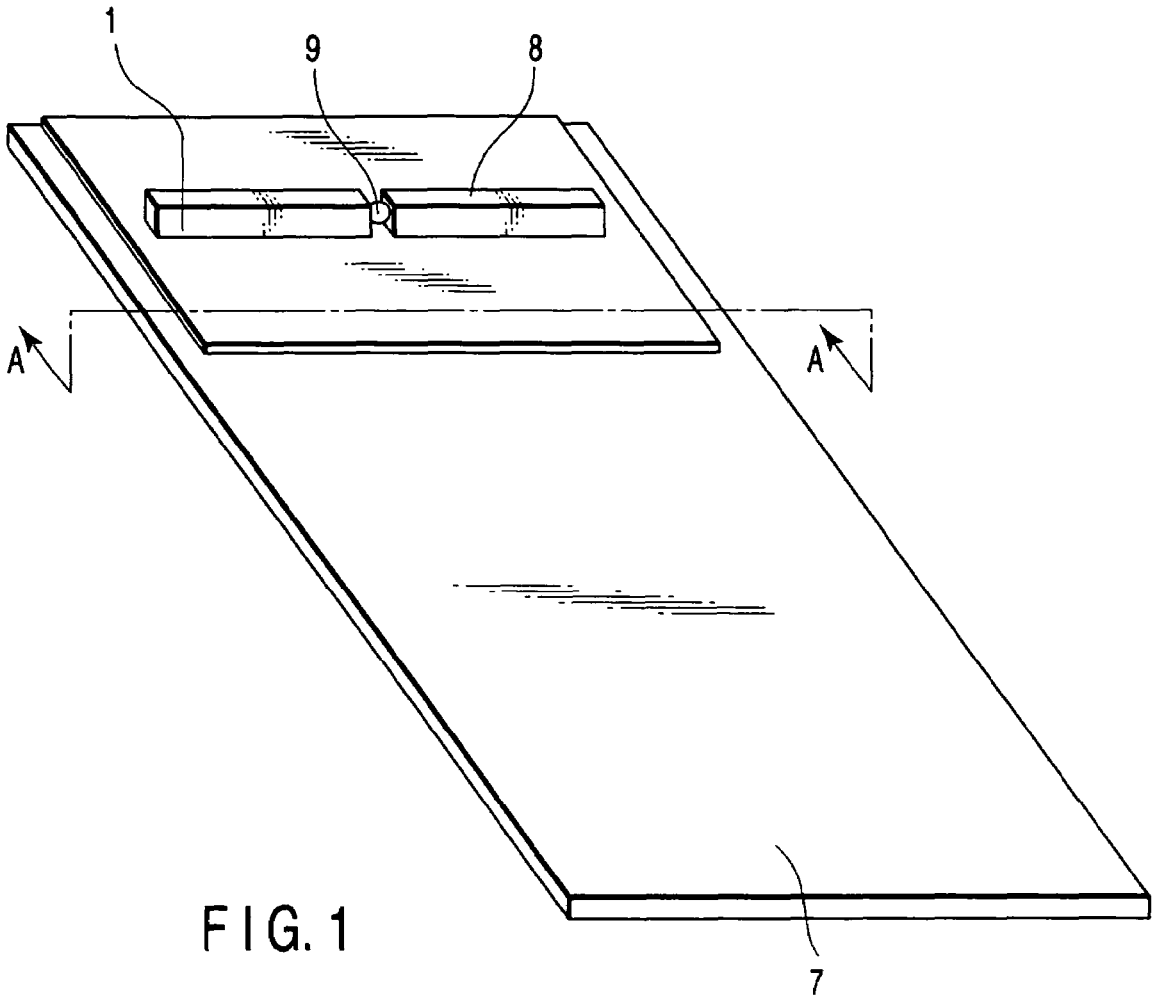
FIG. 1 is a perspective view showing a first embodiment of an antenna apparatus according to the present invention.
Figure 2:
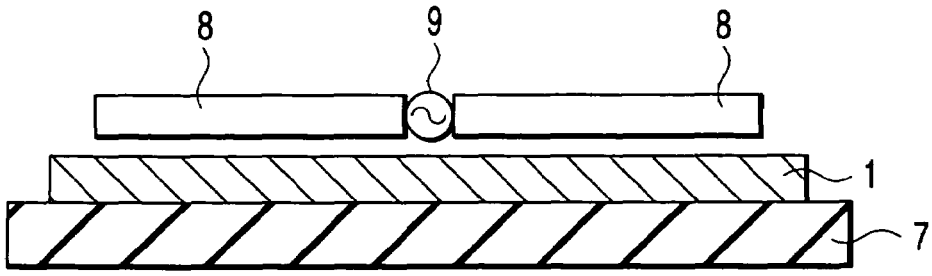
FIG. 2 is a cross-sectional view of the antenna apparatus taken along a line A-A depicted in FIG. 1.

FIG. 1 is a perspective view showing a configuration of the antenna apparatus according to the first embodiment of the present invention, and FIG. 2 is a cross-sectional view taken along a line A-A in FIG. 1. In these drawings, reference numerals denote an element of a dipole antenna (which will be referred to as an antenna element hereinafter), and 7 designates a printed circuit board. The antenna element 8 is formed of a linear antenna such as a dipole antenna, and fixed and held on a rear surface of a case of a non-illustrated mobile communication terminal, for example.

The printed circuit board 7 is constituted of, e.g., a multi-member board. On a surface member of these substrate members are mounted various kinds of electronic components such as a central processing unit (CPU), a memory, large-scale integrated circuits (LSIs), terminals and others. These electronic components constitute electrical circuits which operate the mobile communication terminal. For example, one of the LSIs constitutes a radio frequency circuit, and a wireless transmission signal output from this radio frequency circuit is supplied to a feed point 9 of the antenna element 8 through a signal line pattern. Further, a metal surface serving as a ground pattern is formed on one of the respective substrate members. This metal surface gives a ground potential to the various kinds of electronic components and the antenna elements 8.

Meanwhile, a magnetic member 1 is interposed and arranged at a position on the printed circuit board 7 facing the antenna element 8. The magnetic member 1 has a nanogranular structure in which magnetic nanoparticles are three-dimensionally dispersed and arranged in an insulating matrix substrate, and is formed into a tabular shape.

As the insulating matrix substrate, there is used, e.g., rubber, an insulative resin, or an insulative ceramic. As the magnetic nanoparticle, a metal particle having ferromagnetism is used. The ferromagnetism means properties that a magnetic moment is regularly arranged to spontaneously form magnetization even though an external magnetic field does not exist, and there are, e.g., Co, Fe and Ni as a metal particle having such properties. The magnetic member 1 having such a structure is characterized in that its relative permeability $\mu$ is high, its loss is low and its film thickness can be readily increased. Furthermore, an air member or a dielectric member is interposed and provided between the magnetic member 1 and the antenna element 8 as shown in FIG. 2.

As described above, according to the first embodiment, the magnetic member 1 having the high permeability is interposed and arranged between the antenna element 8 and the ground plane of the printed circuit board 7. Moreover, the air member or the dielectric member is interposed and arranged between the magnetic member 1 and the antenna element 8. Therefore, high input impedance can be maintained.

Figure 3A:
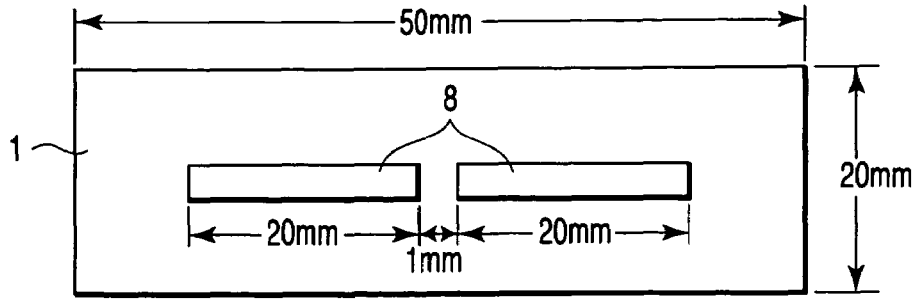
FIGS. 3A and 3B are a plan view and a cross-sectional view showing an example of a dimension of the antenna apparatus depicted in FIG. 1, respectively.
Figure 3B:
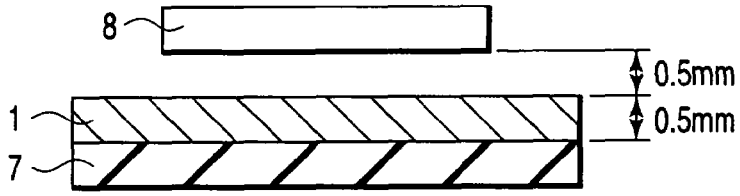
Figure 4:
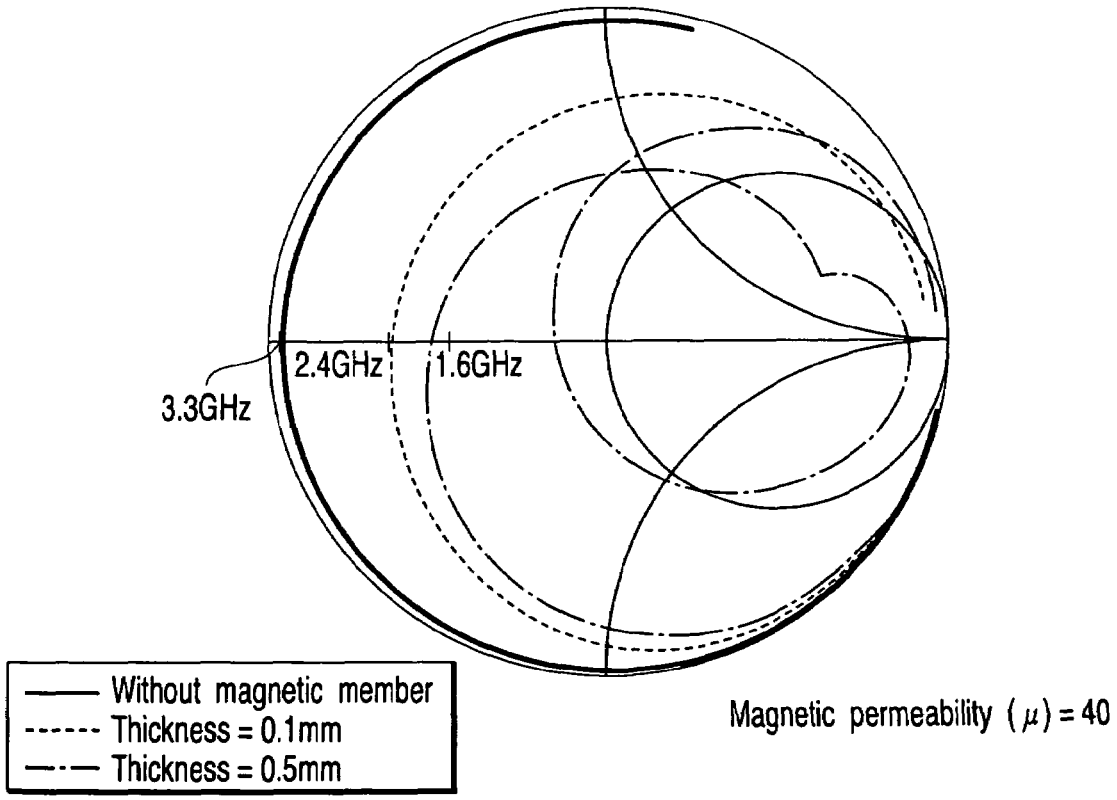
FIG. 4 is a view showing input impedance characteristics of the antenna apparatus depicted in FIG. 1.

For example, as shown in FIGS. 3A and 3B, it is assumed that the magnetic member 1 has a vertical and horizontal dimension of 50×20 mm, a thickness of 0.5 mm and relative permeability $\mu$=40, a structure in which two lines each having a length of 20 mm are arranged with a 1-mm gap there between is used as the antenna element 8, and the air member or the dielectric member is interposed between the magnetic member 1 and the antenna element 8. Additionally, when input impedance characteristics is analyzed while changing a radio frequency in a range of 1 to 4 GHz under such conditions, input impedance characteristics indicated by an alternate long and short dash line in FIG. 4 can be obtained. As apparent from such characteristics, a high value, e.g., 17 Ω of the input impedance can be maintained even in a resonance frequency. It is to be noted that input impedance characteristics indicated by a broken line in FIG. 4 can be obtained when a magnetic material having a thickness of 0.1 mm is used, and input impedance characteristics indicated by a solid line in FIG. 4 can be obtained when the magnetic member 1 is not interposed and arranged. As apparent from comparison between these characteristics, using the magnetic member 1 according to the present invention can maintain high input impedance.

Therefore, above a ground plane of the printed circuit board 7, it is hard for an image (a equal charge of the opposite phase to an antenna current IA flowing through the antenna elements 8 as shown in FIG. 5) to flow. Further, it is possible to reduce an inconvenience that noise generated from the electronic components or the like on the printed circuit board 7 is superimposed on the antenna current of the antenna element 8.

That is, using the magnetic member 1 according to the present invention can demonstrate a high isolation effect between the antenna element 8 and the ground plane of the printed circuit board 7, thereby enhancing antenna radiation characteristics. FIG. 6 schematically shows an intensity distribution of a magnetic field distribution obtained by the antenna apparatus depicted in FIG. 5, and illustrates that a magnetic field has a higher intensity as a concentration is high. It is to be noted that FIG. 6 shows the intensity distribution from a longitudinal direction of the antenna element 8.

It is to be noted that, in a structure where the magnetic member 1 is not interposed and arranged and the printed circuit board 7 and the antenna element 8 are arranged to face each other as shown in FIG. 7, an image IB flows above the ground plane of the printed circuit board 7 and this current functions to offset the antenna current IA. Therefore, the intensity distribution of the magnetic field representing radiation characteristics of the antenna is weak as a radiation power as shown in FIG. 8, thereby reducing the antenna radiation efficiency.

Moreover, since an input impedance characteristic between the antenna elements 8 and the ground plane of the printed circuit board 7 can be set high, a gap between the antenna element 8 and the printed circuit board 7 facing each other can be reduced. Therefore, a thickness of the antenna apparatus can be reduced, and an accommodation space for the antenna apparatus in a case of the mobile communication terminal can be decreased, thereby achieving a compact size of the mobile communication terminal.

Second Embodiment

In a second embodiment of an antenna apparatus according to the present invention, a magnetic member is interposed and arranged between an element of a dipole antenna and a printed circuit board, and an air member or a dielectric member is interposed between the magnetic member and the printed circuit board.

Figure 9:
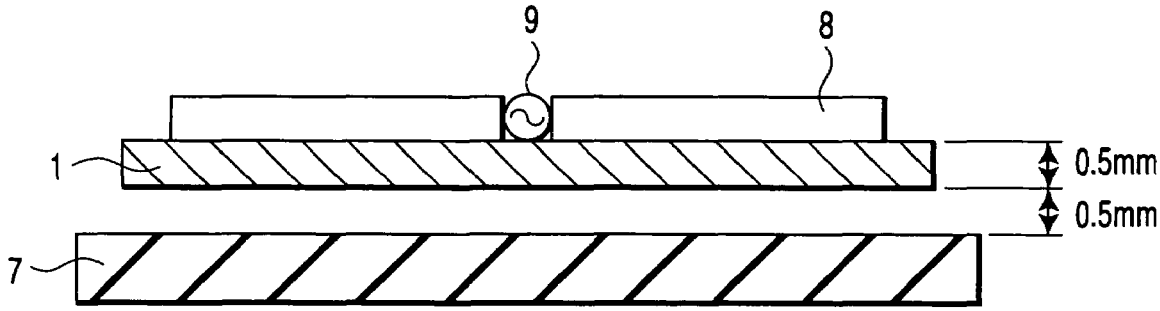
FIG. 9 is a cross-sectional view showing a second embodiment of an antenna apparatus according to the present invention.

FIG. 9 is a cross-sectional view showing a configuration of an antenna apparatus according to the second embodiment of the present invention. A magnetic member 1 is interposed and arranged between a ground plane of a printed circuit board 7 and elements 8 of a dipole antenna in a state where the magnetic member 1 is in contact with the antenna element 8. Further, an air member or a dielectric member is interposed between the magnetic member 1 and the printed circuit board 7. It is to be noted that a configuration of each of the antenna element 8, the printed circuit board 7 and the magnetic member 1 is the same as that described in the first embodiment, and hence the explanation thereof is omitted.

Figure 10:
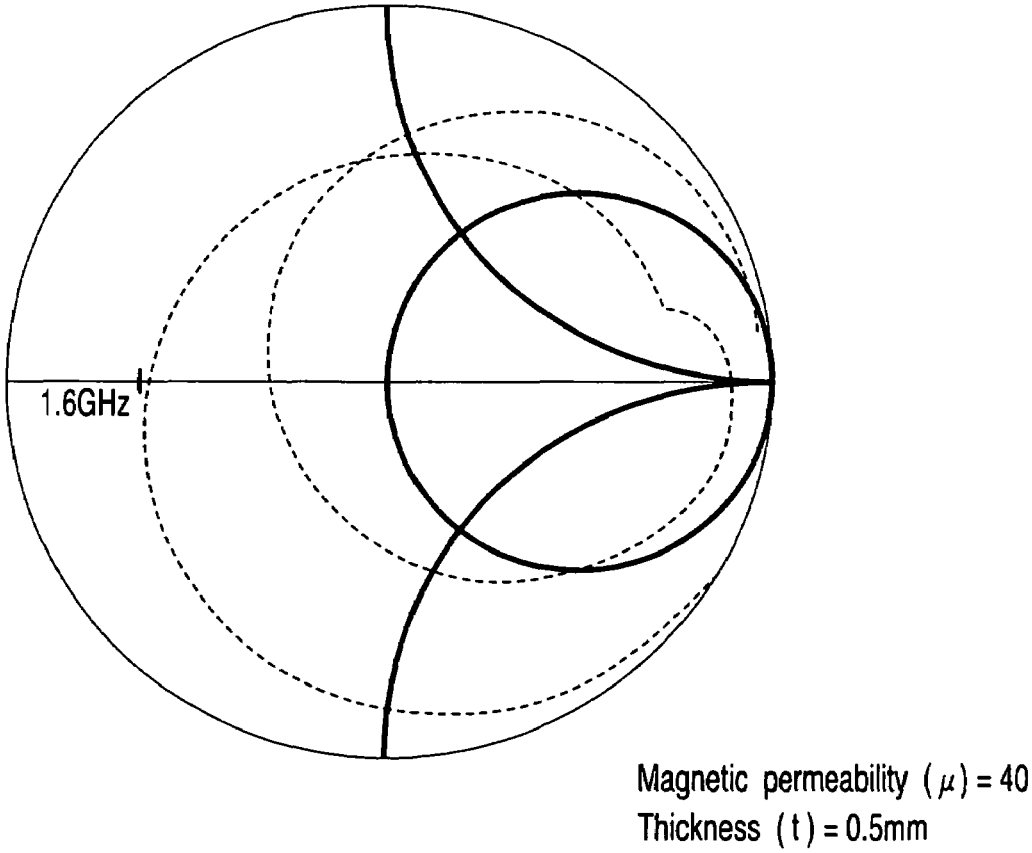
FIG. 10 is a view showing input impedance characteristics of the antenna apparatus depicted in FIG. 9.

Therefore, according to the second embodiment, the magnetic member 1 having high permeability is interposed and arranged between the antenna element 8 and the ground plane of the printed circuit board 7. Furthermore, the air member or the dielectric member is interposed and arranged between the magnetic member 1 and the printed circuit board 7. As a result, high input impedance can be maintained. For example, in a structure that the magnetic member 1 has relative permeability μ of 40 and a thickness of 0.5 mm and the air member or the dielectric member which is 0.5 mm is interposed between the magnetic member 1 and the printed circuit board 7, when an input impedance is analyzed while changing a radio frequency in a range of 1 to 4 GHz, input impedance characteristics indicated by a broken line in FIG. 10 can be obtained. As apparent from such characteristics, the input impedance can be likewise set to a high value in this structure according to this embodiment.

Therefore, like the first embodiment, an image above the ground plane of the printed circuit board 7 is suppressed to be small, and an inconvenience that noise generated from electronic components or the like on the printed circuit board 7 is superimposed on an antenna current of the antenna element 8 can be reduced. Moreover, since the input impedance between the antenna element 8 and the ground plane of the printed circuit board 7 can be set high, thereby reducing a gap between the antenna element 8 and the printed circuit board 7 facing each other. Therefore, a thickness of the antenna apparatus can be reduced, whereby an accommodation space for the antenna apparatus in a case of a mobile communication terminal can be decreased, thus achieving a small size of the mobile communication terminal.

Third Embodiment

According to a third embodiment of an antenna apparatus of the present invention, a magnetic member is interposed and arranged between the element of a dipole antenna and a printed circuit board, and an air member or a dielectric member is interposed between the magnetic member and the printed circuit board and between the magnetic member and the antenna elements.

Figure 11:
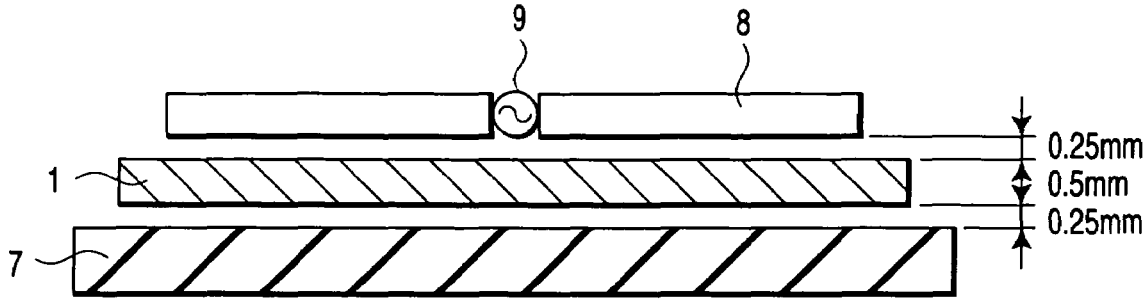
FIG. 11 is a cross-sectional view showing a third embodiment of an antenna apparatus according to the present invention.

FIG. 11 is a cross-sectional showing a configuration of an antenna apparatus according to the third embodiment of the present invention. A magnetic member 1 is interposed and arranged between a ground plane of a printed circuit board 7 and the element 8 of a dipole antenna. Further, an air member or a dielectric member is interposed between this magnetic member 1 and the printed circuit board 7 and between the magnetic member 1 and the antenna element 8, respectively. It is to be noted a structure of each of the antenna element 8, the printed circuit board 7 and the magnetic member 1 is the same as that described in the first embodiment, and hence the explanation thereof is omitted.

Figure 12:
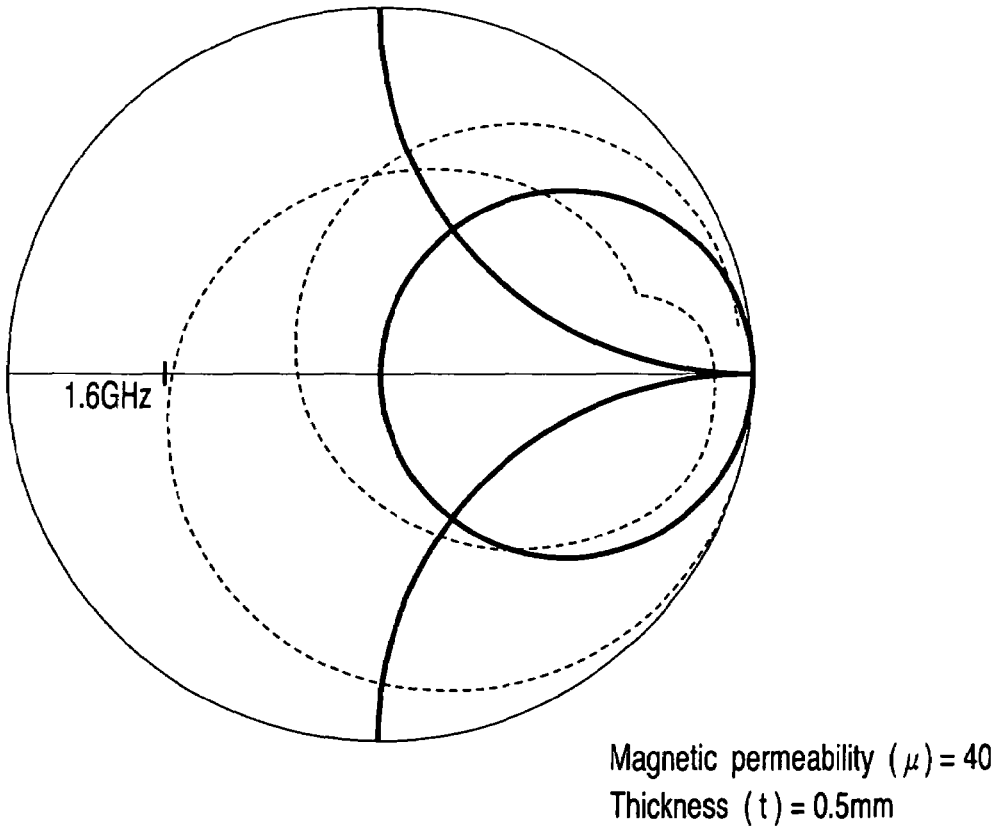
FIG. 12 is a view showing input impedance characteristics of the antenna apparatus depicted in FIG. 11.

Therefore, in the third embodiment, the magnetic member 1 having high permeability is interposed and arranged between the antenna elements 8 and the ground plane of the printed circuit board 7, and the air member or the dielectric member is interposed between the magnetic member 1 and the printed circuit board 7 and between the magnetic member 1 and the antenna element 8, respectively. Therefore, high input impedance can be maintained. For example, like the first and second embodiments, when the magnetic member 1 has relative permeability μ of 40 and a thickness of 0.5 mm and the air member or the dielectric member which is 0.5 mm is interposed between the magnetic member 1 and the printed circuit board 7 and between the magnetic member 1 and the antenna elements 8, respectively, input impedance characteristics are as indicated by broken lines in FIG. 12. As apparent from such characteristics, the input impedance can be likewise set to a high value in this embodiment.

Fourth Embodiment

In a fourth embodiment according to the present invention, when interposing and arranging a magnetic member between a ground plane of a printed circuit board and the element of a dipole antenna, the magnetic member is arranged to face a feed point and intermediate portions excluding both end portions of the antenna element.

Figure 13:
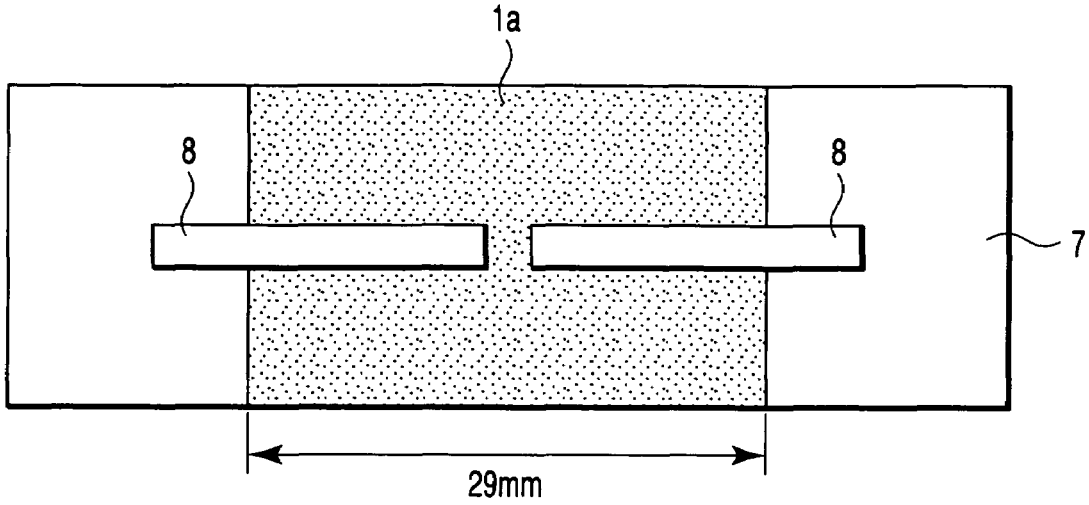
FIG. 13 is a plan view showing a fourth embodiment of an antenna apparatus according to the present invention.

FIG. 13 is a plan view showing this configuration. As shown in this drawing, a wide magnetic member 1*a* is arranged on a ground plane of a printed circuit board 7 to face a feed point and an intermediate portion of each element 8 of a dipole element excluding both end portions thereof. It is to be noted that each of the antenna element 8, the printed circuit board 7 and the magnetic member 1*a* is the same as that described in the first embodiment.

Figure 14:
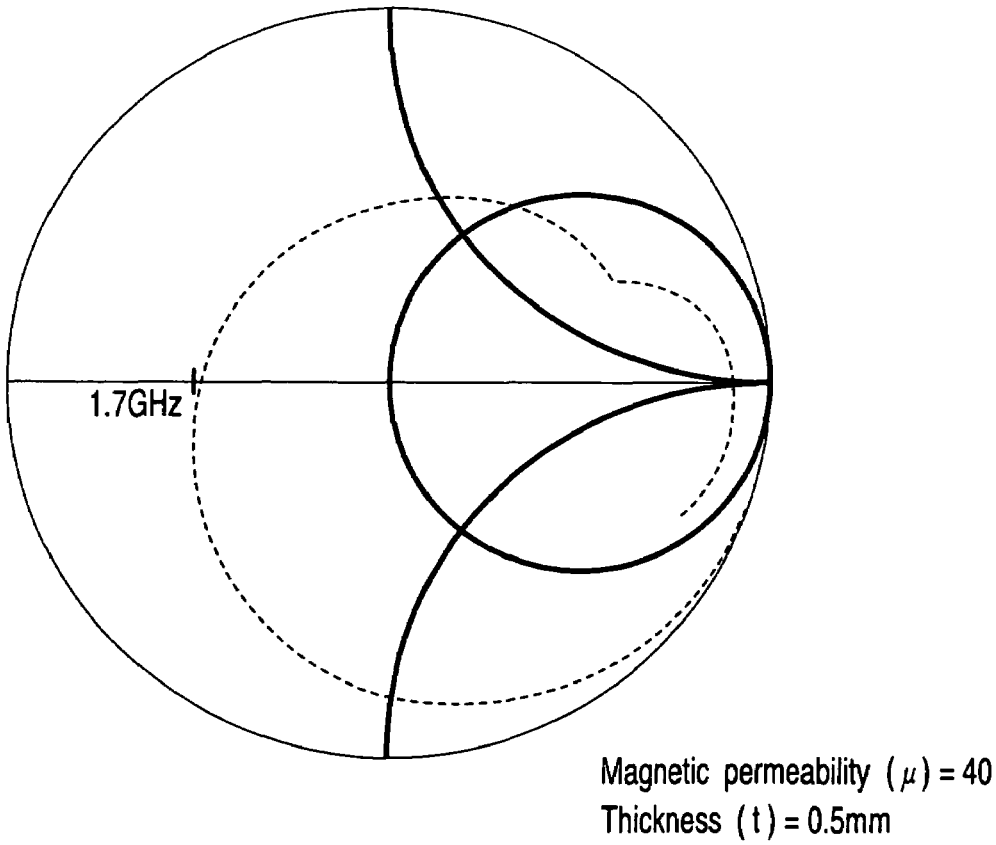
FIG. 14 is a view showing input impedance characteristics of the antenna apparatus depicted in FIG. 13.

Since such a configuration is adopted, the high input impedance can be maintained by a function of the magnetic member 1*a* with high permeability interposed and arranged between the feed point and the intermediate portions of the antenna element 8 excluding both end portions thereof and the ground plane of the printed circuit board 7. For example, when the magnetic member 1*a* has relative permeability μ of 40, a thickness of 0.5 mm and a width length of 29 mm, input impedance characteristics are as indicted by a broken line in FIG. 14. As apparent from such characteristics, the input impedance can be likewise set to a high value in this embodiment.

Fifth Embodiment

In a fifth embodiment according to the present invention, when interposing and arranging a magnetic member between a ground plane of a printed circuit substrate and element of a dipole antenna, the magnetic member is arranged to face a part of each antenna element which is close to and includes a feed point thereof.

Figure 15:
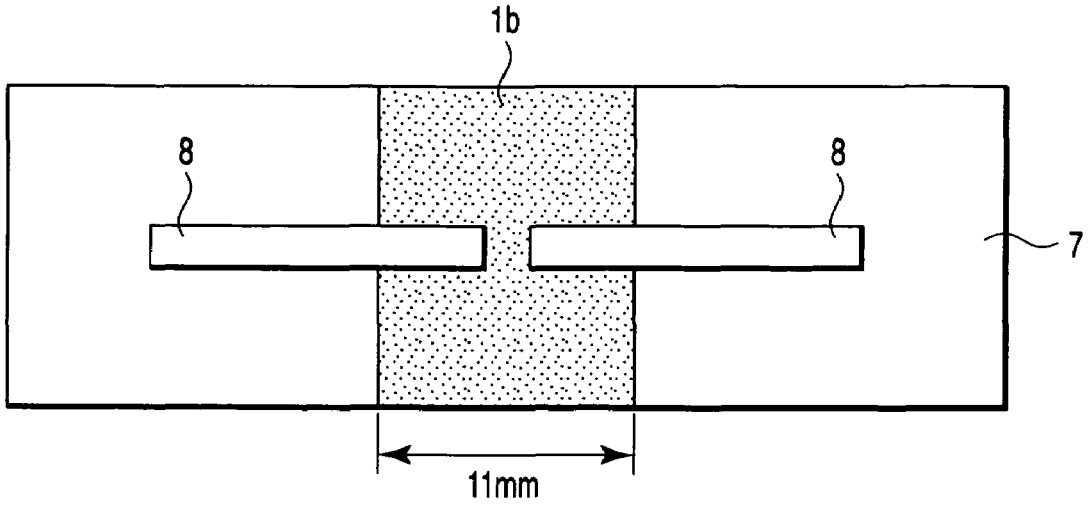
FIG. 15 is a plan view showing a fifth embodiment of an antenna apparatus according to the present invention.

FIG. 15 is a plan view showing this structure. As shown in the drawing, a magnetic member 1*b* is arranged on a ground plane of a printed circuit board 7 to face a part of each antenna element 8 which is close to and includes a feed point thereof. It is to be noted that a structure of each antenna element 8, the printed circuit board 7 and the magnetic member 1*b* is the same as that described in the first embodiment.

Figure 16:
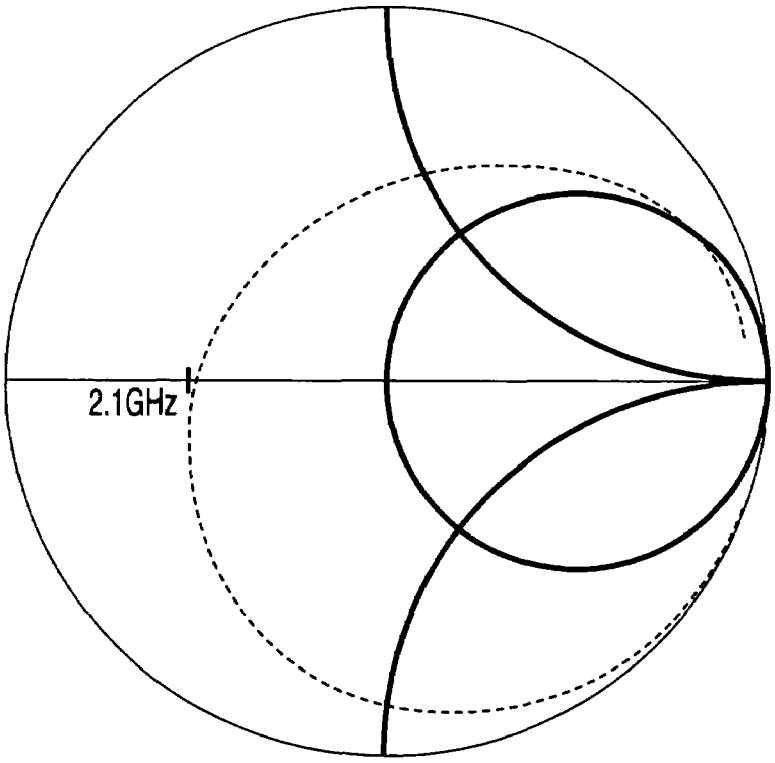
FIG. 16 is a view showing input impedance characteristics of the antenna apparatus depicted in FIG. 15.

Since such a configuration is adopted, high input impedance characteristic can be maintained by a function of the magnetic member 1*b* with high permeability which is interposed and arranged between the part of each antenna element which is close to and includes the feed point 9 and the ground plane of the printed circuit board 7. For example, when the magnetic member 1*b* has relative permeability μ of 40, a thickness of 0.5 mm and a width length of 11 mm, input impedance characteristics are as indicated by a broken line in FIG. 16. As apparent from such input impedance characteristics, it is good enough to arrange the magnetic member 1*b* to face at least the part of each antenna element 8 which is close to an includes the feed point 9. According to this configuration, a size of the magnetic member 1*b* can be reduced, thereby decreasing cost.

Sixth Embodiment

In a sixth embodiment according to the present invention, when interposing and arranging a magnetic member between a ground plane of a printed circuit board and element of a dipole element, the magnetic member is arranged to face only a part of each antenna element which is close to a feed point thereon.

Figure 17:
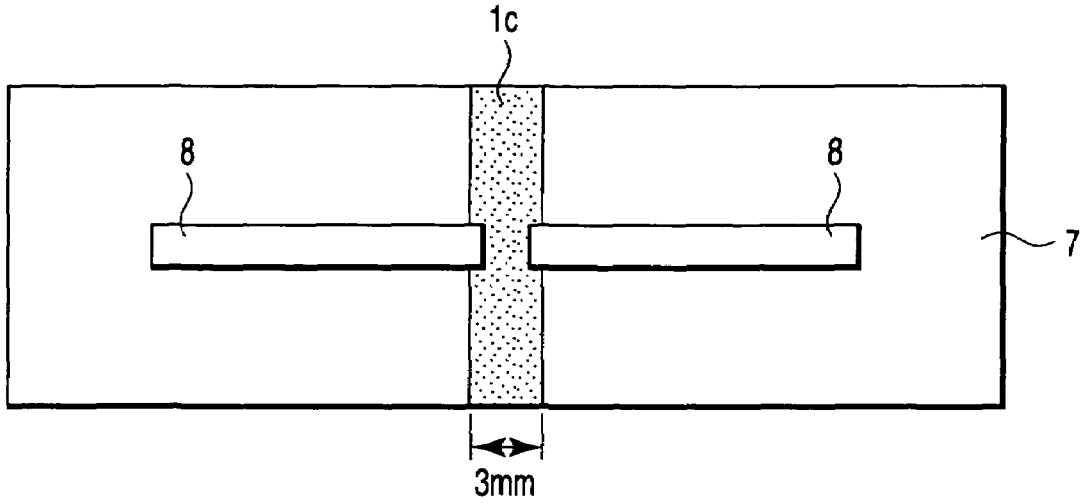
FIG. 17 is a plan view showing a sixth embodiment of an antenna apparatus according to the present invention.

FIG. 17 is a plan view showing this structure. As shown in this drawing, a strip-like magnetic member 1*c* is arranged on a ground plane of a printed circuit board 7 to face only a part of each antenna element 8 close to a feed point 9. It is to be noted that a structure of each antenna element 8, the printed circuit board 7 and the magnetic member 1*c* is the same as that described in the first embodiment.

Figure 18:
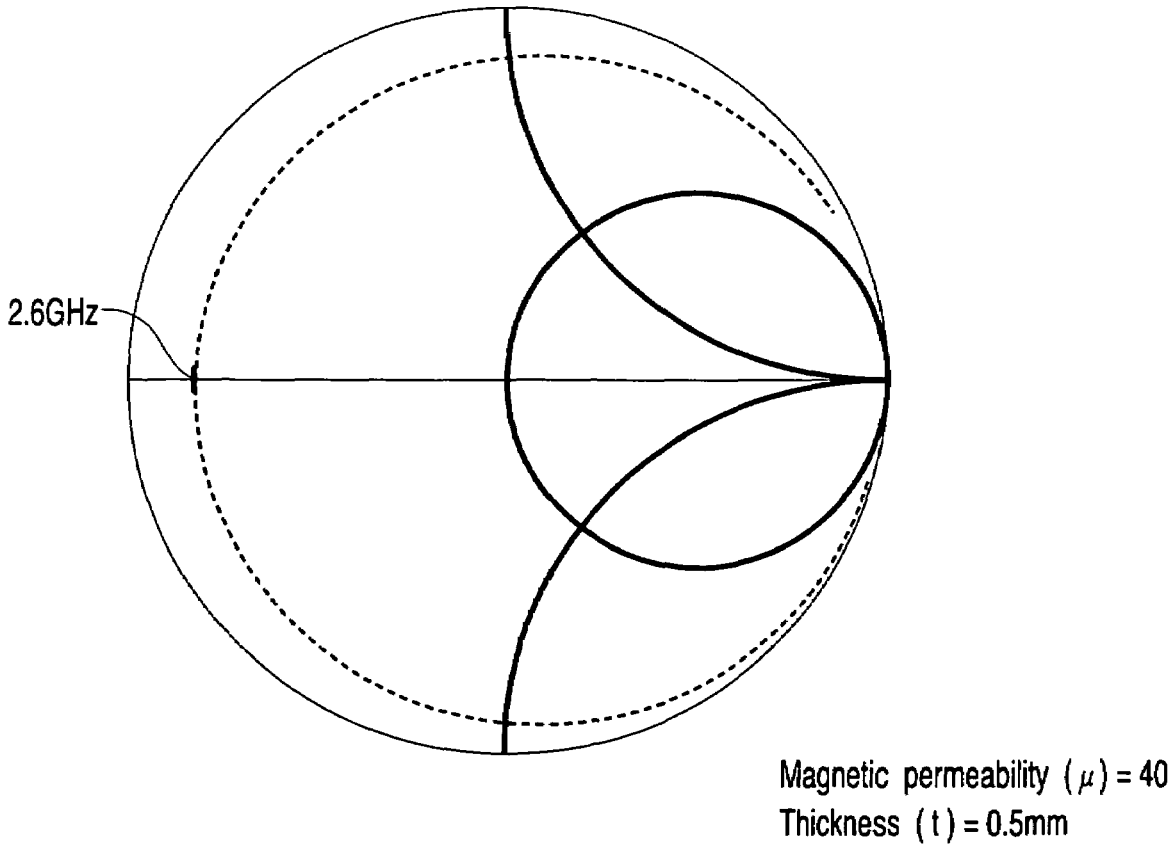
FIG. 18 is a view showing input impedance characteristics of the antenna apparatus depicted in FIG. 17.

Even in such a configuration, input impedance characteristic can be set high as compared with a prior art in which the magnetic member is not used. For example, when the magnetic member 1*c* has relative permeability μ of 40, a thickness of 0.5 mm and a width length of 3 mm, input impedance characteristics are as indicated by a broken line in FIG. 18. As indicated by such characteristics, in the sixth embodiment, although a value of the input impedance is lowered as compared with the fifth embodiment, it is obviously improved as compared with an example (a solid line in FIG. 4) where the magnetic member is not interposed and arranged. That is, according to the sixth embodiment, just providing the magnetic member 1*c* which is small can greatly improve the input impedance characteristics.

Seventh Embodiment

In a seventh embodiment according to the present invention, when interposing and arranging magnetic members between a ground plane of a printed circuit board and elements of a dipole antenna, the magnetic members are respectively arranged to face intermediate portions alone of the pair of elements constituting the dipole antenna.

Figure 19:
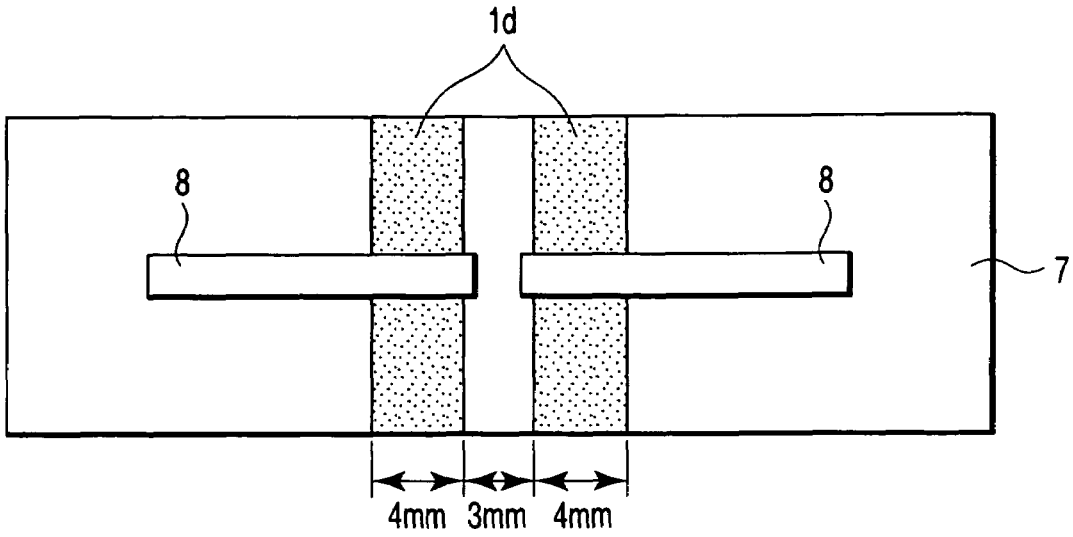
FIG. 19 is a plan view showing a seventh embodiment of an antenna apparatus according to the present invention.

FIG. 19 is a plan view showing this structure. As shown in this drawing, magnetic members 1*d* and 1*d* are respectively arranged on a ground plane of a printed circuit board 7 to face intermediate portions alone of a pair of elements 8 and 8 constituting a dipole antenna. It is to be noted that a structure of each antenna element 8 and 8, the printed circuit board 7 and the magnetic members 1*d* and 1*d* is the same as that described in the first embodiment.

Figure 20:
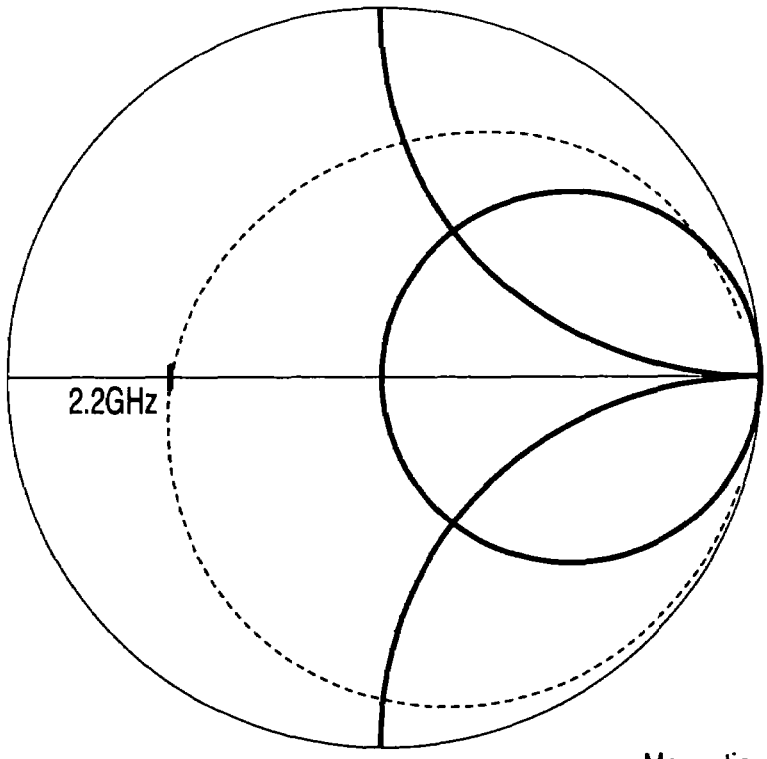
FIG. 20 is a view showing input impedance characteristics of the antenna apparatus depicted in FIG. 19.

Even if the magnetic members 1*d* and 1*d* are provided to avoid a feed point 9 in this manner, enough high input impedance can be maintained. For example, when the magnetic members 1*d* and 1*d* have relative permeability μ of 40, a thickness of 0.5 mm, a width length of 4 mm and are arranged with a gap of 3 mm there between, input impedance characteristics are as indicated by a broken line in FIG. 20. That is, equivalent functions and effects can be demonstrated by arranging the magnetic members 1*d* and 1*d* to face the intermediate portions alone of the pair of elements 8 and 8 constituting the dipole antenna in place of arranging the magnetic member to face a region including the feed point 9 of the antenna element 8.

Eighth Embodiment

In an eighth embodiment according to the present invention, when interposing and arranging magnetic members between a ground plane of a printed circuit board and elements of a dipole antenna, strip-like magnetic members each having a narrow width are respectively arrange to face parts of respective intermediate portions of the pair of elements constituting the dipole antenna close to ends thereof.

Figure 21:
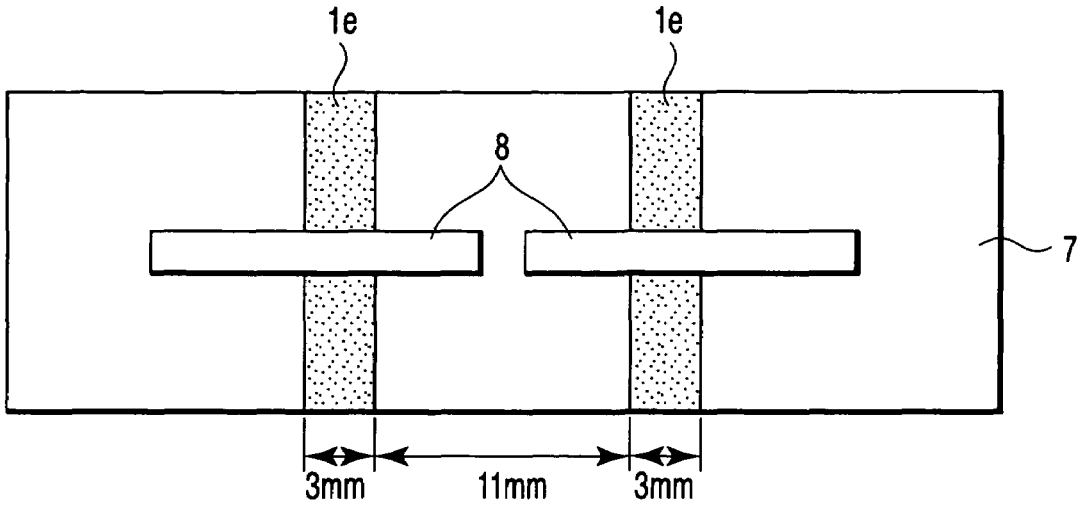
FIG. 21 is a plan view showing an eight embodiment of an antenna apparatus according to the present invention.

FIG. 21 is a plan view showing this structure. As shown in this drawing, strip-like magnetic members 1*e* and 1*e* each having a narrow width are respectively arranged on a ground plane of a printed circuit board 7 to face parts of intermediate portions of a pair of elements 8 and 8 constituting a dipole antenna close to ends thereof. It is to be noted that a structure of each antenna element 8 and 8, the printed circuit board 7 and the magnetic members 1*e* and 1*e* is the same as that described in the first embodiment.

Figure 22:
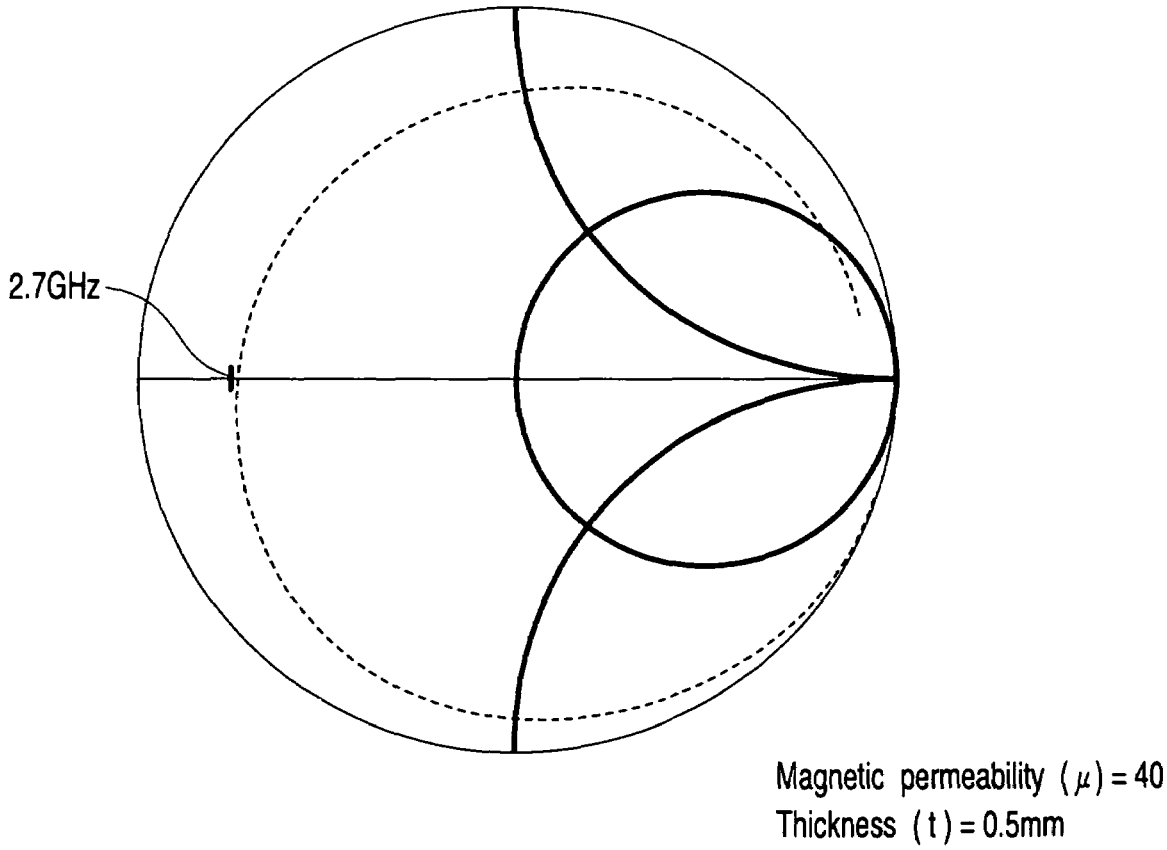
FIG. 22 is a view showing input impedance characteristics of the antenna apparatus depicted in FIG. 21.

Even if such magnetic members 1*e* and 1*e* are provided, input impedance characteristic can be maintained even though it is slightly lower than that in the seventh embodiment. For example, when the magnetic members 1*e* and 1*e* have relative permeability μ of 40, a thickness of 0.5 mm and a width length of 3 mm and are arranged with a gap of 11 mm there between, input impedance characteristics are as indicated by a broken line in FIG. 22. That is, arranging the magnetic members 1*e* and 1*e* to face the antenna elements 8 and 8 can obtain an effect of improving the input impedance irrespective of arrangement positions of these members.

Ninth Embodiment

In a ninth embodiment according to the present invention, when interposing and arranging magnetic members between a ground plane of a printed circuit board and element of a dipole antenna, strip-like magnetic members each having a narrow width are respectively arranged to face parts of intermediate portions of the pair of elements constituting the dipole antenna close to a feed point.

Figure 23:
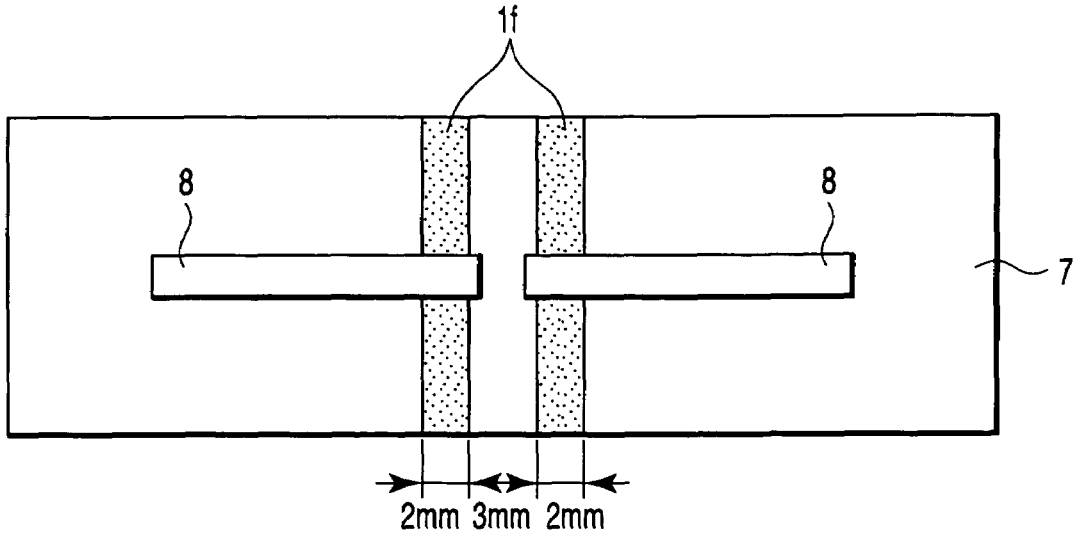
FIG. 23 is a plan view showing a ninth embodiment of an antenna apparatus according to the present invention.

FIG. 23 is a plan view showing this structure. As shown in the drawing, strip-like magnetic members 1*f* and 1*f* each having a narrow width are respectively arranged on a ground plane of a printed circuit board 7 to face parts of intermediate portions of a pair of elements 8 and 8 constituting a dipole antenna close to a feed point 9. It is to be noted that a structure of each antenna element 8 and 8, the printed circuit board 7 and the magnetic members 1*f* and 1*f* is the same as that described in the first embodiment.

Figure 24:
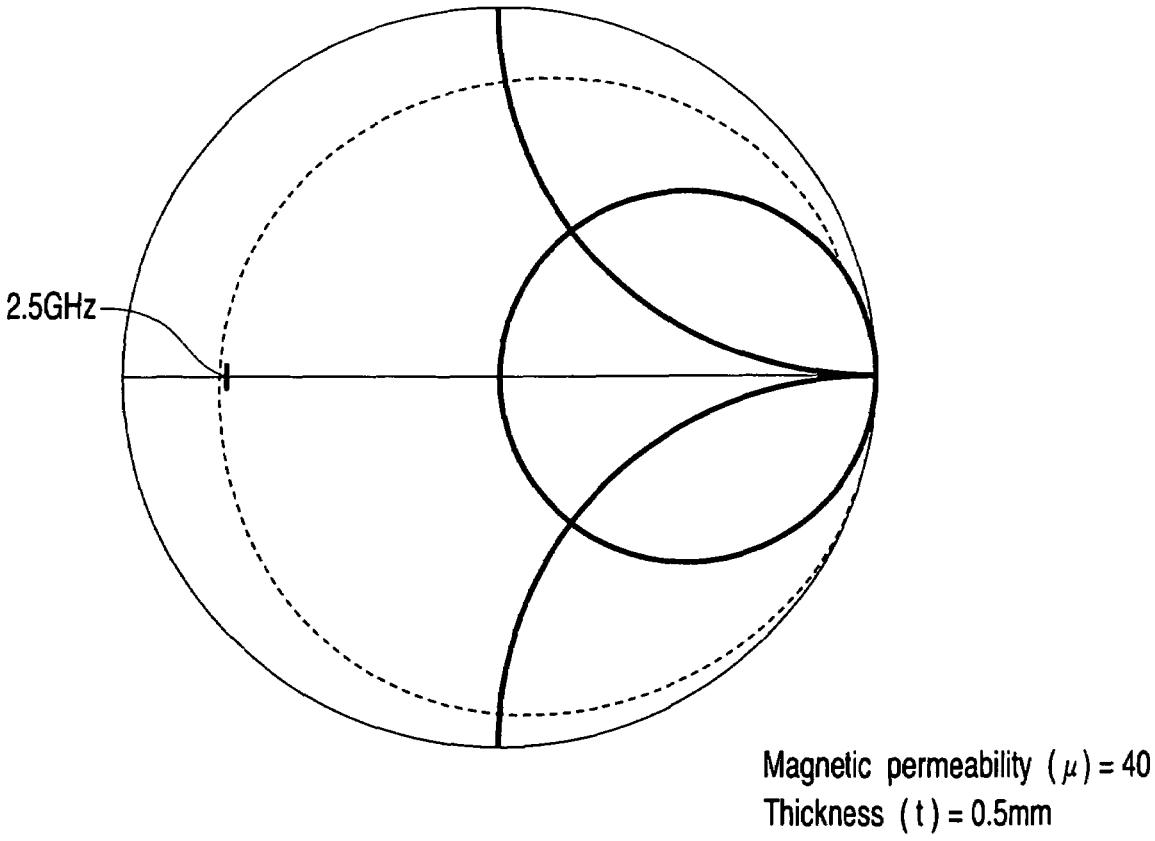
FIG. 24 is a view showing input impedance characteristics of the antenna apparatus depicted in FIG. 23.

Even if such magnetic members 1*f* and 1*f* are provided, a higher input impedance can be set as compared with a case where the magnetic members are not provided. For example, when the magnetic members 1*f* and if have relative permeability μ of 40, a width of 0.5 mm and a width length of 2 mm and are arranged with a gap of 3 mm there between, input impedance characteristics are as indicated by a broken line in FIG. 24. That is, like the eighth embodiment, arranging the magnetic members 1*f* and 1*f* to face the antenna elements 8 and 8 can obtain an effect of improving the input impedance irrespective of the opposing positions and the width length.

10th Embodiment

In a 10th embodiment according to the present invention, a magnetic member has a structure in which a plurality of magnetic material plates are superimposed through a dielectric member, and the magnetic member is interposed and arranged between a printed circuit board and elements of a dipole antenna. Further, each of the plurality of magnetic material plates is set to a size with which it faces intermediate portions alone of the antenna elements including a feed point.

Figure 25:
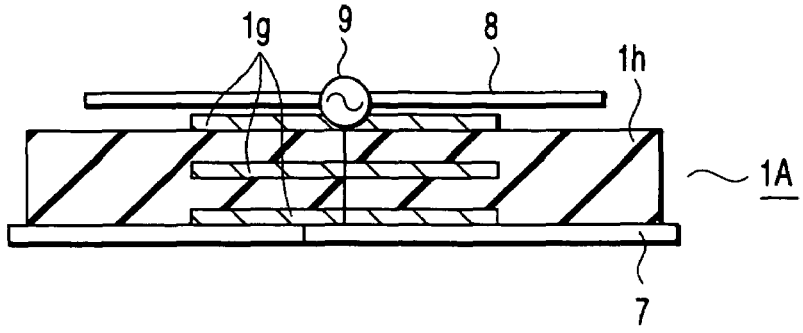
FIG. 25 is a cross-sectional view showing a 10th embodiment of an antenna apparatus according to the present invention.
Figure 27:
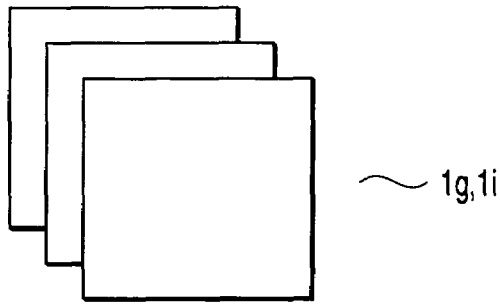
FIG. 27 is a view showing a configuration of a magnetic member used in the apparatus depicted in FIG. 25.
Figure 28:
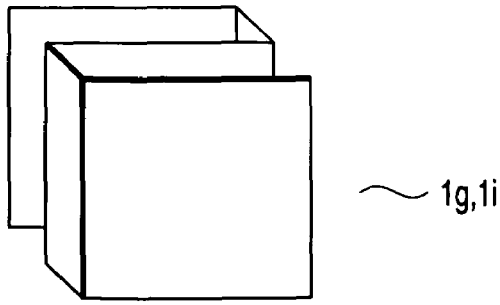
FIG. 28 is a view showing a configuration of a magnetic member used in the apparatus depicted in FIG. 26.

FIG. 25 is a cross-sectional view showing this structure. As shown in the drawing, a magnetic member 1A is interposed and arranged between a printed circuit board 7 and element 8 of a dipole antenna. This magnetic member 1A is configured in such a manner that a plurality of magnetic material plates 1*g*, 1*g*, . . . having a size with which these plates face intermediate portions alone of the antenna element 8 including a feed point 9 are superimposed in parallel through a dielectric member 1*h*. It is to be noted that the magnetic material plates 1*g*, 1*g*, . . . may be obtained by individually manufacturing a plurality of plate materials as shown in FIG. 27, but they may be obtained by accordion-folding one magnetic material plate 1*i* as shown in FIG. 28. Furthermore, an air member having a predetermined thickness may be interposed in place of the dielectric member 1*h*.

Using the magnetic member 1A having such a configuration can set the high input impedance and consequently reduce an image current flowing through the ground plane of the printed circuit board 7, thereby improving the antenna radiation efficiency. Moreover, since the magnetic material plates 1*g*, 1*g*, . . . having a small thickness can be used, the magnetic member can be readily and inexpensively manufactured.

It is to be noted that the dipole antenna is taken as an example in this embodiment. However, the present invention is not restricted thereto, and a plurality of magnetic members may be interposed and arranged between the element of a monopole antenna and the printed circuit board. Additionally, in this case, a dielectric member (including an air member) is likewise interposed between a plurality of magnetic members.

11th Embodiment

In an 11th embodiment according to the present invention, like the 10th embodiment, a magnetic member in which a plurality of magnetic members are superimposed through dielectric members is manufactured, and this magnetic member is interposed and arranged between a printed circuit board and elements of a dipole antenna. Each of the plurality of magnetic material plates is set to a size larger than the entire antenna element.

Figure 26:
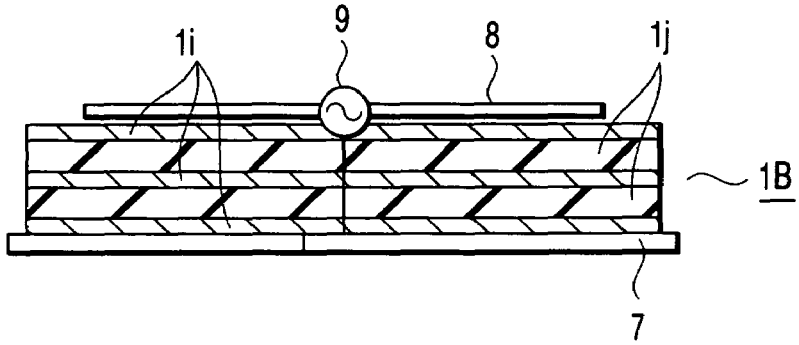
FIG. 26 is a cross-sectional view showing a 11th embodiment of an antenna apparatus according to the present invention.

FIG. 26 is a cross-sectional view showing this structure. As shown in the drawing, a magnetic member 1B is interposed and arranged between a printed circuit board 7 and element 8 of a dipole antenna. This magnetic member 1B is configured in such a manner that a plurality of magnetic material plates 1*i*, 1*i*, . . . longer than an entire length of the antenna element 8 are superimposed in parallel through dielectric members 1*j* and 1*j*. It is to be noted that, likewise, the magnetic material plates 1*i*, 1*i*, . . . may be manufactured by using individual plate materials as shown in FIG. 27 or by accordion-folding one magnetic material plate 1*i* as shown in FIG. 28 in this embodiment. Furthermore, an air member having a predetermined thickness may be interposed in place of the dielectric member 1*j*.

Figure 48A:
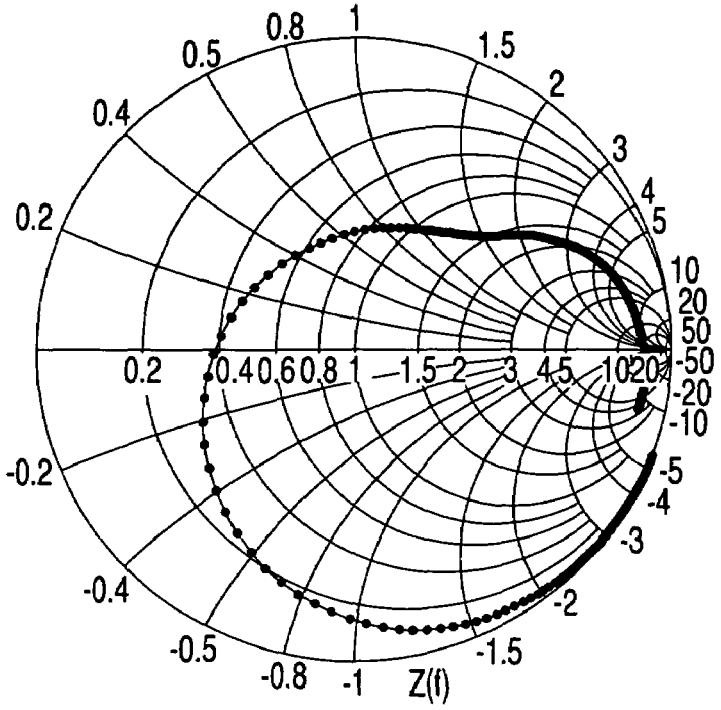
FIGS. 48A and 48B are a Smith chart and a view showing input impedance frequency characteristics when three magnetic material plates each having a thickness of 0.1 mm are superimposed, interposed and arranged in the antenna apparatus according to the 11th embodiment of the present invention, respectively.
Figure 48B:
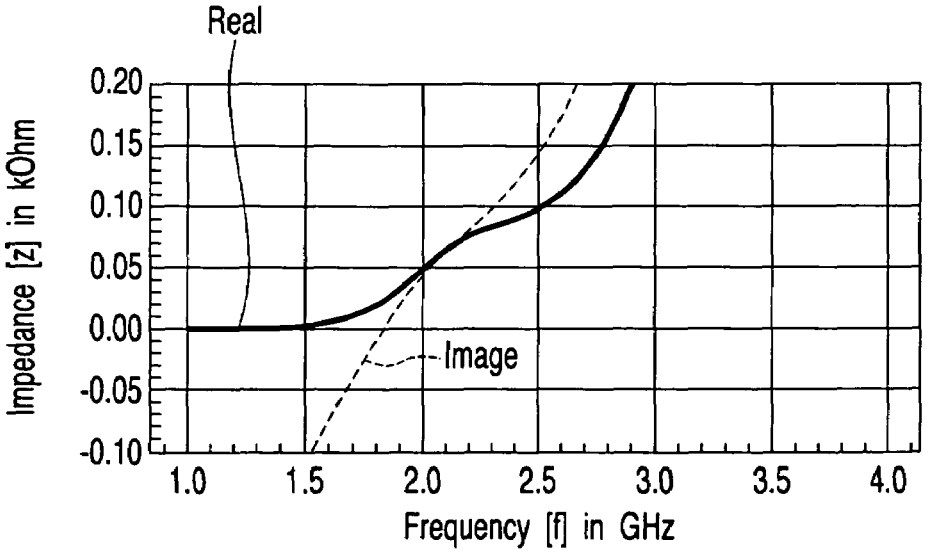

Using the magnetic member 1B having such a configuration can set the high input impedance like the 10th embodiment and consequently reduce an image current flowing through the ground plane of the printed circuit board 7, thereby enhancing antenna radiation efficiency. Moreover, since the magnetic material plates 1*i*, 1*i*, . . . having a small thickness can be used and the magnetic member can be readily and inexpensively manufactured. FIGS. 48A and 48B are a Smith chart and a view showing input impedance characteristics when three magnetic material plates having a thickness of 0.1 mm are superimposed, interposed and arranged. As shown in the drawings, when the three magnetic material plates having the thickness Of 0.1 mm are superimposed, it is possible to obtain input impedance characteristics equivalent to those in the FIG. 4 example where one magnetic material having a thickness of 0.5 mm is arranged.

It is to be noted that the dipole antenna is taken as an example in this embodiment. However, the present invention is not restricted thereto, and a plurality of magnetic material plates may be superimposed and arranged between elements of a monopole antenna and the printed circuit board. Moreover, in this case, a dielectric member (including an air member) is likewise interposed between a plurality of magnetic members.

12th Embodiment

In a 12th embodiment according to the present invention, a magnetic member is interposed and arranged between a monopole antenna and a printed circuit board having a metal surface which applies a ground potential to this monopole antenna.

Figure 29:
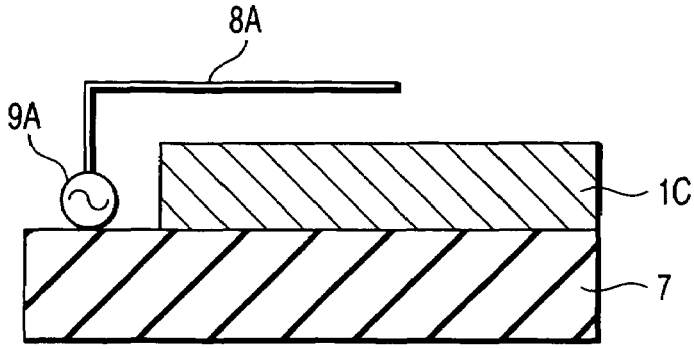
FIG. 29 is a cross-sectional view showing a 12th embodiment of an antenna apparatus according to the present invention.

FIG. 29 is a cross-sectional view showing a schematic configuration of an antenna apparatus according to this 12th embodiment. A magnetic member 1C is interposed and arranged between a printed circuit board having a ground plane and a monopole antenna 8A. The magnetic member 1C has nanogranular structure in which magnetic nanoparticles are three dimensionally dispersed and arranged in an insulating matrix substrate like the magnetic members described in the foregoing embodiments.

According to the thus configured antenna apparatus, a current distribution on the ground plane of the monopole antenna 1C can be controlled by using the magnetic member 1C.

13th Embodiment

In a 13th embodiment according to the present invention, when interposing and setting a magnetic member between an element of a monopole antenna and a printed circuit board, the magnetic member is arranged on a feeder end side of the element of the monopole antenna, and a dielectric member is arranged on an end side of the element of the monopole antenna.

Figure 49:
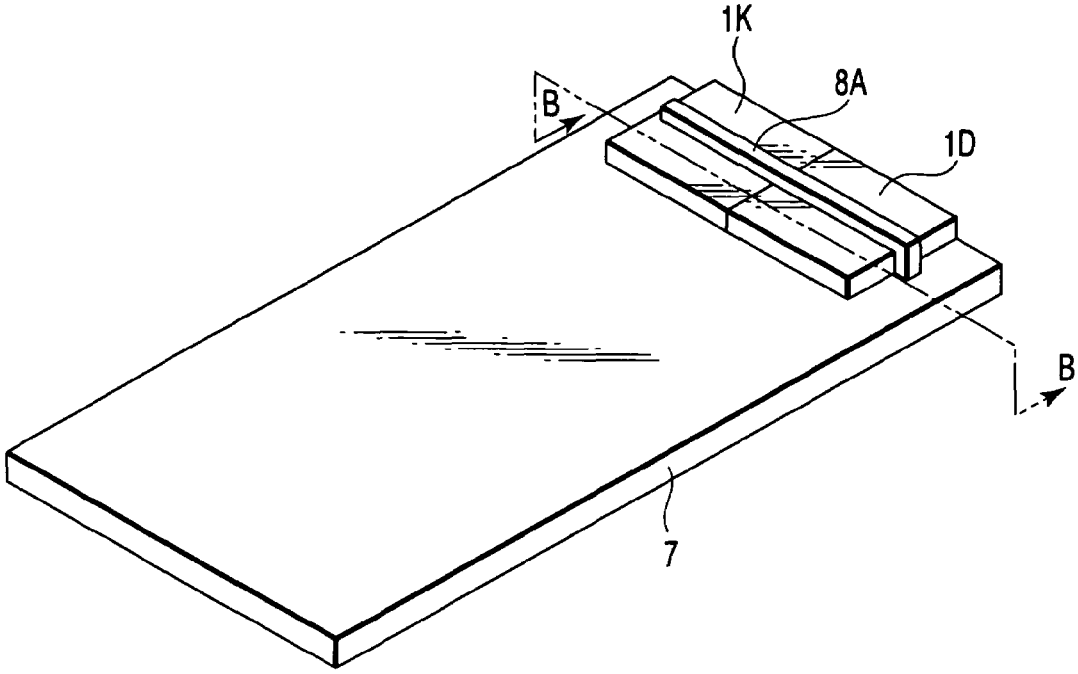
FIG. 49 is a perspective view showing a schematic configuration of an antenna apparatus according to a 13th embodiment of the present invention.
Figure 50:
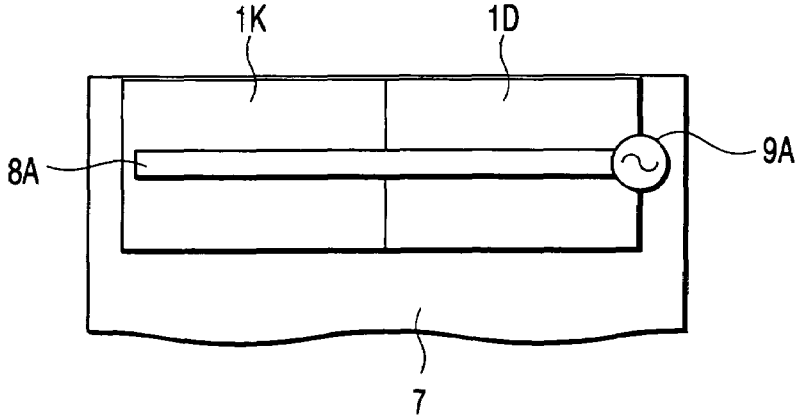
FIG. 50 is a plan view showing the antenna apparatus depicted in FIG. 49.
Figure 51:
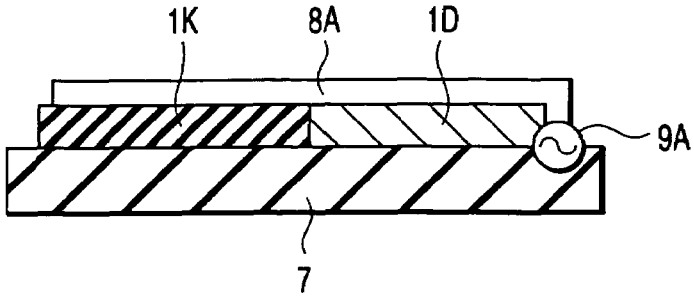
FIG. 51 is a cross-sectional view showing the antenna apparatus taken along a line B-B in FIG. 49.

FIG. 49 is a perspective view showing a schematic configuration of an antenna apparatus according to the 13th embodiment, FIG. 50 is a plan view of this configuration, and FIG. 51 is a cross-sectional view taken along a line B-B in FIG. 49.

In these drawings, a magnetic member 1D is interposed and arranged on a feed point 9A side of an element of a monopole antenna 8A and a dielectric member 1K is interposed and arranged on an end portion side of the element of the monopole antenna 8A between a printed circuit board 7 and the element of the monopole antenna 8A. Like the magnetic members described in the foregoing embodiments, the magnetic member 1C has a nanogranular structure in which magnetic nanoparticles are three-dimensionally dispersed and arranged in an insulating matrix substrate, and it is obtained by molding this structure into a tabular shape. Additionally, the dielectric member 1K is formed of an insulating member such as a resin.

It is to be noted that thickness dimensions and shapes of the magnetic member 1D and the dielectric member 1K are determined in such a manner that these members are in contact with the printed circuit board 7 and the monopole element 8A at the same time between them, whereby the magnetic member 1D and the dielectric member 1K also function as an antenna holding member which structurally and stably holds the element of the monopole antenna 8A on the printed circuit board 7.

According to such a structure, interposing and arranging the magnetic member 1D between the element of the monopole antenna 8A and the printed circuit board 7 can set a reduced resonance frequency and a high input impedance even if a gap between the element of the monopole antenna 8A and the ground surface of the printed circuit board 7 is narrowed. As a result, the antenna apparatus can be reduced in thickness and size, and an accommodation space for the antenna apparatus in a case of a mobile communication terminal can be decreased, thereby achieving a small size of the mobile communication terminal.

Additionally, the magnetic member 1D is arranged on the feed point 9A side having a large current and a low voltage and, on the other hand, the dielectric member 1K is arranged on the end side having a high voltage value and a small current value. Therefore, an installation area of the magnetic member 1D can be reduced while effectively suppressing a reduction in input impedance of the monopole antenna 8A.

Further, since the thickness dimensions of the magnetic member 1D and the dielectric member 1K are preset to e equal to a gap between the printed circuit board 7 and the element of the monopole antenna 8A, the element of the monopole antenna 8A can be structurally stably held on the printed circuit board 7.

14th Embodiment

In a 14th embodiment according to the present invention, when interposing and setting a magnetic member between elements of a dipole antenna and a printed circuit board, the magnetic member is arranged at an antenna central portion with a feed point of the elements of the dipole antenna at the center, and dielectric members are arranged at both end portions of the elements of the dipole antenna.

Figure 52:
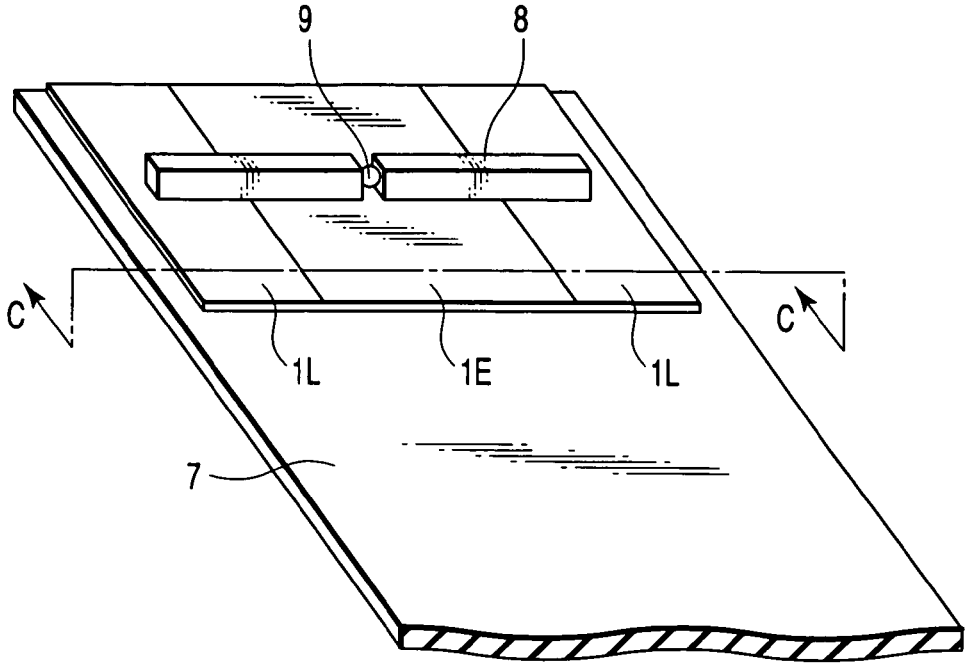
FIG. 52 is a perspective view showing a schematic configuration of an antenna apparatus according to a 14th embodiment of the present invention.
Figure 53:
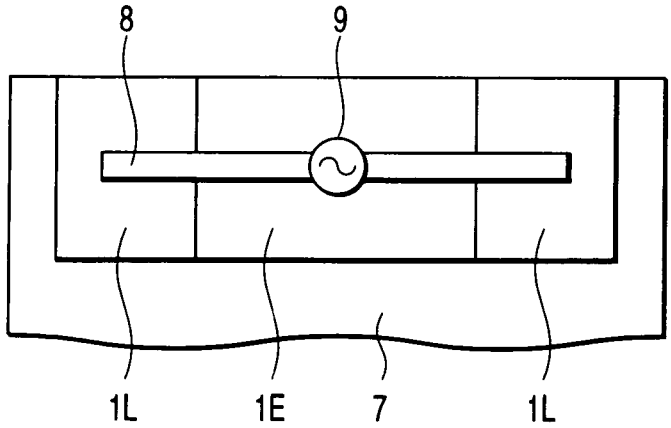
FIG. 53 is a plan view showing the antenna apparatus depicted in FIG. 52.
Figure 54:
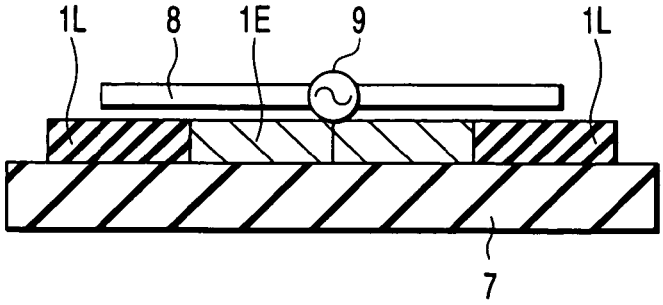
FIG. 54 is a cross-sectional view showing the antenna apparatus taken along a line C-C in FIG. 53.

FIG. 52 is a perspective view showing a schematic configuration of an antenna apparatus according to this 14th embodiment, FIG. 53 is a plan view showing this configuration, and FIG. 54 is a cross-sectional view taken along a line C-C in FIG. 52.

In these drawings, a magnetic member 1E is interposed and arranged at a part facing an antenna central portion including a feed point 9 of elements of a dipole antenna 8 and dielectric members 1L and 1L are interposed and arranged on both end portion sides of the elements of the dipole antenna 8 between a printed circuit board 7 and the elements of the dipole antenna 8. Like the magnetic members described in the foregoing embodiments, the magnetic member 1E has a nanogranular structure in which magnetic nanoparticles are three-dimensionally dispersed and arranged in an insulating matrix substrate, and it is obtained by molding this structure into a tabular shape. On the other hand, the dielectric members 1L and 1L are formed of an insulating member such as a resin.

It is to be noted that thickness dimensions and shapes of the magnetic member 1E and the dielectric members 1L and 1L are determined in such a manner that these members are in contact with the printed circuit board 7 and the elements of the dipole antenna 8 at the same time between them, whereby the magnetic member 1E and the dielectric members 1L and 1L also function as an antenna holding member which structurally stably holds the elements of the dipole antenna 8 on the printed circuit board 7.

According to such a structure, interposing and setting the magnetic member 1E between the elements of the dipole antenna 8 and the printed circuit board 7 can set a reduced resonance frequency and maintain a high input impedance even if a gap between the elements of the dipole antenna 8 and the ground surface of the printed circuit board 7 is narrowed. As a result, the antenna apparatus can be reduced in thickness and size while maintaining antenna radiation characteristics, and an accommodation space for the antenna apparatus in a case of a mobile communication terminal can be consequently decreased, thereby achieving a small size of the mobile communication terminal.

Further, the magnetic member 1E is arranged at the antenna central part including the feed point 9 where a current is large and a voltage is small and, on the other hand, the dielectric members 1L and 1L are arranged on both end portion sides where a voltage is high and a current is small. Therefore, an installation area of the magnetic member 1E can be reduced while suppressing a reduction in input impedance of the dipole antenna 8.

Further, since the thickness dimensions of the magnetic member 1E and the dielectric members 1L and 1L are preset to be equal to a gap between the printed circuit board 7 and the elements of the dipole antenna 8, the elements of the dipole antenna 8 can be structurally stably held on the printed circuit board 7.

Figure 55:
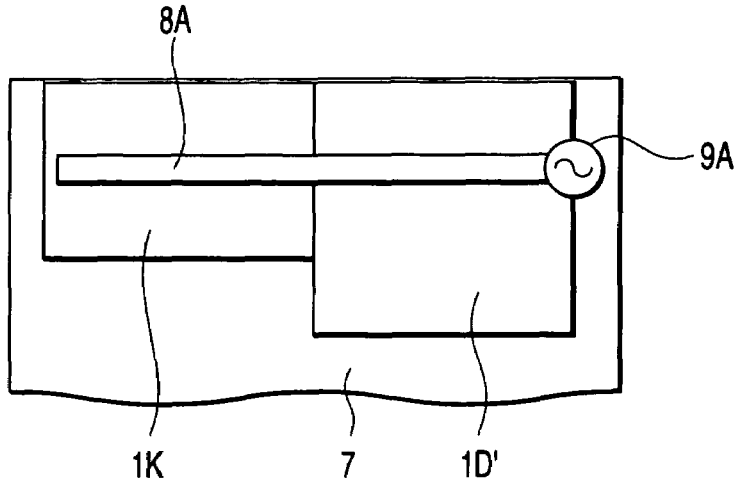
FIG. 55 is a view showing another structural example of the antenna apparatus depicted in FIG. 50.
Figure 56:
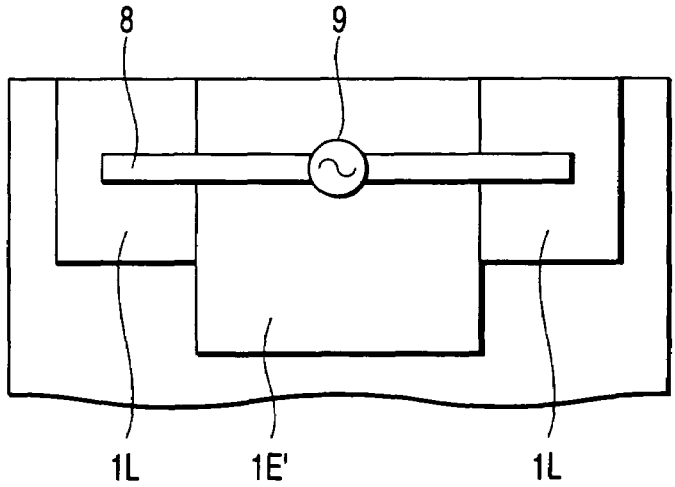
FIG. 56 is a view showing another structural example of the antenna apparatus depicted in FIG. 53.
Figure 57:
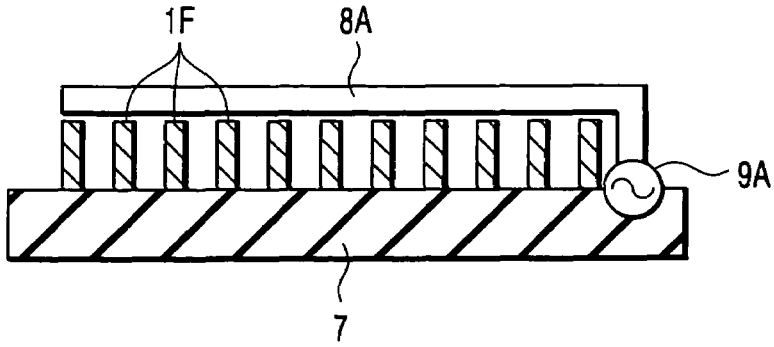
FIG. 57 is a view showing another structural example of the antenna apparatus depicted in FIG. 51.

Incidentally, in each of the 13th and 14th embodiments, it is good enough to set installation areas (sizes) of the magnetic material 1D and 1E to be larger than installation areas of the dielectric materials 1K and 1L as indicated by magnetic materials 1D' and 1E' shown in FIGS. 55 and 56, for example. According to this configuration, higher input impedance can be maintained, thereby further reducing a thickness of the antenna apparatus and a size of the mobile communication terminal.

Furthermore, each of the magnetic materials 1D and 1E is not restricted to a single member, and it may have a structure in which a plurality of members are superimposed as shown in FIG. 25, for example. When this structure is adopted, it is possible to obtain an input impedance suppressing effect which is equivalent to that in a case of using a magnetic material with a thick film structure without the magnetic materials 1D and 1E each having the thick film structure.

Figure 58:
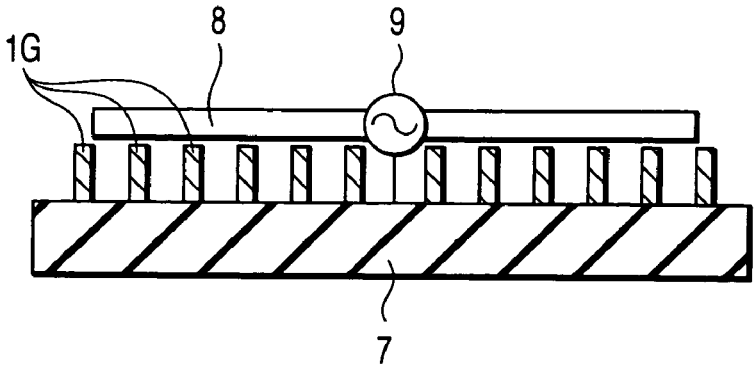
FIG. 58 is a view showing another structural example of the antenna apparatus depicted in FIG. 54.
Figure 59:
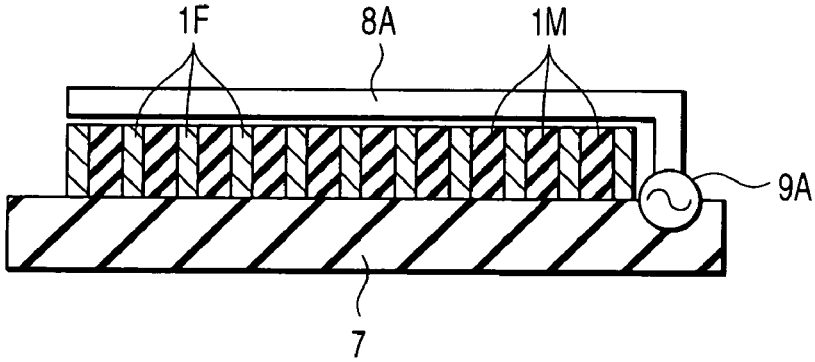
FIG. 59 is a view showing still another structural example of the antenna apparatus depicted in FIG. 57.
Figure 60:
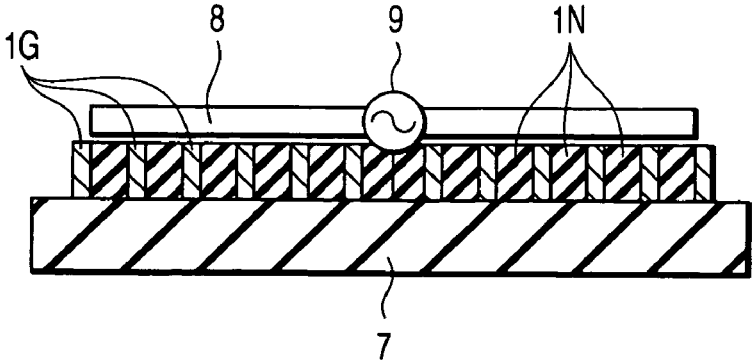
FIG. 60 is a view showing still another structural example of the antenna apparatus depicted in FIG. 58.

Moreover, the magnetic material may have a structure in which a plurality of magnetic material plates 1F, 1F, . . . , 1G, 1G, . . . are provided upright at predetermined intervals on the printed circuit board 7 as shown in FIGS. 27 and 58, for example. Additionally, dielectric materials 1M, 1M, . . . , 1N, 1N, . . . may be interposed between the magnetic material plates 1F, 1F, . . . , 1G, 1G, . . . as shown in FIGS. 59 and 60, for example. According to this structure, the magnetic material plates 1F, 1F, . . . , 1G, 1G, . . . can be integrated with the dielectric materials 1M, 1M, . . . , 1N, 1N, . . . , thereby simplifying manufacture and stabilizing the structure.

15th Embodiment

In a 15th embodiment according to the present invention, a magnetic member having high permeability is set at a feeder end of a folded antenna provided on a printed circuit board.

Figure 61:
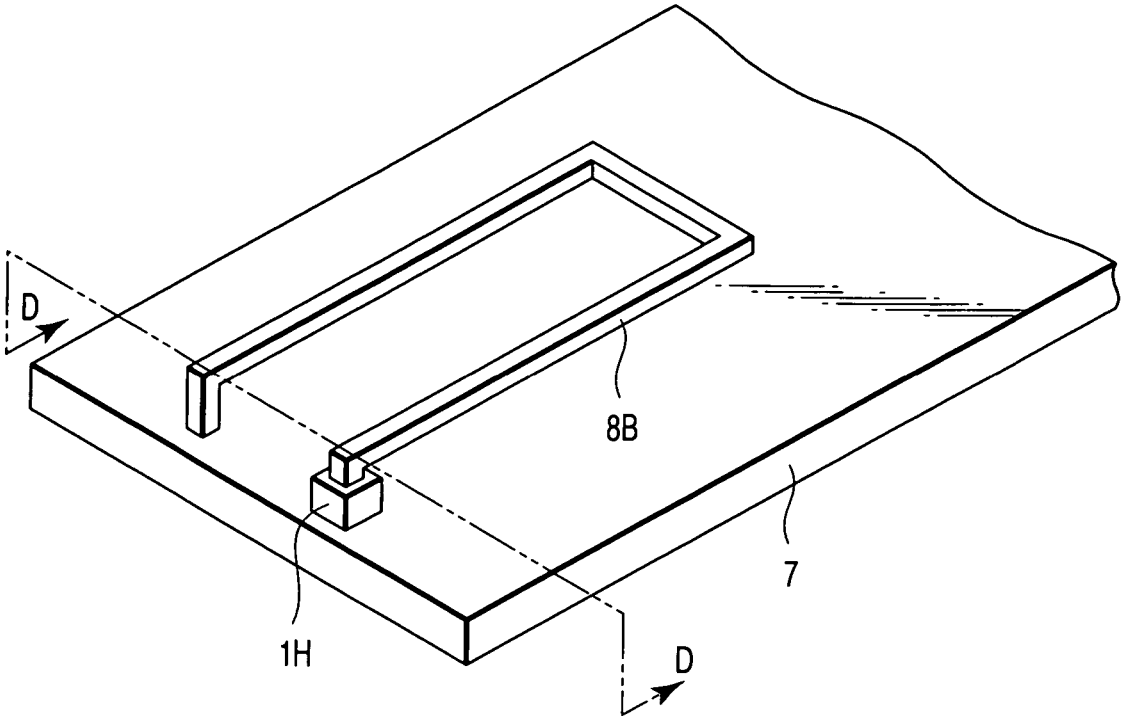
FIG. 61 is a perspective view showing a schematic configuration of an antenna apparatus according to a 15th embodiment of the present invention.
Figure 62:
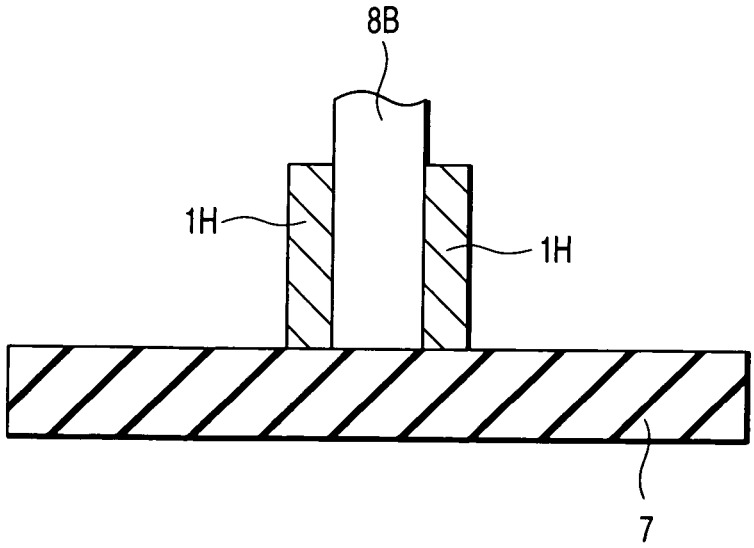
FIG. 62 is a cross-sectional view showing the antenna apparatus taken along a line D-D in FIG. 61.

FIG. 61 is a perspective view showing a schematic structure of an antenna apparatus according to this 15th embodiment, and FIG. 62 is a cross-sectional view taken along a line D-D in FIG. 61. In these drawings, a folded monopole antenna 8B which is folded in a U-like shape is arranged on a printed circuit board 7. Additionally, a feeder end of this folded antenna 8B is connected with a feeder circuit (not shown) mounted on the printed circuit board 7, and a short-circuit end of the same is connected with a ground end of the printed circuit board 7.

Further, a magnetic member 1H is provided at the feeder end portion of the folded antenna 8B. This magnetic member 1H has a structure in which a through hole is formed in one of opposed surfaces of a cube, and the feeder end portion of the folded antenna 8B is inserted into this through hole. A size of the magnetic member 1H is set to, e.g., 3 mm×3 mm×3 mm when a diameter of the folded antenna 8B is 2 mm. That is, the feeder end portion of the folded antenna 8B is set in such a manner that its peripheral surface is enclosed by the magnetic member 1H having a thickness of 1 mm.

Since such a configuration is adopted, providing the magnetic member 1H at the feeder end portion of the folded antenna 8B to surround the peripheral surface thereof can reduce a resonance frequency of the antenna and maintain a high input impedance of the antenna in the resonance frequency even if the folded antenna 8B is arranged in proximity to the printed circuit board 7. As a result, the antenna apparatus can be reduced in thickness and size, and an accommodation space for the antenna apparatus in a case of a mobile communication terminal can be consequently decreased, thereby achieving a small size of the mobile communication terminal.

Figure 63A:
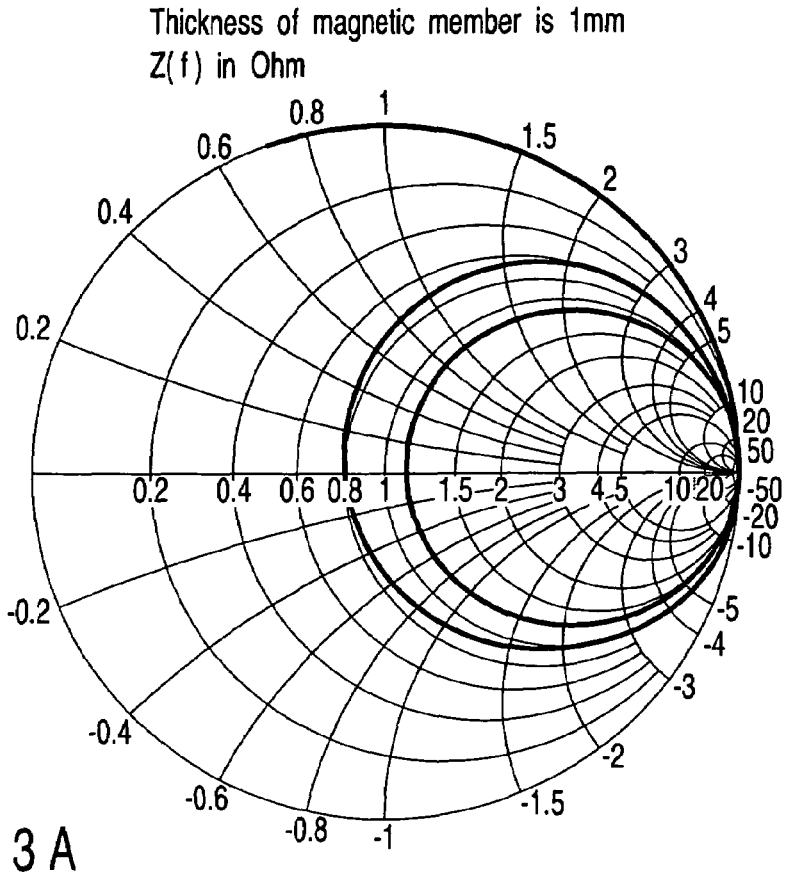
FIGS. 63A and 63B are a Smith chart and a frequency characteristic view showing characteristics of the antenna apparatus depicted in FIG. 61, respectively.
Figure 63B:
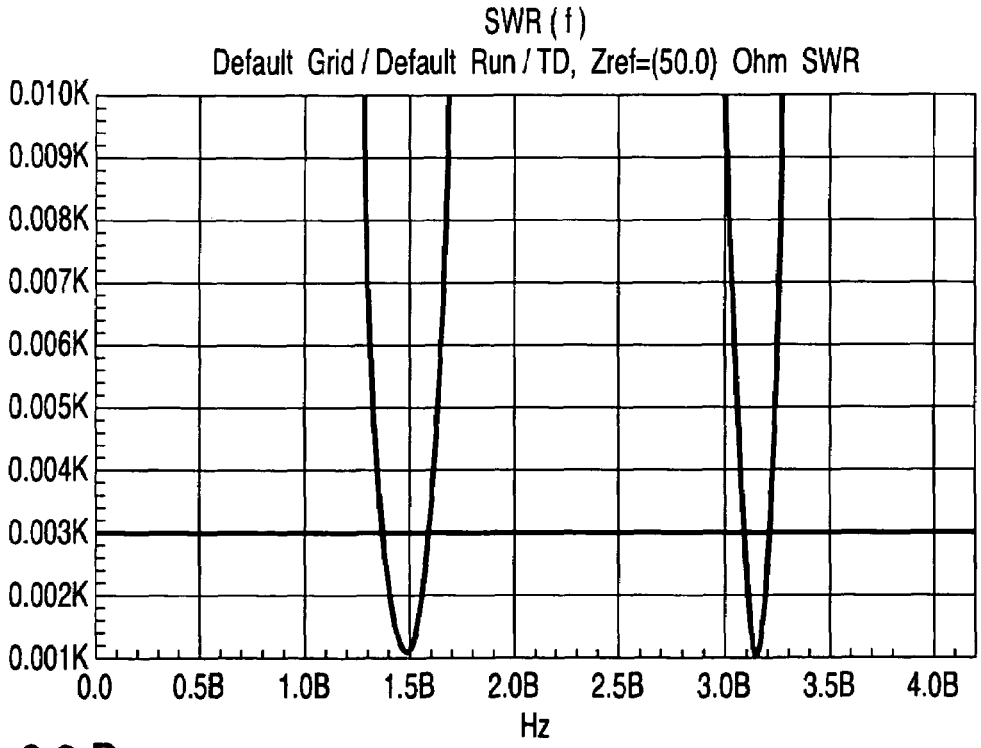
Figure 64A:
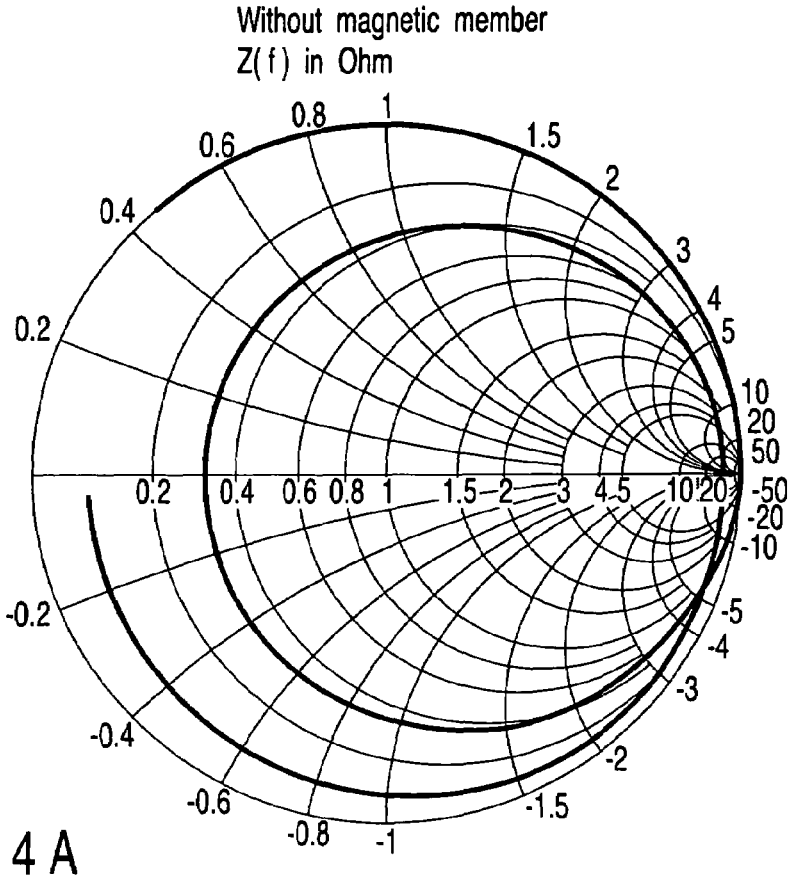
FIGS. 64A and 64B are a Smith chart and a frequency characteristic view showing characteristics when a magnetic member is not provided in the antenna apparatus depicted in FIG. 61, respectively.
Figure 64B:
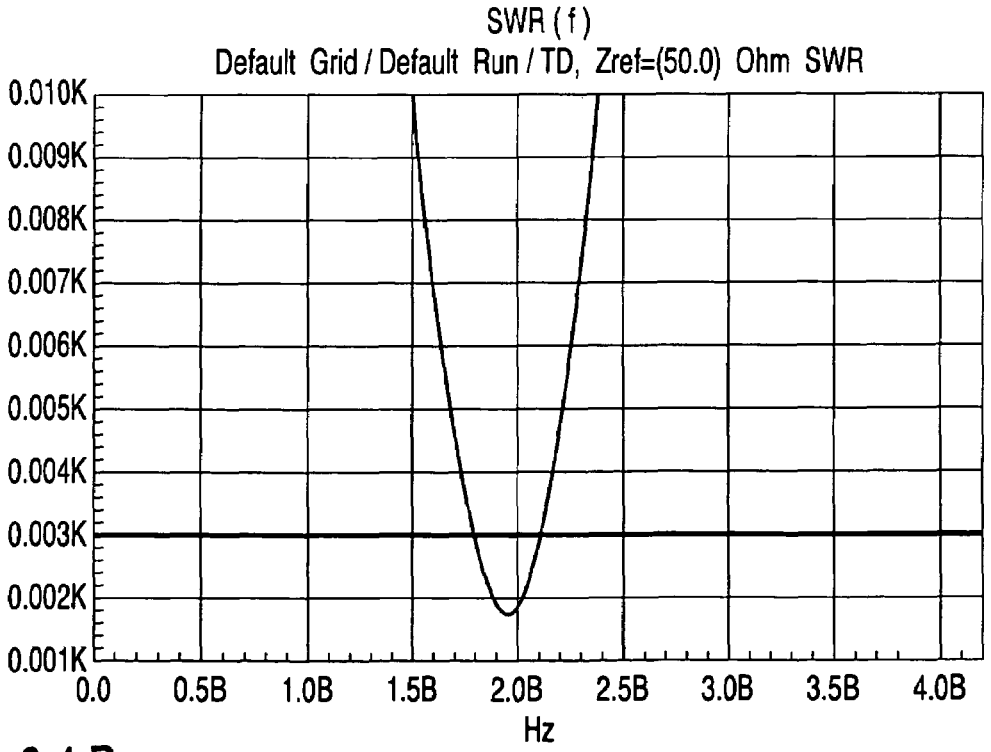

FIGS. 63A and 63B are a Smith chart and a view showing input impedance characteristics when the magnetic member 1H having a thickness 1 mm is provided over a length of 3 mm on a peripheral surface of a feeder end portion of the folded antenna 8B. As apparent from these drawings, a resonance frequency is set low, and an input impedance Z (f) in this resonance frequency is maintained high. It is to be noted that input impedance characteristics and frequency characteristics are as shown in FIGS. 64A and 64B when the magnetic member 1H is not provided in the folded antenna 8B having the same structure as the antenna depicted in FIG. 61. That is, the resonance frequency is increased, and the input impedance is reduced.

Moreover, according to this embodiment, since the magnetic member 1H is arranged at the feeder end portion alone of the folded antenna 8B, an installation area of the magnetic member 1H can be reduced while effectively suppressing a reduction in the input impedance Z (f) of the antenna 8B as compared with a case where the magnetic member is arranged on the entire antenna element.

It is to be noted that the description has been given as to the example where the magnetic member 1H is provided on the peripheral surface of the feeder end portion of the folded antenna 8B in the 15th embodiment, but the magnetic member 1H may be provided on the peripheral surface of the short-circuit end portion of the folded antenna 8B. Even if such a configuration is adopted, a resonance frequency of the antenna can be reduced, and the antenna can be decreased in size. Additionally, arranging the magnetic member at the short-circuit end portion alone can reduce the use of the magnetic member 1H as compared with the case where the magnetic member is arranged on the entire antenna element.

Figure 65A:
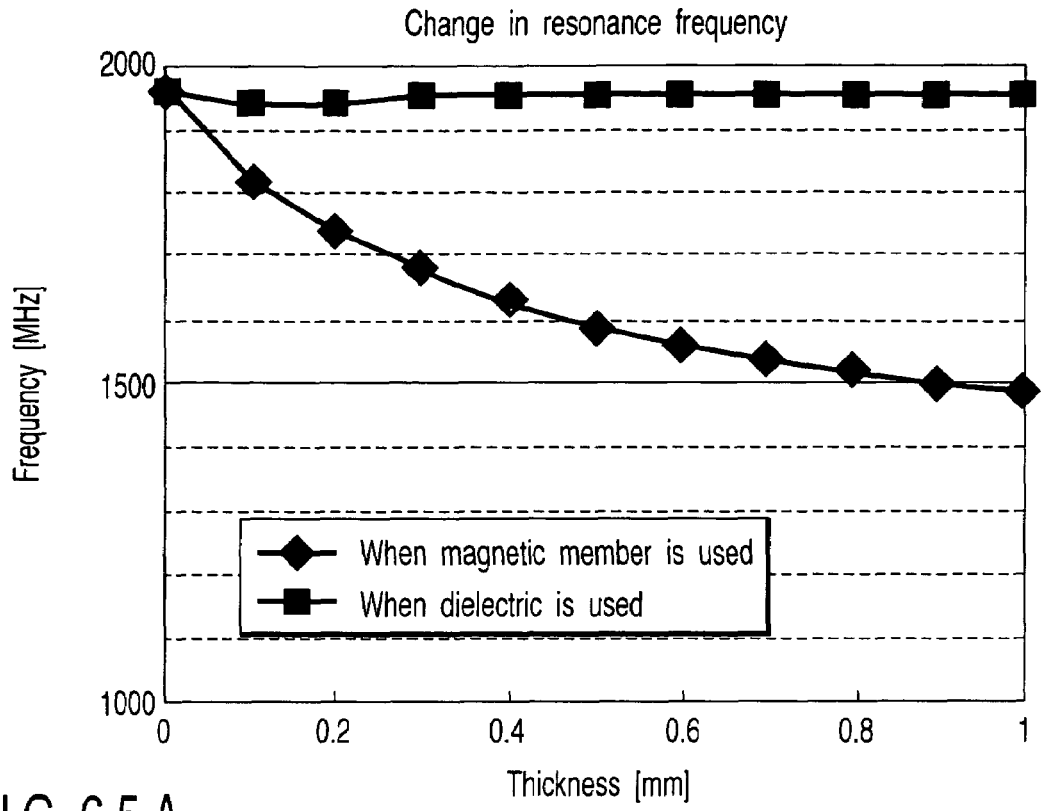
FIGS. 65A and 65B are views showing an example of a resonance frequency and input impedance variation characteristics when a thickness of the magnetic member is changed.
Figure 65B:
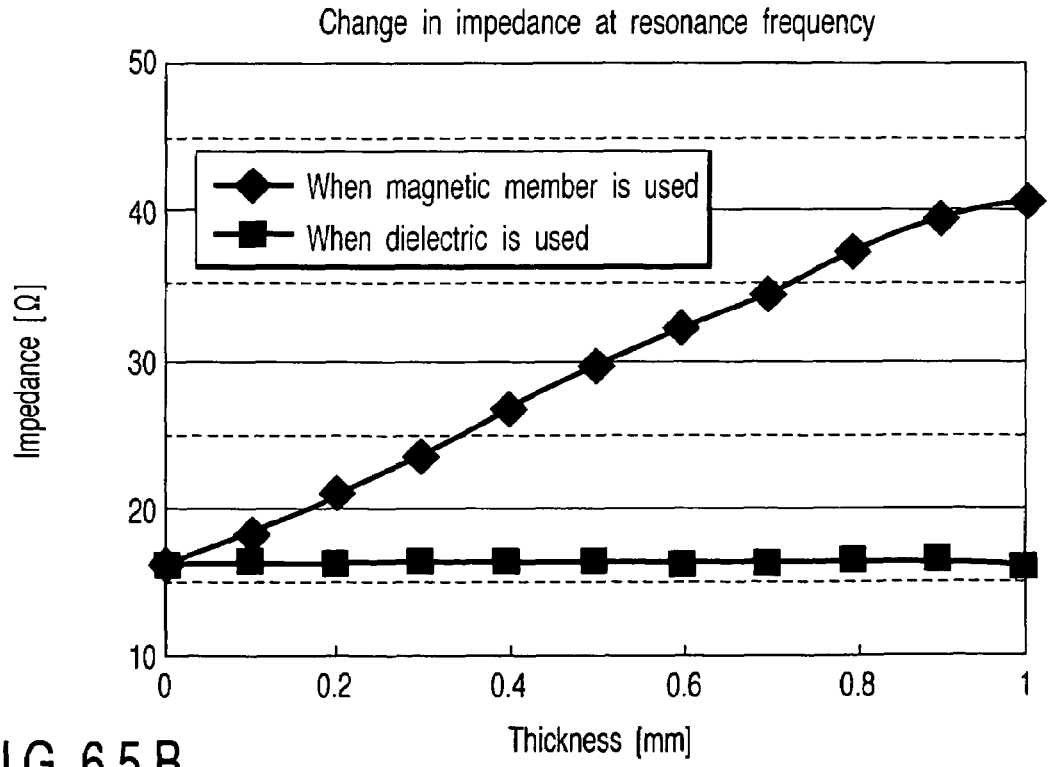

Further, the thickness of the magnetic member 1H provided on the peripheral surface of the feeder end portion of the folded antenna 8B is not restricted to 1 mm, and it may be increased or reduced. Furthermore, the length of the same may be longer than or shorter than 3 mm. FIGS. 65A and 65B show an example of changes in a resonance frequency and input impedance when the thickness of the magnetic member 1H is changed. As apparent from the drawings, the resonance frequency is reduced and the input impedance is increased as the thickness of the magnetic member 1H is increased. It is to be noted that there is no change in the resonance frequency and the input impedance when a dielectric material is used.

Furthermore, as the method of installing the magnetic member 1H on the peripheral surface of the feeder end portion of the antenna 8B, it is possible to adopt a method of inserting the feeder end portion of the antenna 8B into the through hole of the magnetic member having a cubic shape as well as a method of forming the magnetic material on the peripheral surface of the feeder end portion of the antenna 8B by coating means or depositing means.

A structure of the magnetic member used in each of the foregoing embodiments and its manufacturing method will now be described in detail. However, drawings are schematic representations, and a ratio or the like of a thickness of each material member or a particle diameter of a magnetic particle is different from a real value.

Specific Example 1 of the structure used in the present invention will be first explained. The magnetic member according to the present invention has a structure in which a plurality of magnetic particles formed of at least one magnetic metal (soft magnetic metal) selected from Fe, Ni and Co or an alloy or the like of these magnetic metals are separated out in such a manner that they are partially buried in a surface of an insulator member, and also has a structure in which at least a part of each magnetic particle (e.g., a surface region exposed on a member surface) is covered with a protection film containing at least one of $Al_2O_3$, AlN, $SiO_2$, $Si_3N_4$ and SiC.

It is to be noted that the insulator member may be a plurality of members or a single member. It is desirable for a value of an insulating resistance of the insulator member to be not smaller than $1\times10^2$ [Ω·cm], or preferably not smaller than $1\times10^8$ [Ω·cm] at room temperature. As a material of the insulator member, it is possible to use ceramics such as an oxide, a nitride or the like, a synthetic resin such as polystyrene, polyethylene, polyethylene terephthalate (PET) or an epoxy type resin, or glass, but using a ceramics material containing a non-reducible metal oxide is desirable. As the oxide, considering a degree of freedom in composition, a solid solution of a composite oxide is preferable, and a complete solid solution is more preferable. Further, when two types or more of non-reducible metal oxides are used, two types or more of composite oxides may be also formed.

The non-reducible metal oxide means a metal oxide which is hardly reduced to a metal in a hydrogen atmosphere at a room temperature to 1500° C. Even if such a metal oxide is left in the hydrogen atmosphere for two hours, a metal is not separated out. As specific non-reducible metal oxides, there are oxides of, e.g., Ca, Al, Si, Mg, Zr, Ti, Hf, a rare-earth element, Ba, Sr, Zn or the like. In the present invention, it is possible to use one or a plurality of types of these oxides as the non-reducible metal oxide.

Furthermore, it is preferable for at least one insulator member in which magnetic particles are buried to be formed of a metal oxide obtained by combining as constituent elements an [A] metal element constituting at least one [a] non-reducible metal oxide selected from Mg, Al, Si, Ca, Cr, Ti, Zr, Ba, Sr, Zn, Mn, Hf and a rare-earth element with at least one [B] magnetic metal element selected from Fe, Ni and Co. In addition, it is preferable for at least one insulator member in which magnetic particles are buried to contain at least 0.01 to 0.25% by atomic weight of at least one [C] additive metal element selected from Al, Cr, Sc and Si besides the [A] metal element and the [B] magnetic metal element. It is to be noted that elements selected in the form of combinations of the [A] metal element and the [C] additive metal element are different from each other.

Moreover, the plurality of magnetic particles are dispersed and arranged at predetermined intervals along a surface of the insulator member. It is preferable for the pair of insulator members which are bonded to each other with these magnetic particles there between to have the same thermal expansion coefficient. However, assuming that one of the pair of insulator members is a first insulator member, it is preferable for a thermal expansion coefficient $\alpha 1$ of this member and a thermal expansion coefficient $\alpha 2$ of the other second insulator member to satisfy the condition of $0.5<\alpha 1/\alpha 2<2$ in a range of 80° C. to 1500° C.

Additionally, it is preferable to form a third insulator member as a buffer member which alleviates a difference of the thermal expansion coefficients between the first insulator member and the second insulator member.

Further, it is preferable for the first insulator member and the second insulator member to have relative dielectric constants different from each other. Furthermore, it is preferable for at least one of the first insulator member and the second insulator member to be a ceramics member.

It is preferable for this ceramics member to be formed of an [a] non-reducible metal oxide of at least one type of [A] metal element selected from Mg, Al, Si, Ca, Cr, Ti, Zr, Ba, Sr, Zn, Mn, Hf and a rare-earth element and at least one selected from [b] magnetic metal oxides of at least one [B] magnetic metal element selected from Fe, Ni and Co. Moreover, it is preferable for this ceramics member to contain a [D] metal oxide formed of at least one selected from $Al_2O_3$, $Sc_2O_3$, $Cr_2O_3$ and $V_2O_5$. Additionally, it is preferable for this ceramics member to mainly contain an [a] non-reducible metal oxide of at least one [A] metal element selected from Mg, Al, Si, Ca, Cr, Ti, Zr, Ba, Sr, Zn, Mn, Hf and a rare-earth element, and have a metal oxide having a valence larger than that of this [a] non-reducible metal oxide added therein.

Additionally, it is possible to adopt a structure in which at least one of the plurality of superimposed insulator members is formed of an organic member. This organic member may have an inorganic member mixed therein or have a porous structure, and characteristics of the insulator member may be adjusted by such a structure.

The magnetic member according to the present invention has an anisotropic structure formed in a state where many magnetic particles are uniformly dispersed and arranged along the surface of the insulator member while maintaining their insulation states.

[First Embodiment of Magnetic Layer: Structure where Multiple Insulator Layers are Superimposed]

Figure 30:
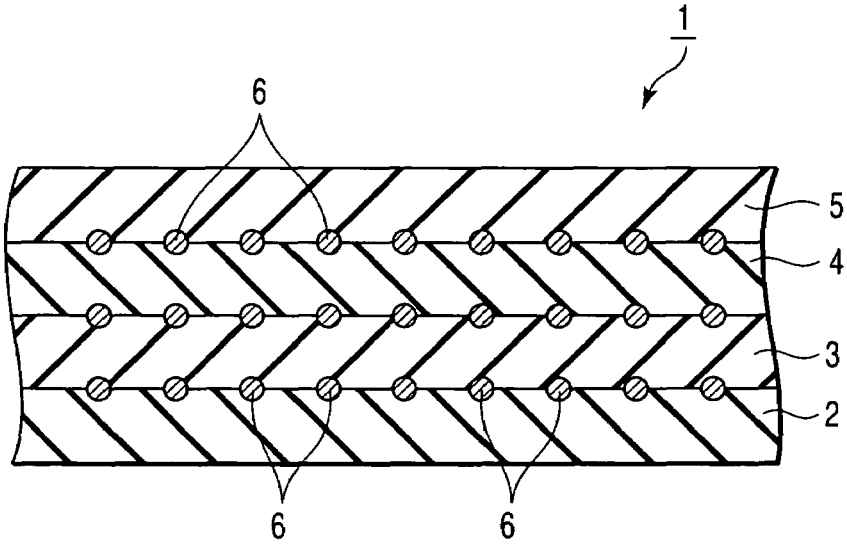
FIG. 30 is a schematic cross-sectional view showing a first embodiment of a magnetic member according to the present invention.
Figure 31:
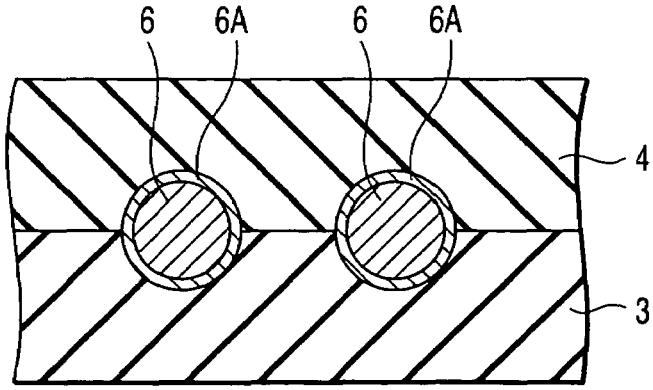
FIG. 31 is an enlarged cross-sectional view of a primary part of the magnetic member depicted in FIG. 30.

A magnetic member according to a first embodiment of the present invention will now be described with reference to FIGS. 30 and 31. FIG. 30 is a schematic cross-sectional view of a magnetic member according to the first embodiment, and FIG. 31 is an enlarged cross-sectional view of the primary part of the magnetic member. This embodiment is an example where a plurality of insulator members are provided, and a description will be given as to a four-member structure by way of example.

(Schematic Structure of Magnetic Layer)

As shown in FIG. 30, a magnetic member 1 has a structure in which a plurality of (e.g., four in this embodiment) insulator members 2, 3, 4 and 5 are superimposed. A plurality of fine magnetic particles 6 are uniformly dispersed and arranged in each of a lamination interface between the insulator member 2 and the insulator member 3, a lamination interface between the insulator member 3 and the insulator member 4 and a lamination interface between the insulator member 4 and the insulator member 5. The magnetic particles 6 are arranged to be buried in both insulator members (2, 3, 4, 5) sandwiching these particles. As shown in FIG. 31, a surface of each magnetic particle 6 is coated with a protection film 6A consisting of an oxide. It is to be noted that although the magnetic particles 6 exist on outer surfaces of the insulator members 2 and 5 in a manufacturing process but the magnetic particles 6*a* are removed after this process in the magnetic member 1 according to this embodiment.

(Components of Magnetic Particle)

The magnetic particle 6 is a particle consisting of at least one magnetic metal selected from Fe, Ni and Co or an alloy of these magnetic metals. Specifically, this magnetic particle 6 contains one of an Fe particle, an Ni particle, an Fe—Co particle, an Fe—Ni particle, a Co—Ni particle and an Fe—Co—Ni particle as a basic component, and Al or Si as a second component. It is to be noted that this magnetic particle 6 is separated out by later-described reduction process.

In particular, since saturated magnetization must be increased as much as possible to realize high permeability, it is preferable to add the Fe—Co particle having the highest saturated magnetization as a basic component and a small amount of another element, e.g., Ni in order to provide oxidation resistance. It is desirable to contain 50% or below by atomic weight of Al or Si which is added as the second component and allow solid solution of this substance. As a solid solution system, it is possible to select one of Fe—Al, Fe—Si, Co—Si, Ni—Si, Fe—Co—Al, Fe—Co—Si, Fe—Ni—Al, Fe—Ni—Si, Co—Ni—Si, Fe—Co—Ni—Al and Fe—Co—Ni—Si. A smaller amount of Al or Si subjected to solid solution processing is preferable in order to increase saturated magnetization of particles as much as possible, but a larger amount is desirable in order to improve contact properties with respect to the protection film 6A to be applied. That is, an amount of Al or Si subjected to solid solution processing is determined based on the balance of saturated magnetization and close contact properties with respect to the protection film 6A, and a range of 5 to 10% by atomic weight is most preferable. Further, a small amount of another component such as Mn or Cu may be contained as a third component in order to improve high-frequency characteristics of the relative permeability.

It is to be noted that existence of at least one of an Fe particle, a Co particle, an Fe—Co alloy particle, an Fe—Co—Ni alloy particle, an Fe group alloy particle and Co group alloy particle can suffice as the magnetic particle. Beside, other non-magnetic metal elements may be alloyed. However, when an amount of such an element is excessive, saturated magnetization is extremely reduced. Therefore, considering high-frequency characteristics, 10 at % or below is preferable as alloying using any other non-magnetic metal element (a reducible metal other than Fe and Co). Moreover, although the non-magnetic metal may be solely dispersed in a constitution, it is preferable for such a metal to have an amount of 20% or below by volume. In view of oxidation resistance of a deposited fine crystal, it is preferable for the Fe group alloy particles to partially contain Co or Ni, and Fe—Co group particles are desirable in terms of saturated magnetization in particular.

(Particle Diameter of Magnetic Particle)

Further, it is preferable for the magnetic particle to exist in at least one of a crystal particle or a crystal grain boundary of a crystal particle constituting a high-frequency magnetic member. In order to improve high-frequency magnetic characteristics, it is preferable to provide the magnetic particle in both the crystal particle and the crystal grain boundary. For example, since a skin effect greatly affects the magnetic member (the magnetic component) when a frequency is increased to 1 GHz or above, magnetic particles having a maximum value of an average particle diameter being 2000 nm or below are preferable for a high-frequency application.

In such a viewpoint, a range of 1 to 2000 nm is preferable as a particle diameter of the magnetic particle 6 covered with the protection film 6A. Furthermore, for a use in an electronic communication device such as an antenna substrate, setting the particle diameter to fall within a range of 1 to 100 nm is preferable. A reason of setting an upper limit of a particularly preferable particle diameter to 100 nm for a use in an electronic communication device or the like is that an eddy-current loss is generated when a particle diameter is too large, and hence the particle diameter must be set to at least 100 nm or below in order to assure characteristics as the magnetic member. Moreover, when the particle diameter is large, adopting a multi-magnetic-domain structure rather than a single-magnetic-domain structure results in stabilization of energy, but high-frequency characteristics of relative permeability of the multi-magnetic-domain structure become inferior to high-frequency characteristics of relative permeability of the single-magnetic-domain structure. Therefore, when the magnetic member is used as a high-frequency magnetic component in e.g., an antenna apparatus, it is important to allow existence of each soft magnetic metal particle or each alloy particle of a soft magnetic metal as a single-magnetic-domain particle. A limit particle diameter having a single-magnetic-domain structure is approximately up to 50 nm, and hence setting the particle diameter to 50 nm or below is preferable. On the other hand, when the particle diameter is too small, super paramagnetism is produced, and hence a saturation magnetic flux density is reduced. Considering these matters, it is desirable to set the particle diameter of the magnetic particle 6 to fall within a range of 1 to 100 nm, especially a range of 10 to 50 nm.

(Crystal Orientation of Magnetic Particle)

In the magnetic member shown in FIG. 30, it is preferable for crystal orientations of the magnetic particles 6 held between each of the pair of the insulator member 2 and the insulator member 3, the pair of the insulator member 3 and the insulator member 4 and the pair of insulator member 4 and the insulator member 5 to be aligned along at least two axes with respect to a crystal orientation of at least one insulator member in each of these pairs. When the crystal orientations of the magnetic particles 6 are aligned along at least two axes with respect to the crystal orientation of at least one insulator member of each of these pairs, the magnetic particles 6 exist in each member interface in a thermally very stable state, and the magnetic member can be used for a long time even if it is applied as a high-frequency magnetic component as typified by a later-described antenna apparatus. Therefore, it is preferable for all the magnetic particles 6 to be matched in grating with the insulator members 2, 3, 4 and 5 and to exist in an equally aligned state. It is to be noted that the buried state of the magnetic particles 6 is decisively different from a state where the magnetic particles 6 are simply arranged in depressions on the surface of each insulator member, and a difference can be recognized by using TEM, a diffraction figure or the like.

(Dispersed State of Magnetic Particle)

As a dispersed state of the magnetic particles 6, it is preferable for the magnetic particles 6 to be dispersed and distanced from each other at 0 to 5 nm intervals in both a case where the magnetic particles 6 exist in the interface between the respective insulator members and a case where the magnetic particles are arranged on the surface of each insulator member. That is because, like the reason of specifying a film thickness range of the protection film 6A, a particle interval falls within a range of 0 to 5 nm, the particle interval being optimum for maintaining the high resistance of the magnetic member 1, increasing a volume percent of the magnetic metal or the magnetic metal alloy as much as possible and increasing the saturation magnetic flux density.

(Components of Protection Film)

As element components of the protection film 6A, it is most preferable that a total element amounts of Al and Si in elements excluding oxygen (O) is a composition which is not smaller than 50% by atomic weight and that the protection film 6A is 100% constituted of one of $Al_2O_3$, AlN, $SiO_2$, $Si_3N_4$ and SiC. However, the protection film 6A may be constituted of a compound such as FeO, $Fe_2O_3$, $Fe_3O_4$, NiO, CoO, $Co_2O_3$, $FeAl_2O_4$, $CoAl_2O_4$ or $FeAlO_3$.

(Film Thickness of Protection Film)

It is preferable for a film thickness of the protection film 6A to be 1 to 5 nm irrespective of a particle diameter of the magnetic particle 6A. That is because a range of 1 to 5 nm is a thickness which is optimum for maintaining a high resistance of the magnetic member 1, increasing a volume percent of the magnetic particle 6 with respect to the entire magnetic member 1 as much as possible and increasing a saturation magnetic flux density. However, a thickness of the protection film formed by oxidation is ideally approximately atomicity member, but the thickness of the protection film is not restricted to a particular value as long as magnetic properties are not lost.

(Components of Insulator Layer)

In this embodiment, each of the insulator members 2, 3, 4 and 5 is formed of an oxide insulator obtained by combining at least one selected from [A] metal elements of the [a] non-reducible metal oxides and at least one [B] magnetic metal (soft magnetic metal) element selected from iron (Fe), nickel (Ni) and cobalt (Co).

The [a] non-reducible metal oxide means a metal oxide which is hard to be reduced in a hydrogen atmosphere at a room temperature to 1500° C. as described above. As the [A] metal elements constituting this non-reducible metal oxide, there are Mg, Al, Si, Ca, Cr, Ti, Zr, Ba, Sr, Zn, Mn, Hf, a rare-earth element and others. One or a combination of these materials may be used. Although many combinations can be considered as combinations of a metal element of the non-reducible metal oxides and a magnetic metal or an alloy of such metals, a system forming a solid solution and a system forming a compound phase are desirable.

As the system forming a solid solution, a complete solid solution system is particularly desirable considering a degree of freedom of compositions. As this complete solid solution system, FeO—MgO, CoO—MgO, NiO—MgO, $Fe_2O_3$—$Cr_2O_3$ and others can be considered.

On the other hand, as the compound phase, there can be considered many materials such as FeAl2O4, Fe2SiO4, FeTiO3, Mg ferrite, Zn ferrite, Mn ferrite, Ca ferrite, Sr ferrite, rare-earth ferrite and others.

As will be described on a manufacturing method, when the insulator member consisting of such an oxide is subjected to reduction processing, magnetic particles 6 each consisting of a particle of readily reducible magnetic metals (reducible magnetic metals) or of an alloy of such metals are selectively dispersed and deposited on the surface (the interface) of the insulator member, thereby obtaining a structure in which these magnetic particles 6 are partially buried in the insulator member. At this time, the magnetic particles 6 are mainly deposited on the surface of the insulator member, the interface between the insulator members and the grain boundary, and they are rarely deposited in the grains. Therefore, the magnetic member 1 has an anisotropic structure in which many magnetic particles 6 dispersed and deposited on the surface or the interface of the insulator members spread in a single-member shape.

Moreover, when the compound phase is subjected to element substitution or a plurality of solid solutions are used, deposition sites of the magnetic particles in the insulator member can be controlled, thus freely controlling an interval between the magnetic particles. That is, dispersion and deposition of the magnetic particles 6 formed of magnetic metals or an alloy of these metals on the interface of each of the insulator members 2, 3, 4 and 5 or the surface in case of the single insulator member can be controlled within a particle diameter range of 1 to 100 nm and a particle interval range of 1 to 10 nm.

Additionally, the insulator member may contain 0.01 to 0.25% by atomic weight of at least one [C] additive metal element selected from Al, Cr, Sc and Si as well as the [A] metal element and the [B] magnetic metal element constituting the [a] non-reducible metal oxide. However, in this composition, as to elements selected from the [A] metal elements constituting the [a] non-reducible metal oxide and the [C] additive metal elements, the same elements are not combined with each other. That is, a combination of different elements is preferable. It is preferable to contain the [C] additive metal element in this manner in the system forming the solid solution. For example, in a bivalent oxide solid solution system, subjecting a trivalent or higher-valued oxide to solid solution processing can increase a reduction speed of the [b] magnetic metal oxide or the magnetic alloy oxide by a valence effect. That is, adding an additive can facilitate reduction of the [b] magnetic metal oxide or the magnetic alloy oxide, thus allowing deposition of the fine magnetic particles with a high density. It is to be noted that this reduction processing process will be described in the manufacturing method.

(Characteristics and Applications of Magnetic Layer)

As described above, the magnetic member 1 according to this embodiment has a structure in which the magnetic particles 6 of at least one magnetic metal selected from Fe, Ni and Co or a magnetic alloy are buried in the interface between the insulator members bonded to each other and the entire surface of each magnetic particle 6 is coated with the protection film 6A containing at least one of $Al_2O_3$, AlN, $SiO_2$, $Si_3N_4$ and SiC. Additionally, as described above, since the conditions such as a dispersion state of the magnetic particles 6, a film thickness of the protection film 6A and others are set, the magnetic member 1 can have characteristics which are excellent in 100 MHz to several GHz or in a high-frequency domain of 10 GHz. Therefore, the magnetic member 1 can be used as an excellent member of a high-frequency magnetic component used in 100 MHz or in a high-frequency domain of 1 GHz or above such as an antenna substrate, a transformer magnetic core, a magnetic head core, an inductor, a choke coil, a filter or a wave absorber.

For example, when this magnetic member 1 is applied to an antenna substrate of an antenna apparatus, it is preferable for a dielectric constant of a material of superimposed insulator members to be inclined. In this embodiment, when forming an antenna on an exposed surface of the insulator member of the four insulator members 2, 3, 4 and 5, the insulator member 5 can be formed of magnesia (MgO), and the underlying insulator member 4 can be formed of alumina ($Al_2O_3$), thereby inclining the dielectric constant. The dielectric constant of the insulator members is inclined in this manner because an electronic communication device in which an antenna is mounted has an inherent optimum value and an improvement in antenna characteristics can be expected by inclining the dielectric constant.

Modification of First Embodiment

It is to be noted that the magnetic member 1 according to this embodiment has the structure in which the protection film 6A is formed on the surface of each magnetic particle 6, but a magnetic member having a structure in which the protection film 6A is not formed, i.e., a magnetic member (a magnetic member precursor) having a structure in which a plurality of magnetic particles obtained by solid-solving one of elements Al and Si are arranged to be partially buried in a member surface of each insulator member can be applied to a high-frequency magnetic component. However, as will be described on the manufacturing method later, it is preferable for the magnetic member to have a structure including the protection film 6A formed of, e.g., $Al_2O_3$, AlN, $SiO_2$, $Si_3N_4$ or SiC obtained by oxidizing solid-solved Al or Si on the surface of each magnetic particle.

(Magnetic Layer Precursor)

A structure of a magnetic member precursor produced at a previous step in the manufacturing process of the magnetic member will now be described with reference to FIGS. 32 to 34. Although the example in which the four insulator members are provided, has been described in the first embodiment, a description will be individually provided on a two-member structure and a single-member structure in order to simplify the explanation. It is to be noted that the magnetic member precursor has an appropriate number of members in accordance with performance or dimensions required for the magnetic member to be manufactured, and a structure in which three or more insulator members are superimposed can be of course adopted like the magnetic member (a four-member structure) according to the first embodiment.

Figure 32:
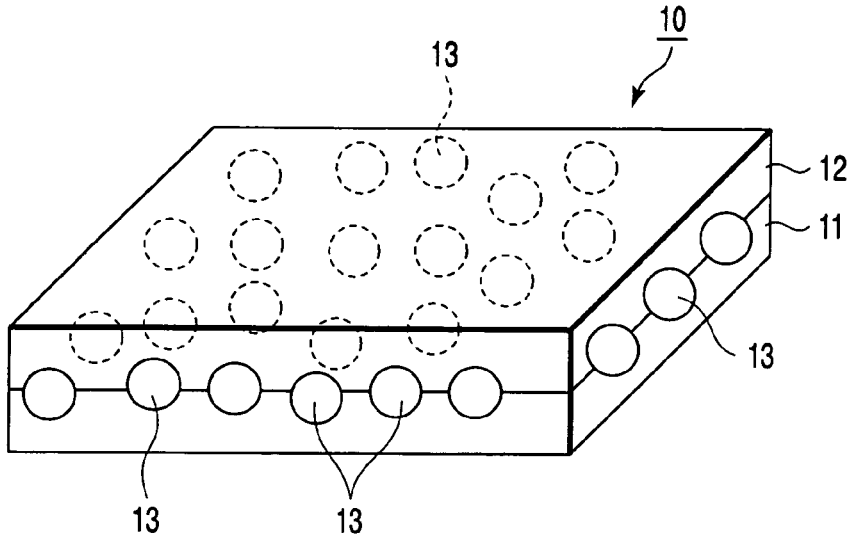
FIG. 32 is a perspective view showing a configuration of a precursor (a two-member configuration) of a magnetic member according to the present invention.
Figure 33:
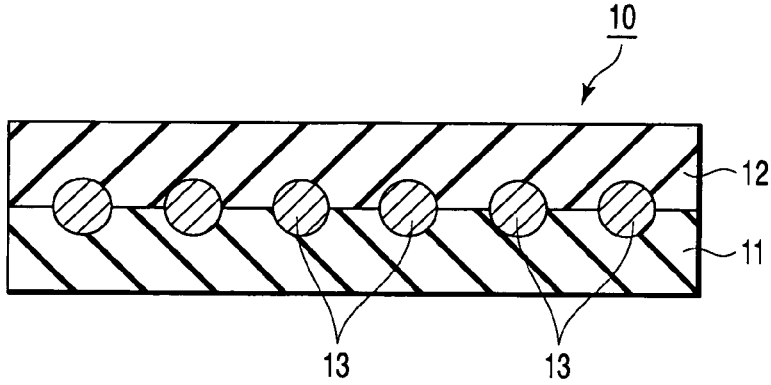
FIG. 33 is a cross-sectional view of the precursor (the two-member configuration) of the magnetic member depicted in FIG. 32.

FIG. 32 is a perspective view showing a magnetic member precursor having a two-member structure, and FIG. 33 is a cross-sectional view showing a state in which the magnetic member precursor depicted in FIG. 32 is cut in a thickness direction.

In this magnetic member precursor 10, two insulator members 11 and 12 are bonded to each other, and magnetic particles 13 are arranged on a lamination interface of these insulator members 11 and 12 to be buried in both the insulator members 11 and 12.

The magnetic particle 13 has the same structure as the magnetic particle 6 in the magnetic member 1 according to the first embodiment. That is, the magnetic particle 13 is formed of at least one selected from magnetic metals Fe, Ni and Co or an alloy of these magnetic metals. The magnetic particle 13 is deposited by reduction processing.

In this magnetic particle 13, Al and Si are solid-solved. These materials serve as a constituent element of a protection film consisting of an oxide formed by oxidation. An atomic weight percent of this solid-solved element is not greater than 50%. As a solid solution system, it is possible to select one from Fe—Al, Fe—Si, Co—Si, Ni—Si, Fe—Co—Al, Fe—Co—Si, Fe—Ni—Al, Fe—Ni—Si, Co—Ni—Si, Fe—Co—Ni—Al and Fe—Co—Ni—Si. As an amount of Al and Si subjected to solid solution, a smaller amount is preferable in order to increase saturated magnetization of the particles. However, a larger amount is preferable in order to improve contact properties with respect to the protection film 6A to be applied. That is, the amount of Al and Si subjected to solid solution is determined based on the balance of the saturated magnetization and the contact properties with respect to the protection film which is to be formed by oxidation, and a range of 5 to 10% by atomic weight is most preferable. Further, in order to improve high-frequency characteristics of relative permeability, a small amount of another component such as Mn or Cu may be contained as a third component.

Furthermore, in this magnetic member precursor 10, like the first embodiment, it is preferable for crystal orientations of crystal gratings of the magnetic particles 13 held between the pair of insulator members 11 and 12 to be aligned along at least two axes with respect to a crystal orientation of at least one of the pair of insulator members. Aligning the crystal orientations in this manner allows existence of the magnetic particles 6 in the member interface in a thermally very stable state. Therefore, even when oxidation and a heat treatment are carried out in a later process, the magnetic particles 13 stably exist. Moreover, even if the magnetic member is applied as a high-frequency magnetic component as typified by the antenna apparatus, it can be used for a long time.

It is to be noted that setting the particle diameter of each magnetic particle of the magnetic member to be not greater than 100 nm as described in the first embodiment, and hence it is good enough to control the particle diameter of the magnetic particle 13 deposited when manufacturing the magnetic member precursor 10 while considering the film thickness of the protection film formed by oxidation.

The dispersed state of the magnetic particles 13 in the magnetic member precursor 10 is the same as the dispersed state of the magnetic particles in the magnetic member 1 according to the first embodiment. That is, a state where the magnetic particles 13 are separated from each other at intervals of 0 to 5 nm is desirable.

Additionally, since the magnetic member precursor 10 serves as the magnetic member by performing oxidation, constituent components of the magnetic member precursor 10 are the same as those of the insulator members 2, 3, 4 and 5 constituting the magnetic member 1 according to the first embodiment. That is, each of the insulator members 11 and 12 is formed of an oxide insulator obtained by combining at least one selected from the [A] metal elements of the [a] non-reducible metal oxide with at least one [B] magnetic metal (soft magnetic metal) element selected from iron (Fe), nickel (Ni) and cobalt (Co). Furthermore, the insulator member contains at least one [C] additive metal element selected from Al, Cr, Sc and Si in an amount of 0.01 to 0.25% by atomic weight as well as the [A] metal element constituting the [a] non-reducible metal oxide and the [B] magnetic metal element. However, in this composition, as to elements selected from the [A] metal elements constituting the [a] non-reducible metal oxide and the [C] additive metal elements, the same elements are not combined with each other. That is, a combination of different elements is preferable.

Moreover, it is preferable for this magnetic member precursor 10 to be a polycrystalline substance. Being the polycrystalline substance means that manufacture is possible by a sintering method, and production at a low cost can be realized. If such a polycrystalline substance is adopted, there is an advantage that the magnetic particles can be readily deposited on the grain boundary, especially the surface of the insulator member. It is to be noted that the magnetic particle 13 deposited by reduction processing may be a single crystal.

Figure 34:
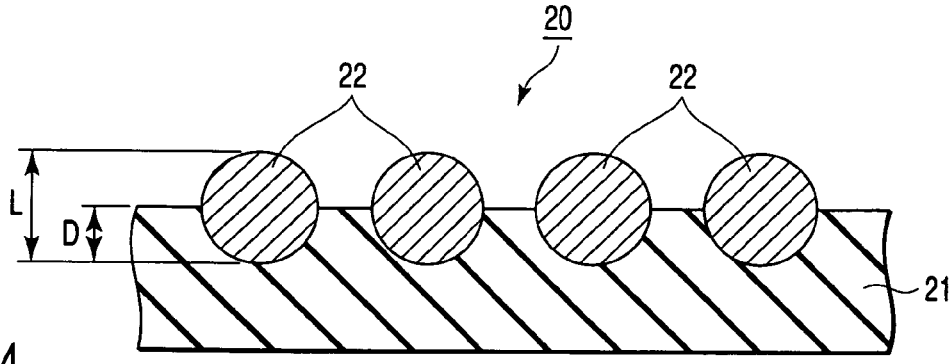
FIG. 34 is a cross-sectional view showing a configuration of a precursor (a single-member configuration) of a magnetic member according to the present invention.

FIG. 34 is a cross-sectional view of a magnetic member precursor 20 when an insulating member is a single member. This magnetic member precursor 20 is constituted of a single insulator member 21 and a plurality of magnetic particles 22 arranged to be partially buried in one member surface of this insulator member 21.

The single insulator member 21 or each magnetic particle 22 in case of the single-member structure is formed of the same material as that in case of the two-member structure mentioned above. Further, as shown in FIG. 34, in case of the magnetic member precursor 20 having a single-member structure, it is preferable for a buried depth D of each magnetic particle 22 to fall within a range of 40% to 80% of a particle diameter (a particle diameter in a depth direction) L from the surface of the insulator member 21. It is to be noted that such a buried depth D of the magnetic particle can be controlled when manufacturing the magnetic member precursor 20.

[Second Embodiment of Magnetic Layer: Single-Member Structural Example 1]

Figure 35:
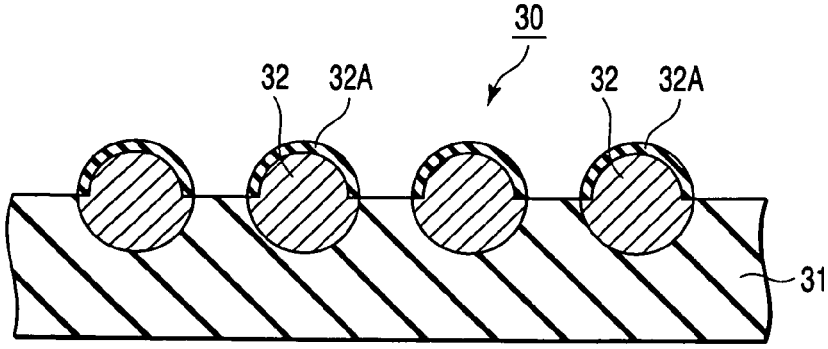
FIG. 35 is a cross-sectional view showing a second embodiment of a magnetic member according to the present invention.

FIG. 35 shows a magnetic member 30 according to a second embodiment of the present invention. This magnetic member 30 is constituted of an insulator member 31, magnetic particles 32 arranged to be buried in one surface of this insulator member 31, and a protection film 32A covering a surface of each magnetic particle 32 exposed from the insulator member 31.

This magnetic member 30 is obtained by oxidizing a magnetic member precursor having the same structure as the magnetic member precursor 20. In this magnetic member 30, it is likewise preferable for a buried depth D of each magnetic particle 32 including the protection film 32A to fall within a range of 40% to 80% of a particle diameter (a particle diameter in a depth direction) L from the surface of the insulator member 31. It is to be noted that since structures or the like of the insulator member 31, the magnetic particle 32 and the protection film 32A in the magnetic member 30 according to this embodiment are the same as those in the magnetic member 1 according to the first embodiment, and hence the explanation thereof is omitted.

The magnetic member 30 according to this embodiment shown in FIG. 35 has a structure in which the protection film 32A is formed on the surface alone of the magnetic particle 32 exposed from the insulator member 31, and such a structure can be formed by controlling heat treatment conditions.

[Third Embodiment of Magnetic Layer: Single-Member Structural Example 2]

Figure 36:
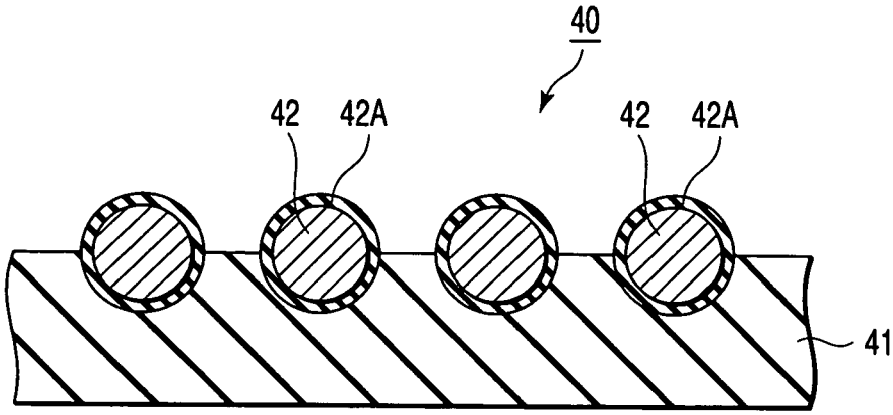
FIG. 36 is a cross-sectional view showing a third embodiment of a magnetic member according to the present invention.

FIG. 36 shows a magnetic member 40 according to a third embodiment of the present invention. As shown in FIG. 36, this magnetic member 40 is different from the magnetic member 30 according to the second embodiment depicted in FIG. 35 in that a protection film 42A is formed on an entire surface of each magnetic particle 42 arranged to be partially buried in an insulator member 41.

Such a configuration of this magnetic member 40 can be manufactured by controlling, e.g., a component of the insulator member 41 or the magnetic particle 42 or heat treatment conditions of the deposited magnetic particle 42. Forming the protection film 42 consisting of an oxide on an interface between the magnetic particle 42 and the insulator member 41 in this manner can improve contact properties of the magnetic particle 42 and the insulator member 41.

It is to be noted that structures or the like of the insulator member 41, the magnetic particle 42 and the protection film 42A in the magnetic member 40 according to this embodiment are the same as those in the magnetic member 1 according to the first embodiment, and hence the explanation thereof is omitted.

[Fourth Embodiment of Magnetic Layer: Single-Member Structural Example 3]

Figure 37:
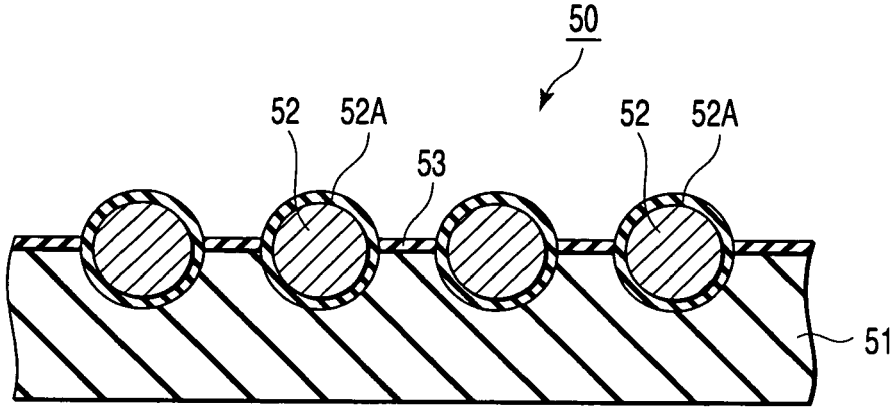
FIG. 37 is a cross-sectional view showing a fourth embodiment of a magnetic member according to the present invention.

FIG. 37 shows a magnetic member 50 according to a fourth embodiment of the present invention. As shown in FIG. 37, this magnetic member 50 has a structure in which a protection film 52A is formed on an entire surface of each magnetic particle 52 arranged to be partially buried in an insulator member 51 and an insulating protection film 53 is also formed on an entire surface of the insulator member 51 having a configuration in which each magnetic particle 52 is buried. It is to be noted that this insulating protective film 53 can be formed by a method of controlling heat treatment conditions of each magnetic particle 52, PVD technology or CVD technology.

It is to be noted that structures or the like of the insulator member 51, the magnetic particle 52 and the protection film 52A in the magnetic member 50 according to this embodiment are the same as those in the magnetic member 1 according to the first embodiment, and hence the explanation thereof is omitted.

[Fifth Embodiment of Magnetic Layer: Two-Member Structural Example 1]

Figure 38:
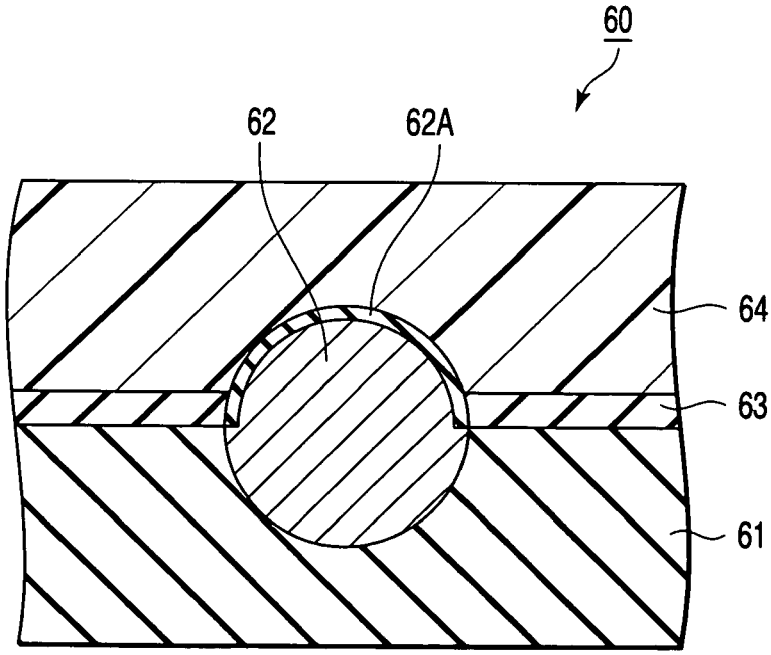
FIG. 38 is a cross-sectional view showing a fifth embodiment of a magnetic member according to the present invention.

FIG. 38 shows a magnetic member 60 according to a fifth embodiment of the present invention. As shown in FIG. 38, this magnetic member 60 is provided with an insulator member 61, many magnetic particles 62, a protection film 62A, an insulating protection film 63 and an insulator member 64. Each magnetic particle 62 is provided to be partially buried in the insulator member 61. Further, the protection film 62A is formed on an surface of the magnetic particle 62 alone which is exposed from the insulator member 61. The insulating protection film 63 is formed on the entire surface of the insulator member 61 having a structure in which each magnetic particle 62 is buried. Furthermore, the insulator member 64 consisting of a synthetic resin is superimposed on the surfaces of these structures. Structural components or the like of the insulator member 61, the magnetic particle 62, the protection film 62A and others are the same as those in the magnetic member 1 according to the first embodiment, and hence the explanation thereof is omitted.

In the magnetic member 60 according to this embodiment, the insulator member 64 is formed of a synthetic resin such as polystyrene, polyethylene, polyethylene terephthalate (PET), or an epoxy-based resin. Therefore, in the magnetic member 60, a dielectric constant can be inclined between the insulator member 61 formed of a ceramic material and the insulator member 64 consisting of a synthetic resin, and hence the magnetic member 60 is suitable as a member of an electronic communication device such as an antenna apparatus in which an antenna is arranged and fixed. Additionally, since the insulator member 64 is formed of a synthetic resin, the durability can be improved with respect to a physical load such as vibrations.

[Sixth Embodiment of Magnetic Layer: Two-Member Structural Example 2]

Figure 39:
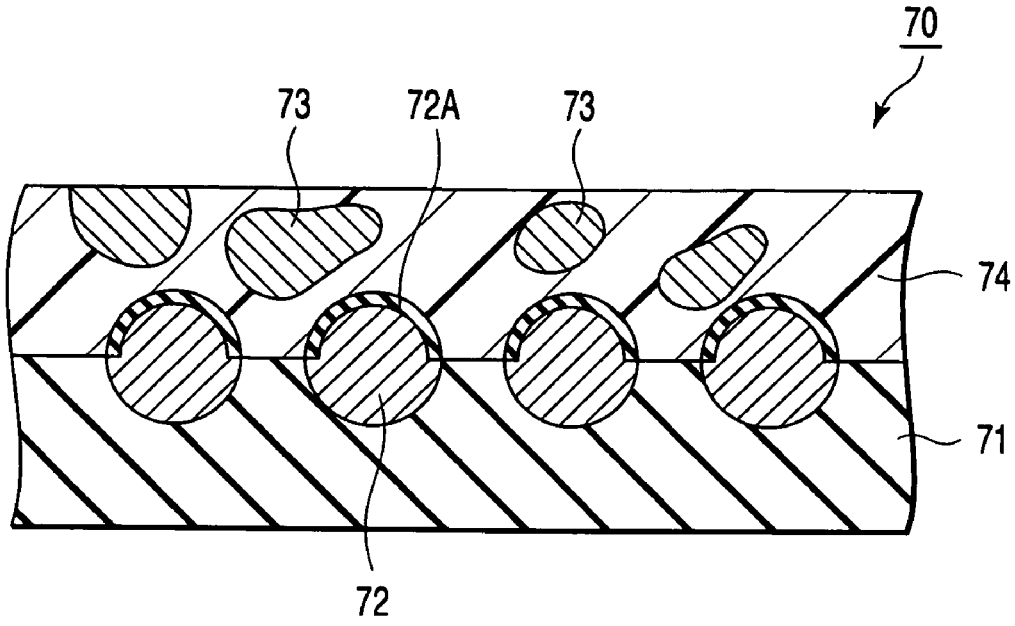
FIG. 39 is a cross-sectional view showing a sixth embodiment of a magnetic member according to the present invention.

FIG. 39 shows a magnetic member 70 according to a sixth embodiment of the present invention. As shown in FIG. 39, this magnetic member 70 is provided with an insulator member 71, many magnetic particles 72, a protection film 72A formed on a surface of each magnetic particle 72 alone which is exposed from the insulator member 71, and an insulator member 74 formed of a synthetic resin bonded to the insulator member 71 to sandwich each magnetic particle 72 between itself and the insulator member 71. Further, inorganic material particles 73 consisting of, e.g., ceramics are mixed and arranged in the insulator member 74. It is to be noted that constituent components or the like of the insulator member 71, the magnetic particle 72, the protection film 72A and others are the same as those in the magnetic member 1 according to the first embodiment, and hence their explanation is omitted. Furthermore, a component of the insulator member 74 is a synthetic resin such as polystyrene, polyethylene, polyethylene terephthalate (PET) or an epoxy-based resin as in the fifth embodiment.

In the magnetic member 70 according to this embodiment, since the inorganic material particles 73 are mixed in the insulator member 74 consisting of a synthetic resin, adjusting an amount of the inorganic material particles 73 can not only control a dielectric constant of the insulator member 74 but also improve process such as cutting.

[Seventh Embodiment of Magnetic Layer: Two-Member Structural Example 3]

Figure 40:
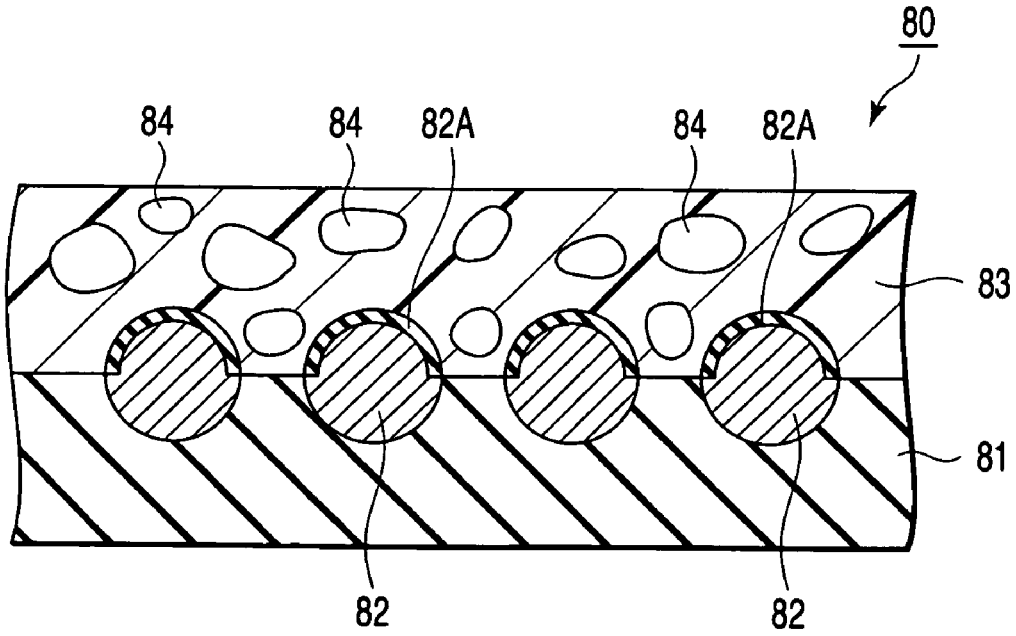
FIG. 40 is a cross-sectional view showing a seventh embodiment of a magnetic member according to the present invention.

FIG. 40 shows a magnetic member 80 according to a seventh embodiment of the present invention. As shown in FIG. 40, this magnetic member 80 is provided with an insulator member 81, many magnetic particles 82, a protection film 82A formed on a surface of each magnetic particle 82 alone which is exposed from the insulator member 81, and an insulator member 83 consisting of a synthetic resin bonded to the insulator member 81 to sandwich each magnetic particle 82 between itself and the insulator member 81. Moreover, air cavities (air bubbles) 84 are dispersed and formed in the insulator member 84. It is to be noted that constituent components or the like of the insulator member 81, the magnetic particle 82, the protection film 82A and others are the same as those in the magnetic member 1 according to the first embodiment, and hence their explanation is omitted. Additionally, a component of the insulator member 83 is a synthetic resin such as polystyrene, polyethylene, polyethylene terephthalate (PET) or an epoxy-based resin as in the fifth embodiment.

In the magnetic member 80 according to this embodiment, since the air cavities (air bubbles) 83 are formed in the insulator member 83 consisting of a synthetic resin, adjusting a size or the like of each air cavity 84 can control a dielectric constant of the insulator member 83. Further, forming the air cavities 84 in the insulator member 83 can further reduce a weight of the entire magnetic member 80.

[Manufacturing Method of Magnetic Layer]

A manufacturing method of a magnetic member according to the present invention will now be described. The manufacturing method of a magnetic member according to the present invention is not restricted to a specific manufacturing method as long as the above-described structure is provided, but there are a plurality of following manufacturing methods as preferable manufacturing methods.

(First Manufacturing Method)

This first manufacturing method includes the following four steps 1 to 4, and it is a basic manufacturing method which does not specify a shape and a structure of a magnetic member.

Step 1: a composite oxide, e.g., a solid solution is manufactured from a powder of a [a] non-reducible metal oxide, a powder of a [b] magnetic metal oxide and a small amount of an additive oxide (as required).

Step 2: the composite oxide manufactured at Step 1 is reduced to deposit fine magnetic particles consisting of at least one of a magnetic metal such as Fe, Co or Ni or an alloy basically containing such magnetic metals on a surface of the composite oxide.

Step 3: performing oxidation to form a protection film consisting of an oxide on a surface of each magnetic particle deposited at Step 2.

Step 4: after Step 3, another insulator member is formed on the surface of the composite oxide where the magnetic particles are deposited.

According to this manufacturing method, since a sintering method can be used, there is an advantage that a process yield is excellent and manufacture is possible at a low cost.

Step 1 will be first described in detail. This Step 1 is a step of manufacturing a composite oxide, e.g., a solid solution which consists of a powder of a [a] non-reducible metal oxide, a powder of a [b] magnetic metal oxide containing at least one of Fe, Co and Ni and a small amount of an additive oxide (as required) and has a molar ratio a:b of the [a] non-reducible metal oxide and the [b] magnetic metal oxide falling within a range of 10:90 to 90:10.

As the powder of the [b] magnetic metal oxide containing at least one of Fe, Co and Ni, iron monoxide (FeO) or cobalt oxide (CoO) is preferable. For example, although there are various conformations (stoichiometry) such as FeO, $Fe_2O_3$ or $Fe_3O_4$ as iron oxide, a composite oxide can be readily formed in an extensive composition range by using iron monoxide (FeO) and a non-reducible metal oxide. For example, when MgO is used as an [a] non-reducible metal oxide, FeO, CoO or NiO is particularly preferable since it becomes a complete solid solution. In case of a complete solid solution, fine metal particles can be deposited in crystal grains at an arbitrary ratio in a reduce processing step of depositing the magnetic particles on the surface like Step 2. It is to be noted that, as iron oxide, iron oxide having any other valence may be contained besides iron monoxide (FeO). Further, in case of forming a solid solution of an Fe—Al—O-based compound, using $Fe_2O_3$ is preferable.

Furthermore, as a [b] magnetic metal oxide containing a [B] magnetic metal such as Fe, Co or Ni, a composite metal oxide in which Cu or Mn is added can suffice. Here, when Ni is selected, it is preferable for an amount of Ni contained in the [b] magnetic metal oxide to be a content rate which is not smaller than 50 mol % with respect to Co or Fe. Moreover, in case of containing Cu or Mn in the [b] magnetic metal oxide, setting a content rate which is not greater than 10 mol % is preferable. As the composite metal oxide mentioned in conjunction with Step 1, it is possible to adopt a composite metal oxide such as $CoFe_2O_4$ or $NiFe_2O_4$ or other composite metal oxide having nickel oxide, copper oxide, manganese oxide or any other impurity added therein. Since the [b] magnetic metal oxide is a metal oxide which can be reduced to a metal in a hydrogen atmosphere at 200 to 1500° C., the magnetic particles can be deposited at Step 2. Therefore, the [b] magnetic metal oxide can be called a reducible metal oxide.

In a molar ratio of the [a] non-reducible metal oxide and the [b] magnetic metal oxide, when an amount of the [a] non-reducible metal oxide is increased beyond the ratio a:b=90:10, namely, a percentage of this material exceeds 90, a percentage of the [b] magnetic metal oxide is reduced, and hence a magnetic interaction between particles is decreased, and super paramagnetism occurs in some cases, thereby deteriorating characteristics On the other hand, when a percentage of the [b] magnetic metal oxide is increased beyond the ratio a:b=10:90, crystal grains of the magnetic particles deposited in the reduction process are increased, characteristics in a high frequency are decreased, whereby magnetic characteristics required for the antenna substrate, the high-frequency magnetic core, the electromagnetic wave absorber or the like are reduced.

Describing an appropriate example of a molar ratio when using MgO and FeO as the [a] non-reducible metal oxide and the [b] magnetic metal oxide to manufacture a solid solution composite oxide, it is preferable to mix an MgO powder as the [a] non-reducible metal oxide and an FeO powder as the [b] magnetic metal oxide to realize the molar ratio 2:1. When the [a] non-reducible metal oxide is mixed with the [b] magnetic metal oxide at the ratio of 2:1 in this manner, a metal amount of the magnetic particles obtained by reduction can be suppressed to an appropriate amount, thereby suppressing coupling of the magnetic particles or grain growth.

An operation performed in Step 1 will now be specifically described hereinafter. First, there is carried out a raw powder preparation step at which the [a] non-reducible metal oxide, the [b] magnetic metal oxide and a small amount of an additive oxide (as required) are measured and mixed in a ball milling or the like to achieve a predetermined molar ratio, thereby preparing a raw powder. It is to be noted that mixing every oxides in an oxide conformation is preferable, but the present invention is not restricted thereto, and oxides may be mixed in any conformations, e.g., a hydroxide or a carbonate compound. Additionally, in mixing, as a material of a ball or a pot, using, e.g., a resin such as nylon is preferable in order to avoid interfusion. Further, mixing may be carried out in either a wet mode or a dry mode, but wet mixing is preferable in order to perform further uniform mixing, and a binder such as polyvinyl alcohol (PVA) may be added.

Then, the raw powder is heated to a predetermined temperature to evoke a reaction. Various conditions such as a heating temperature for evoking a reaction may be appropriately set in accordance with the raw powder or intended member performance. For example, as heating conditions, after press-molding the raw powder, this raw powder may be heated to a temperature of 1000° C. or above and sintered in an oxidizing atmosphere, in vacuum or in an inert atmosphere using argon (Ar) or the like. As the oxidizing atmosphere, there is atmospheric air, an inert gas atmosphere containing oxygen and others, but performing sintering in the inert atmosphere or vacuum is preferable in order to avoid a fluctuation in an amount of oxygen. For example, in case of manufacturing an FeO—MgO solid solution composite oxide, effecting sintering in vacuum or an Ar atmosphere is preferable. It is to be noted that using a deposit obtained by a chemical reaction can acquire a finer raw powder as the raw powder, and it can be reflected in miniaturization of crystal grains after various kinds of processes.

The composite oxide obtained at Step 1 is not restricted to a specific shape such as a powder or a bulk. Furthermore, a product manufactured by the sintering method (a powder metallurgy method), even though it takes any conformation such as a powder or a bulk.

Step 2 will now be specifically explained. There is carried out Step 2 which reduces the composite oxide obtained at Step 1 to deposit at least one of Fe, Co and an alloy based on these materials. When hydrogen reduction processing is performed with respect to the obtained composite oxide, many magnetic particles can be uniformly dispersed and deposited in a state where they are partially embedded in a surface of the composite oxide (an insulator member). That is, since the magnetic particles are flatly spread, arranged and formed in a state where they are dispersed along the surface of the composite oxide, the entire magnetic member has an anisotropic structure.

Moreover, such a manufacturing method can obtain a structure in which the magnetic particles are partially embedded in the surface of the composite oxide (the insulator member) as described above. Specifically, an buried depth D of the magnetic particles can be controlled to fall within a range of 40% to 80% of a particle diameter (a particle diameter in a depth direction) L from the surface of the insulator member.

Each of the thus deposited magnetic particles is a particle consisting of at least one of magnetic metals (soft magnetic metals) selected from Fe, Ni and Co or an alloy of such magnetic metals. Specifically, this magnetic particle is obtained by solid-solving Al or Si as a second component with an Fe particle, an Ni particle, an Fe—Co particle, an Fe—Ni particle, a Co—Ni particle and an Fe—Co—Ni particle being used as a basic particle.

In particular, since saturated magnetization must be increased as much as possible in order to realize high permeability, it is preferable to use an Fe—Co particle having the highest saturated magnetization as a basic particle and add a small amount of another element, e.g., Ni to provide oxidation resistance. It is preferable to contain Al or Si as the second component at a ratio of 50% or below by atomic weight and control it to be solid-solved. As a material to be solid-solved, it is possible to select one of Fe—Al, Fe—Si, Co—Si, Ni—Si, Fe—Co—Al, Fe—Co—Si, Fe—Ni—Al, Fe—Ni—Si, Co—Ni—Si, Fe—Co—Ni—Al and Fe—Co—Ni—Si. It is preferable to reduce an amount of Al or Si to be solid-solved as much as possible in order to increase saturated magnetization of each particle at a maximum, but a larger amount is preferable in order to improve contact properties with respect to the protection film formed at Step 3. That is, the amount of Al or Si to be solid-solved is determined by the balance of saturated magnetization and contact properties with respect to the protection film, and controlling this amount to fall within a range of 5 to 10% by atomic weight is most preferable.

It is to be noted that, as the magnetic particle, existence of at least one selected from an Fe particle, a Co particle, an Fe—Co alloy particle, an Fe—Co—Ni alloy particle, an Fe group alloy particle, and a Co group alloy particle can suffice, and another non-magnetic metal element may be alloyed besides such a particle. However, when an amount of the alloyed element is too large, saturated magnetization is extremely lowered. Therefore, considering high-frequency characteristics, it is preferable to control allowing using another non-magnetic metal element (a reducible metal other than Fe and Co) to become not greater than 10 at %. Moreover, although a non-magnetic metal may be solely dispersed in a composition, it is preferable for its amount to become not smaller than 10% by volume. It is preferable for the Fe group alloy particle to partially contain Co or Ni in view of oxidation resistance of the deposited fine crystal, and an Fe—Co group particle is desirable from a standpoint of saturated magnetization in particular.

A crystal orientation of the thus deposited magnetic particle can be formed to be aligned with respect to a crystal orientation of the composite oxide (the insulator member) along at least two axes. When the crystal orientation of the magnetic particle is formed to be aligned with respect to the crystal orientation of the composite oxide (the insulator member) along at least two axes in this manner, each magnetic particle can exist on the surface of the composite oxide in a thermally very stable state. When all of the magnetic particles 6 are matched with a crystal grating of the composite oxide and equally aligned on the surface of the composite oxide (the insulator member), the magnetic particles are strongly anchored with respect to the composite oxide (the insulator member), thermally very stable and can have high-frequency characteristics which are stable for a long time as high-frequency member to be finally used. It is to be noted that the buried state of each magnetic particle formed in this manufacturing method is decisively different from a state in which each magnetic particle is simply placed in a depression on the surface of the composite oxide, and a difference between these states can be recognized by using TEM or a diffraction figure.

Additionally, it is preferable to control the dispersed state of the magnetic particles deposited by such a manufacturing method to become a state where the magnetic particles are dispersed and separated from each other at intervals of 0 to 5 nm.

It is to be noted that hydrogen reduction in this manufacturing method may be carried out in a pulverized powder state in which a powder, a bulk (e.g., a pellet shape, a ring shape or a rectangular shape) or a bulk-shaped sample is pulverized. In particular, in case of a powder (including a pulverized powder), since a short reaction time can suffice, fine magnetic particles are dispersed, thereby facilitating deposition. Further, when reduction processing is effected with respect to a shape of a predetermined magnetic component, e.g., an antenna substrate, subsequent processing to obtain a component can be facilitated.

Incidentally, in regard to a temperature and a time of hydrogen reduction, a temperature at which at least a part of the oxide is reduced by hydrogen can suffice, and it is not restricted to a specific value. However, progress of a reduction reaction is too slow at a temperature which is not greater than 200° C., and growth of each deposited magnetic particle excessively advances and agglomeration occurs when the temperature exceeds 1500° C. Therefore, a temperature range of 200 to 1500° C. is preferable, and a temperature range of 400 to 1000° C. is more preferable. Furthermore, the time is determined based on the balance with respect to the reduction temperature, but a range of 10 minutes to 100 hours can suffice. In regard to a hydrogen atmosphere, a flow is preferable, and it is good enough for its flow volume to be not smaller than 10 cc/min. When reduction is carried out in a hydrogen flow current (in a hydrogen flow) in this manner, the magnetic particles can be readily uniformly deposited on the entire surface of the composite oxide. Moreover, its flow volume does not have to be always constant, and it may be varied depending on a temperature. For example, when reduction is carried out at a room temperature to 1000° C., a flow volume may be set to 0 at a room temperature to 500° C., and it may be set to 10 cc/min at 500 to 800° C., and it may be set to 3 cc/min at 800 to 1000° C. It is to be noted that reduction may be performed to deposit a whole amount of Fe or Co in the composite oxide, or reduction may be carried out in such a manner that the composite oxide partially remains.

Additionally, although hydrogen is desirable as a gas used in reduction processing, a reducing gas such as carbon monoxide or methane may be used.

Step 3 is a step of oxidizing the magnetic particles but, specifically, it is possible to use a method of performing a heat treatment in air, a method of leaving the magnetic particles in oxygen or a method of oxidizing the magnetic particles by using an acid gas or an acid solution.

Step 4 is a step of forming the other insulating member on the surface of the composite oxide in which the oxidized magnetic particles are partially buried but, specifically, it is possible to adopt a method of forming a raw insulating member by screen printing or gravure printing and then effecting a heat treatment, or a method of pressure-welding a previously manufactured insulating sheet to the surface of the composite oxide.

Additionally, as a method of simultaneously executing Step 3 and Step 4, an oxidizing agent may be previously mixed in the other insulating member so that the surface of the magnetic particles can be oxidized simultaneously with application.

It is to be noted that, when Al or Si is not solid-solved in each magnetic particle deposited on the surface of the composite oxide (the insulator member), each magnetic particle is coated with a film containing at least one of Al and Si and a heat treatment is performed, thereby obtaining each magnetic particle having Al or Si solid-solved therein. Although the method of coating each magnetic particle with at least one of Al and Si is not restricted to a particular method, a method of coating the magnetic particle by sputtering which uses an Al target, an Si target or an Al—Si target having a predetermined composition is preferable. At this time, each magnetic particle is coated by an amount that one of Al, Si and Al—Si is subjected to solid solution, and solid solution processing is effected by a heat treatment. Conditions of this heat treatment are not restricted as long as each magnetic particle is not oxidized and solid solution processing with Al, Si or Al—Si can be effected, but performing heating in an inert gas atmosphere such as Ar in a range of 200 to 1000° C. is preferable. Furthermore, an amount of solid solution must be carefully determined since it affects a thickness of a film consisting of one of $Al_2O_3$, AlN, $SiO_2$, $Si_3N_4$ and SiC obtained by a subsequent heat treatment (oxidation processing). For example, up to approximately 53 mol % by atomic weight of Al can be solid-solved in Fe. However, when 53 mol % of Al is solid-solved with respect to each Fe particle having a particle diameter of 10 nm, an $Al_2O_3$ film having a thickness of approximately 2 nm can be formed on a surface of the Fe particle by a subsequent heat treatment. Moreover, when 20% of Al is solid-solved with respect to each Fe particle having a particle diameter of 100 nm, an $Al_2O_3$ film having a thickness of approximately 7 nm can be formed on the surface of the Fe particle by the subsequent heat treatment.

(Second Manufacturing Method)

Figure 41:
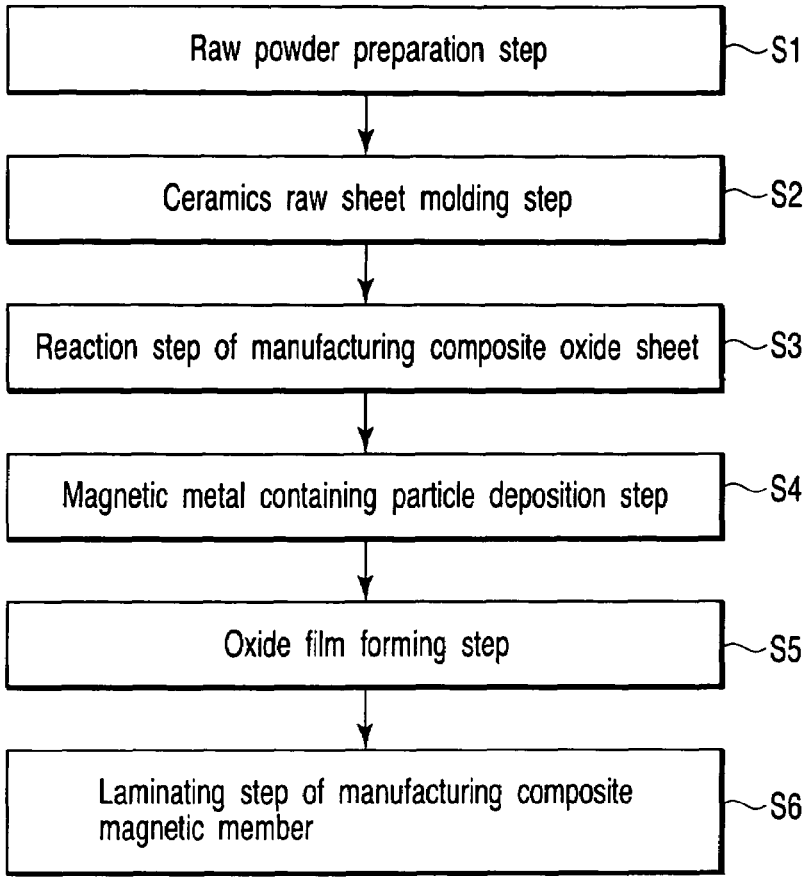
FIG. 41 is a flowchart showing a second manufacturing method of a magnetic member according to the present invention.

A second manufacturing method of a magnetic member will now be described with reference to a flowchart depicted in FIG. 41. As shown in FIG. 41, the second manufacturing method sequentially includes a raw powder preparation step, a molding step, a reaction step, a particle deposition step, a oxide film (a protection film) forming step and a laminating step.

First, the raw powder preparation step is a step of measuring and mixing an [a] non-reducible meal oxide of an [A] metal element which is one selected from Mg, Al, Si, Ca, Ti, Zr, Ba, Sr, Zn, Mn, Hf and a rare-earth element and at least one selected from [b] magnetic metal oxides of at least one [B] magnetic metal element selected from Fe, Ni and Co, thereby preparing a ceramics raw material (step S1).

The molding step is a step of molding the ceramics raw material prepared at step S1 to manufacture a ceramics raw sheet (step S2).

The reaction step is a step of heating the ceramics raw sheet manufactured at step S2 to produce a composite oxide sheet (step S3).

The particle deposition step is a step of performing reduction processing to the composite oxide sheet manufactured at step S3 to deposit magnetic particles on a surface of the composite oxide sheet, thereby producing a magnetic member precursor (step S4).

The oxide film (the protection film) forming step is a step of oxidizing the composite oxide sheet (the magnetic member precursor) on which the magnetic particles have been deposited at step S4 to form an oxide film (a protection film) on the surface of each magnetic particle (step S5).

The laminating step is a step of laminating another insulating sheet on the composite oxide sheet manufactured at step S4 and bonding the surface of the composite oxide sheet to the insulating sheet in such a manner that the magnetic particles are held at a lamination interface (step S6).

Although the above has described the second manufacturing method, materials, various processing conditions and others in this manufacturing method are the same as those in the first embodiment. It is to be noted that various kinds of insulating materials can be used as the insulating sheet, but it is possible to use an organic material such as polystyrene, polyethylene, polyethylene terephthalate (PET) or an epoxy-based resin.

(Third Manufacturing Method)

Figure 42:
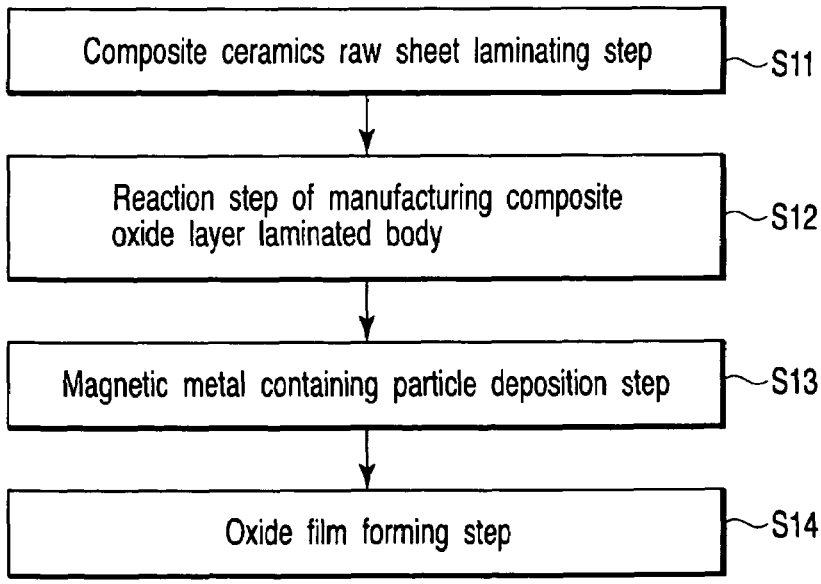
FIG. 42 is a flowchart showing a third manufacturing method of a magnetic member according to the present invention.

A third manufacturing method of a magnetic member will now be described with reference to a flowchart of FIG. 42. As shown in FIG. 42, the third manufacturing method sequentially includes a laminating step, a reaction step, a particle deposition step and an oxide film forming step.

In this manufacturing method, an [a] non-reducible metal oxide of at least one [A] metal element selected from Mg, Al, Si, Ca, Cr, Ti, Zr, Ba, Sr, Zn, Mn, Hf and a rare-earth element and at least one selected from [b] magnetic metal oxides of at least one [B] magnetic metal element selected from Fe, Ni and Co are measured and mixed in advance, thereby preparing a ceramics raw material. Further, the ceramics raw material is molded to produce ceramics raw sheets.

Furthermore, the plurality of ceramics raw sheets are laminated to manufacture a ceramics raw sheet laminated body (step S11).

At the next reaction step, this ceramics raw sheet laminated body is sintered to produce a composite oxide laminated body (step S12).

Then, at the particle deposition step, the composite oxide laminated body manufactured at step S12 is reduced to deposit magnetic particles consisting of a magnetic metal or an alloy containing a magnetic metal on a lamination interface of the composite oxide laminated body, thereby producing a magnetic member precursor (step S13).

At last, the oxide film forming step is carried out to oxidize the composite oxide laminated body having the magnetic particles deposited thereon, thereby forming a protection film consisting of an oxide film on the surface of each magnetic particle (step S14). Performing the oxide film forming step in this manner bring manufacture of the magnetic member to completion.

It is to be noted that materials, various processing conditions and others in this third manufacturing method are the same as those in the first manufacturing method.

(Fourth Manufacturing Method)

Figure 43:
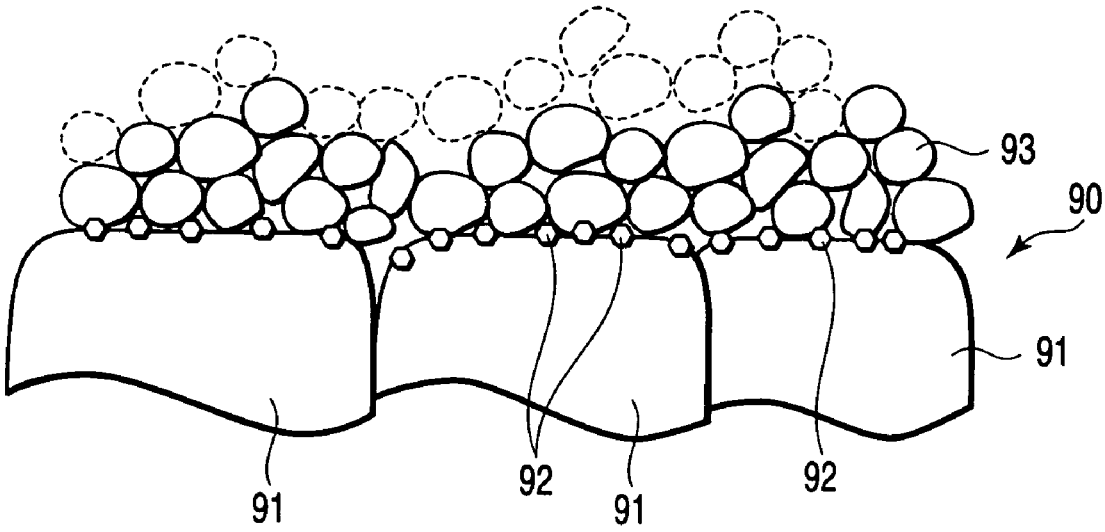
FIG. 43 is an enlarged view of a primary part illustrating a fourth manufacturing method of a magnetic member according to the present invention.
Figure 44:
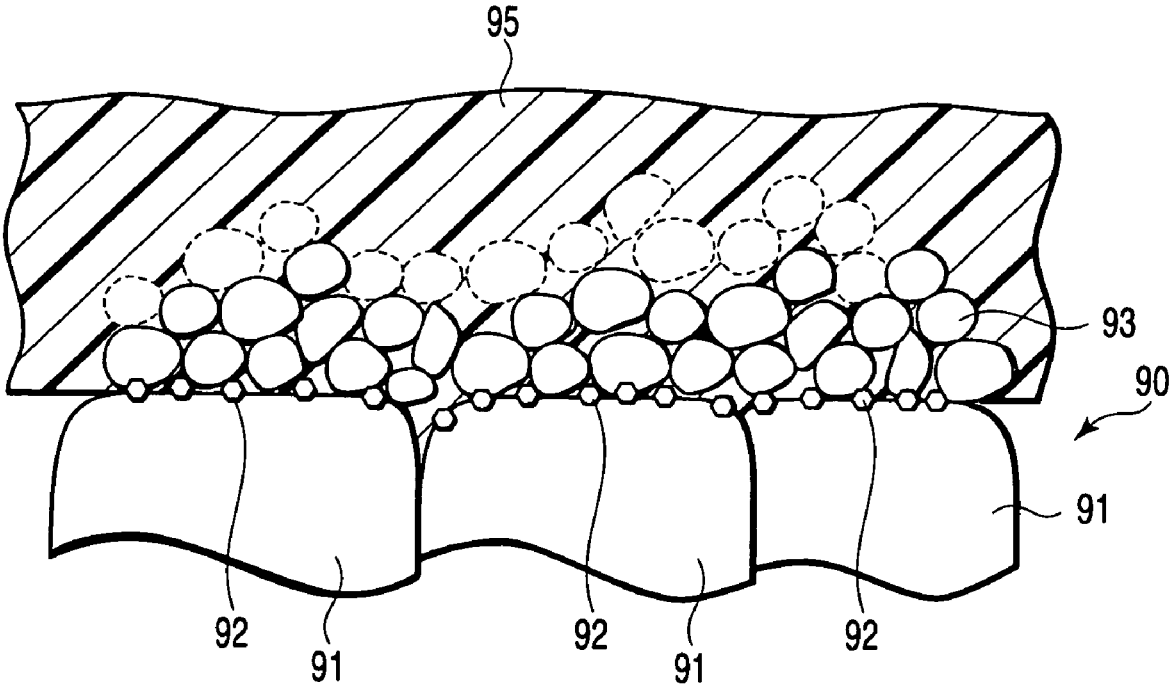
FIG. 44 is an enlarged cross-sectional view of a primary part illustrating the fourth manufacturing method of the magnetic member according to the present invention.

FIGS. 43 and 44 are enlarged cross-sectional views of primary parts showing steps which are characteristics of a fourth manufacturing method. This fourth manufacturing method is the same as the third manufacturing step from the first step to the step of forming the protection film on the surface of each magnetic particle by oxidation processing (step S14). That is, as shown in FIG. 43, a first step to a step of forming a protection film (not shown) on a surface of each magnetic particle 92 deposited on a surface of a composite oxide sheet 91 are the same as the first step to step S14 in the third manufacturing method.

In this fourth manufacturing method, as shown in FIG. 43, magnetic particles 92 are formed at an interface between a composite oxide sheet (an insulator member) 91 in which the magnetic particles 92 having a protection film formed thereon are partially buried and each insulator ceramic sheet 93 having a composition different from that of 91. As shown in FIG. 43, a structure of this insulator ceramic sheet 93 may be a polycrystal or amorphous structure in which a gap is formed between particles, or a continuous porous structure. Using the insulator member having such a configuration can facilitate deposition at the interface, and deposition of the magnetic particles can be readily controlled even in a multimember structure.

Then, as shown in FIG. 15, impregnation with a resin material 95 is effected from a part where the insulator ceramic sheet 93 is exposed. As a result, as shown in FIG. 44, the resin material 95 enters each gap of the insulator ceramic sheet 93 to increase adhesion strength and prevent each magnetic particle 92 from falling off the surface of the composite oxide sheet 91. Furthermore, there is an advantage that selecting a constituent of this resin material 95 can control a dielectric constant.

(Fifth Manufacturing Method)

FIGS. 45A to 45D show a fifth manufacturing method. This fifth manufacturing method is the same as the third manufacturing method except that the fifth manufacturing method includes a step of removing magnetic particles (including a protection film) exposed on an exposed surface side of a composite oxide laminated body (a laminated body of an insulator member).

In this manufacturing method, as shown in FIG. 45A, a first ceramics raw sheet 102 consisting of a constituent raw material of a magnetic member is formed on one surface of a sheet-like support 101. Moreover, a second ceramics raw sheet 103 is applied and formed on this first ceramics raw sheet 102.

A description will be given on an example of a printing method.

(1) A first ceramics paste is printed and dried on the sheet-like support 101 to obtain the first ceramics raw sheet 102.

(2) In this state, the second ceramics paste is printed and dried on the first ceramics raw sheet 102 to form the second ceramics raw sheet 103, thereby obtaining a raw ceramic composite sheet A in which two members of the ceramic raw sheet are formed on the sheet-like support as shown in FIG. 45A.

Then, the sheet-like support 101 is exfoliated, and the ceramics raw laminated body is air-tightly enclosed in a lamination container to perform lamination processing by using isostatic pressing or the like. Although the lamination example having two members alone is shown in FIG. 45A, it is often the case that a plurality of composite sheets consisting of sheets 101, 102 and 103 are prepared, many composite sheets consisting of the sheets 102 and 103 from which the sheet-like support 101 has been exfoliated are laminated, and then lamination processing is performed. Thereafter, the laminated body is cut into a predetermined size, then degreased and sintered. It is to be noted that, when manufacturing the composite sheet consisting of the sheets 102 and 103, the sheet 102 may be first formed on the sheet-like support 101 and then the previously prepared sheet 103 may be subjected thermocompression bonding.

Then, the ceramics sheet laminated body is reduced in a hydrogen atmosphere, and magnetic particles 104 are deposited on outer surfaces of the first ceramics sheet 102A and the second ceramics sheet 103A and a lamination interface as shown in FIG. 45B.

Moreover, the ceramics sheet laminated body on which the magnetic particles 104 are deposited is oxidized to form a protection film 104 on a surface of each magnetic particle 104 as shown in FIG. 45C.

Additionally, a step of removing each magnetic particle 104 (including the protection film 104A) formed on the outer surfaces of the ceramics sheet laminated body is carried out to manufacture such a magnetic member 110 as shown in FIG. 45D.

It is to be noted that, as the method of removing each magnetic particle 104 (including the protection film 104A) formed on the outer surfaces of the ceramics sheet laminated body, it is possible to adopt, e.g., a method of performing oxidation in air or a gas or a method of dissolving the magnetic particles in an acid, an alkaline solution or a molten metal. Additionally, the magnetic particles can be removed by polishing. Such a step of removing the magnetic particles 104 can obtain a structure in which the magnetic particles 104 do not exist on the outer surfaces (including end side surfaces of the interface) of the magnetic member 110. Further, the same effect can be obtained by covering the laminated body with a non-reducible ceramic, and then performing lamination and reduction.

Sixth Embodiment

Figure 46:
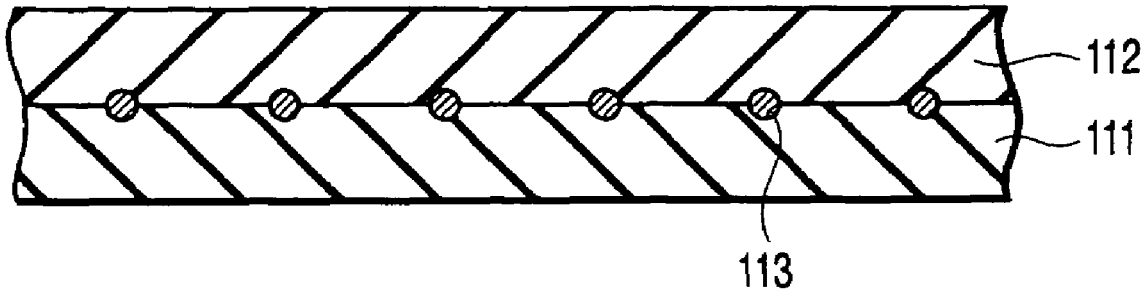
FIG. 46 is a cross-sectional view showing a first step in a sixth manufacturing method of a magnetic member according to the present invention.
Figure 47:
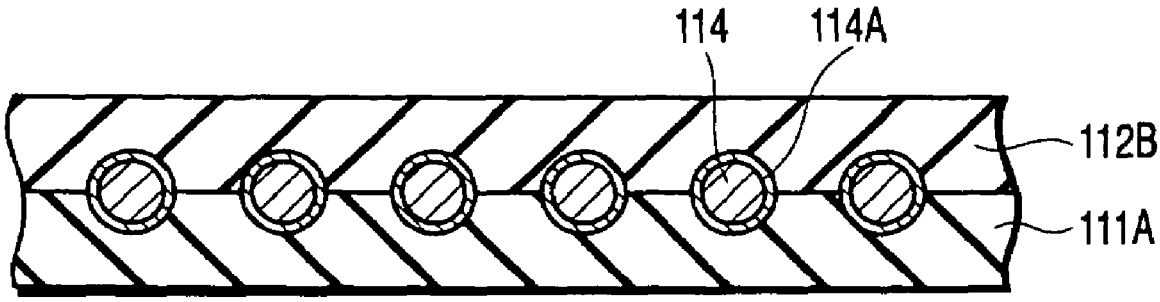
FIG. 47 is a cross-sectional view showing a second step in the sixth manufacturing method of the magnetic member according to the present invention.

FIGS. 46 and 47 show a sixth manufacturing method. In this sixth manufacturing method, as shown in FIG. 46, fine particles 113 consisting of an inorganic material which serve as nuclei of magnetic particles 114 (see FIG. 47) are arranged in a lamination interface of ceramics raw sheets 111 and 112 in advance.

Then, a ceramics laminated body is degreased, sintered and then reduced, whereby each magnetic particle 114 having a predetermined particle diameter is grown as shown in FIG. 47.

Thereafter, oxidation is carried out to form a protection film 114A on a surface of each magnetic particle 114 as shown in FIG. 47.

This sixth manufacturing method has an advantage that deposition of the magnetic particles can be controlled by arranging the fine particles 113 consisting of an inorganic material in advance. It is to be noted that various methods can be used as the method of uniformly dispersing such fine particles 113 on the ceramics raw sheets, but the fine particles 113 can be uniformly arranged on the ceramics raw sheet surfaces by spraying a liquid in which the fine particles 113 are mixed in, e.g., volatile alcohol. Although FIG. 47 shows an example where the inorganic material serving as nuclei grows into the magnetic particles, but a composition of the inorganic material which becomes the nuclei does not have to be the same as a composition of the magnetic particles. Further, each magnetic particle is deposited with the nucleus as a point of origin, but deposition may start from other positions.

Furthermore, Specific Example 2 of a magnetic member used in the present invention will now be described.

A plurality of magnetic particles consisting of at least one of magnetic metals (soft magnetic metals) selected from Fe, Ni and Co or an alloy of such magnetic metals have a structure in which they are dispersed in an insulator member. Since the magnetic particles and the insulator member are the same as those in Specific Example 1, and hence a manufacturing method will be specifically described.

A commercially available MgO single crystal is sliced to have a thickness of 400 μm, polished to have a thickness of 200 μm, buried in an FeO powder, and held in argon for 72 hours at 1700° C. to 1800° C. so that FeO is dispersed in MgO.

Then, this material is held in argon by using a carbon sheath at 1100° C. to 1300 for 40 hours, and Fe nanoparticles are thereby separated out in MgO, thus obtaining a structure in which magnetic material Fe nanoparticles are dispersed. The thus obtained magnetic material member may be used in the present invention as it is, or this member and a dielectric member may be alternately superimposed and bonded, thereby obtaining a laminated magnetic member according to the present invention. Although the same structure can be manufactured by a thin film method such as dual simultaneous sputtering, a thickness of this structure is several μm, and hence lamination is required to increase the thickness.

Other Embodiments

The relative permeability μ of a magnetic material according to the present invention can be controlled by changing a shape, crystallinity, saturated magnetization, anisotropic magnetization and others. That is, considering an ideal case of only a loss due to resonance of a magnetic moment, the relative permeability μ of a magnetic material conforms to a marginal relational expression f (frequency)×μ=C (constant). More specifically, when the relative permeability μ is determined, a threshold frequency (a frequency from which μ starts to fall) is determined. This marginal relational expression can be changed based on a shape, crystallinity and saturated magnetization. Additionally, considering one relational expression, controlling an anisotropic magnetic field can change a value of the relative permeability μ.

Therefore, determining a shape, crystallinity and saturated magnetization of a material can determine a marginal relational expression, and changing an anisotropic magnetic field can determine the relative permeability μ and the threshold frequency f (a frequency from which μ starts to fall).

That is, the relative permeability μ can be controlled by controlling a composition of a material, i.e., a shape, crystallinity, saturated magnetization and anisotropic magnetization and others. For example, the present inventors and others have confirmed that a frequency band of up to several-hundred MHz can be controlled by using ferrite, and a higher frequency band can be theoretically controlled.

Additionally, when arranging a magnetic member to face a ground plane of a printed circuit board, it is good enough to arrange the magnetic member at a position facing the metal surface excluding a signal line pattern such as a circuit pattern or a power feed pattern formed on the printed circuit board by exercising ingenuity to a shape or an arrangement position of the magnetic member. According to such an arrangement, the magnetic member can prevent an input impedance of the signal line pattern from changing.

Further, the description has been given as to the example where the dipole antenna is used as the antenna element. However, the present invention is not restricted thereto, and the present invention can be applied to other linear antennas such as a monopole antenna, an inverted F antenna or an inverted L antenna. Furthermore, the present invention can be applied to other types of antennas such as a microstrip antenna or a loop antenna.

It is to be noted that the present invention is not restricted to the foregoing embodiments, and it can be carried out by modifying constituent elements on an embodying stage without departing from the scope of the invention. Moreover, various inventions can be formed by appropriately combining a plurality of constituent elements disclosed in the foregoing embodiments. For example, some constituent elements may be deleted from all constituent elements disclosed in respective embodiments. Additionally, constituent elements in a plurality of different embodiments may be appropriately combined.

Additional advantages and modifications will readily occur to those skilled in the art. Therefore, the invention in its broader aspects is not limited to the specific details and representative embodiments shown and described herein. Accordingly, various modifications may be made without departing from the spirit or scope of the general invention concept as defined by the appended claims and their equivalents.

What is claimed is:

1. An antenna apparatus which is set on a printed circuit board comprising a metal surface to generate a ground potential, and a signal line pattern to transmit a high-frequency signal, wherein said antenna apparatus comprises:

an antenna element to which the ground potential is received from the metal surface; and a magnetic member arranged between the antenna element and the printed circuit board, wherein within said magnetic member a plurality of magnetic nanoparticles with ferromagnetism are dispersed and arranged in an insulating matrix substrate.

2. The antenna apparatus according to claim 1, wherein the magnetic member is interposed and arranged between a portion of the antenna element including a feeder end and the metal surface of the printed circuit board.

3. The antenna apparatus according to claim 1, wherein the magnetic member is obtained by superimposing a plurality of magnetic material sheets with a dielectric member therebetween, wherein each magnetic material sheet comprises the plurality of magnetic nanoparticles with ferromagnetism dispersed and arranged in the insulating matrix substrate.

4. The antenna apparatus according to claim 3, wherein the plurality of magnetic material sheets are partially superimposed and arranged at a position facing a part of the antenna element including a feeder end in the dielectric member.

5. The antenna apparatus according to claim 3, wherein the plurality of magnetic material sheets are partially superimposed and arranged at a position facing an intermediate portion of the antenna element excluding a feeder end and a distal end in the dielectric member.

6. The antenna apparatus according to claim 3, wherein the plurality of magnetic material sheets comprise a structure obtained by accordion-folding a long magnetic material sheet.

7. The antenna apparatus according to claim 1, wherein:

the magnetic member is arranged in a state in contact with the printed circuit board, and the magnetic member and the antenna element are arranged to face each other through at least one of a dielectric member and an air member.

8. The antenna apparatus according to claim 1, wherein:

the magnetic member is arranged in a state in contact with the antenna element, and the magnetic member and the printed circuit board are arranged to face each other through at least one of a dielectric member and an air member.

9. The antenna apparatus according to claim 1, wherein:

the magnetic member and the antenna element are arranged to face each other through at least one of a dielectric member and an air member, and the magnetic member and the printed circuit board are arranged to face each other through at least one of the dielectric member and the air member.

10. The antenna apparatus according to claim 1, wherein the magnetic member is interposed and arranged between an intermediate portion of the antenna element excluding a feeder end and a distal end and the metal surface of the printed circuit board.

11. The antenna apparatus according to claim 1, wherein the magnetic member is arranged at a position facing the metal surface of the printed circuit board excluding the signal line pattern.

12. The antenna apparatus according to claim 1, wherein the magnetic member is obtained by dispersing and arranging, in the insulating matrix substrate, the plurality of magnetic nanoparticles with ferromagnetism containing at least one of an Fe particle, a Co particle, an Fe—Co alloy particle, an Fe—Co—Ni alloy particle, an Fe group alloy particle, and a Co group alloy particle.

13. The antenna apparatus according to claim 12, wherein the Fe group alloy particle contains at least one of Co, Ni and an Fe—Co group particle.

14. The antenna apparatus according to claim 1, wherein the magnetic member is obtained by dispersing and arranging, in the insulating matrix substrate, the plurality of magnetic nanoparticles with ferromagnetism, comprising:

at least one of an Fe particle, a Co particle, an Fe—Co alloy particle, an Fe—Co—Ni alloy particle, an Fe group alloy particle, and a Co group alloy particle, wherein the alloy particles are made by alloying the particle with a non-magnetic metal element made of a reducible metal other than Fe and Co, and wherein the non-magnetic metal element accounts for not more than 10% of the particle.

15. The antenna apparatus according to claim 14, wherein the Fe group alloy particle contains at least one of Co, Ni and an Fe—Co group particle.

16. The antenna apparatus according to claim 15, wherein the particle diameter falls within a range of 1 to 100 nm.

17. The antenna apparatus according to claim 16, wherein the protection film consists essentially of one $Al_2O_3$, AlN, $SiO_2$, $Si_3N_4$ and SC.

18. The antenna apparatus according to claim 16, wherein the protection film has a thickness within a range 1 to 5 nm.

19. The antenna apparatus according to claim 15, wherein the particle diameter falls within a range of 10 to 50 nm.

20. The antenna apparatus according to claim 19, wherein the protection film consists essentially of one of $Al_2O_3$, AlN, $SiO_2$, $Si_3N_4$ and SC.

21. The antenna apparatus according to claim 19, wherein the protection film has a thickness within a range of 1 to 5 nm.

22. The antenna apparatus according to claim 1, wherein the magnetic member is obtained by dispersing and arranging, in the insulating matrix substrate, the plurality of magnetic nanoparticles with ferromagnetism containing at least one of an Fe particle, a Co particle, an Fe—Co alloy particle, an Fe—Co—Ni alloy particle, an Fe group alloy particle, and a Co group alloy particle and solely including a non-magnetic metal element made of a reducible metal other than Fe and Co in the particle, and wherein the non-magnetic metal element accounts for not more than 20% of the particle by volume.

23. The antenna apparatus according to claim 22, wherein the Fe group alloy particle contains at least one of Co, Ni and an Fe—Co group particle.

24. The antenna apparatus according to claim 1, wherein the magnetic member contains the magnetic nanoparticles with ferromagnetism, each of which being covered with a protection film and having a particle diameter within a range of 1 to 2000 nm.

25. The antenna apparatus according to claim 24, wherein the protection film consists essentially of one of $Al_2O_3$, AlN, $SiO_2$, $Si_3N_4$ and SC.

26. The antenna apparatus according to claim 24, wherein the protection film has a thickness within a range of 1 to 5 nm.

27. An antenna apparatus which is set on a printed circuit board including a ground surface and a feeder circuit, comprising:

an antenna element which is arranged in parallel with and separated from the printed circuit board, and includes a feeder end to which power is supplied from the feeder circuit;

a magnetic member which is interposed and arranged between a portion of the antenna element close to the feeder end and the printed circuit board, and constituted by dispersing and arranging a plurality of magnetic nanoparticles with ferromagnetism in an insulating matrix substrate; and a dielectric member which is interposed and arranged between a portion of the antenna element excluding the portion of the same close to the feeder end and the printed circuit board.

28. The antenna apparatus according to claim 27, wherein at least one of the magnetic member and the dielectric member is set between the antenna element and the printed circuit board in a state in contact with both the antenna element and the printed circuit board to support the antenna element.

* * * * *